US012420982B2

(12) United States Patent
Ismert

(10) Patent No.: US 12,420,982 B2
(45) Date of Patent: Sep. 23, 2025

(54) QUARTER-TURN LOCKING ATTACHMENT FOR A STORAGE DEVICE

(71) Applicant: Dominic P. Ismert, Marshall, MI (US)

(72) Inventor: Dominic P. Ismert, Marshall, MI (US)

( * ) Notice: Subject to any disclaimer, the term of this patent is extended or adjusted under 35 U.S.C. 154(b) by 329 days.

(21) Appl. No.: 17/750,754

(22) Filed: May 23, 2022

(65) Prior Publication Data

US 2022/0281639 A1 Sep. 8, 2022

Related U.S. Application Data

(63) Continuation-in-part of application No. 16/413,223, filed on May 15, 2019, now Pat. No. 11,338,961.

(60) Provisional application No. 62/671,896, filed on May 15, 2018.

(51) Int. Cl.

| | |
|---|---|
| ***B65D 21/02*** | (2006.01) |
| ***B65D 6/18*** | (2006.01) |
| ***B65D 6/24*** | (2006.01) |
| ***B65D 6/26*** | (2006.01) |
| *B65D 25/30* | (2006.01) |

(52) U.S. Cl.

CPC ..... *B65D 21/0224* (2013.01); *B65D 7/30* (2013.01); *B65D 11/1826* (2013.01); *B65D 11/1873* (2013.01); *B65D 25/30* (2013.01)

(58) Field of Classification Search

CPC .. B65D 21/0224; B65D 7/30; B65D 11/1826; B65D 11/1873; B65D 25/30

See application file for complete search history.

(56) References Cited

U.S. PATENT DOCUMENTS

| | | | | |
|---|---|---|---|---|
| 4,720,020 | A * | 1/1988 | Su | B65D 11/1826 220/6 |
| 4,844,277 | A * | 7/1989 | Su | B65D 81/36 220/DIG. 15 |
| 5,076,457 | A | 12/1991 | Marovskis | |
| 5,474,197 | A * | 12/1995 | Hillis | B65D 25/005 220/4.28 |
| 5,538,153 | A | 7/1996 | Marovskis et al. | |
| 5,845,799 | A * | 12/1998 | Deaton | B65D 19/18 220/23.9 |
| 6,722,515 | B2 | 4/2004 | Rumpel | |
| 7,077,374 | B1 * | 7/2006 | Johnson | B65D 85/68 411/452 |
| 7,159,730 | B2 * | 1/2007 | Rumpel | B65D 11/1833 220/23.6 |

(Continued)

FOREIGN PATENT DOCUMENTS

EP 2404837 A1 1/2012

*Primary Examiner* — Mark A Williams
(74) *Attorney, Agent, or Firm* — Polsinelli PC

(57) ABSTRACT

Implementations disclosed and claimed herein provide a customized storage system. In one implementation, a folding crate movable between a storage position and a collapsed position is provided. One or more customizable and modular attachments to the storage crates may be provided to attaching to or otherwise mating with a side of a crate. The modular attachments may include a universal connector that connects to an opening in any side of a storage crate and one or more accessories that mate with the universal connector, with each of the accessories having a specific use or utility, such as a cup holder accessory, a handle accessory, a tool holder accessory, and the like.

15 Claims, 45 Drawing Sheets

(56) References Cited

U.S. PATENT DOCUMENTS

| | | | | |
|---|---|---|---|---|
| 7,588,156 | B2 * | 9/2009 | Lorenz | B65D 11/184 220/6 |
| 10,464,542 | B2 * | 11/2019 | Charpentier | B60T 11/323 |
| 2007/0051721 | A1 * | 3/2007 | Wu | B65D 21/0201 220/23.6 |
| 2009/0084783 | A1 * | 4/2009 | Apps | B65D 19/18 220/6 |
| 2011/0062167 | A1 * | 3/2011 | Colton | B65D 19/18 220/666 |
| 2019/0352050 | A1 * | 11/2019 | Ismert | B65D 11/1826 |

* cited by examiner

QUARTER-TURN LOCKING ATTACHMENT FOR A STORAGE DEVICE

CROSS REFERENCE TO RELATED APPLICATIONS

This application is a continuation-in-part and claims priority to U.S. nonprovisional patent application Ser. No. 16/413,223, entitled "Systems and Methods for Customizable Storage" filed May 15, 2019, the entirety of which is incorporated by reference herein. This application also claims priority from U.S. Provisional Patent Application Ser. No. 62/671,896 filed on May 15, 2018, the entirety of both of which is hereby incorporated by reference herein.

FIELD

Aspects of the present disclosure relate generally to systems and methods for customizable storage and more particularly to a modular crate system having one or more crates customizable for a selected storage configuration and one or more customizable attachments to a side of the modular crate.

BACKGROUND

Crates are commonly used to store various items but are often static in their configuration or otherwise inadaptable to different needs across various users. For example, conventional crates may be designed to support the weight of heavy items, such as milk containers. However, once the crates are no longer being used to store items, their static configuration and bulky dimension is a nuisance and waste of space. Some crates fold to reduce their footprint when not in use. In doing so, many of these crates sacrifice storage capability and/or increase complexity. For example, conventional folding crates often achieve folding functionality at the expense of strength and durability for supporting heavy items. To address this issue, many folding crates contain several additional components, thereby increasing complexity and interfering with available interior storage space of the crate. This complexity is further increased with folding crates that require removal of components, such as a lid, prior to folding and/or where the folding process involves several steps.

Exacerbating these challenges, conventional crates are generally limited to a single stacking arrangement. For example, many crates are merely positionable in one or more adjacent vertical stacks, such that the crates are prone to falling as a height of the stacks increases. Some crate systems lock to each other to prevent falling. However, such crate systems often remain limited to a single stacking arrangement where all the crates must be stacked in the same orientation and/or along the same plane. Moreover, access to the interior of each of the crates in such crate systems is often inhibited or fully precluded when the crates are stacked.

It is with these observations in mind, among others, that various aspects of the present disclosure were conceived and developed.

SUMMARY

Implementations described and claimed herein address the foregoing problems by providing systems and methods for customizable storage, including customizable and modular attachments to storage crates. The modular attachments may include a universal connector that connects to an opening in any side of a storage crate and one or more accessories that mate with the universal connector, with each of the accessories having a specific use or utility, such as a cup holder accessory, a handle accessory, a tool holder accessory, and the like.

In one implementation, a customized storage system is provided. The customized storage system may have a first frame end of a crate having a first frame, a second frame end having a second frame disposed opposite the first frame, and a base panel fixed to and extending between the second frame. The customized storage system may include a lid assembly engaged to the first frame. The lid assembly may include a lid hinge assembly mounting a lid to a lid frame assembly. The lid hinge assembly may include a plurality of hinges adapted to move the lid between a closed position and an open position without changing a stacking symmetry of the crate. The customized storage system may include a first swinging panel disposed opposite a second swinging panel. Each of the first and second swinging panels may be pivotally mounted to the first frame. The first and second swinging panels may each be releasably secured to a respective swinging panel mount disposed at the second frame end when the crate is in a storage position and rotatable about a swinging axis at the first frame to move the crate into a collapsed position, the collapsed position including the first and second swinging panels being housed in an internal space of the first frame. The customized storage system may include a first folding panel disposed opposite a second folding panel. Each of the first and second folding panels may be pivotally mounted to the first frame with a respective proximal folding panel mount and to the second frame with a respective distal folding panel mount. The first and second folding panels may each be foldable along a folding axis, such that the first frame is displaced distally towards the second frame and each of the first and second swinging panels and the first and second folding panels are housed in a collapsed interior space when the crate is in the collapsed position. Each of the first and second swinging panels and the first and second folding panels may be associated with one of a plurality of selectable plane directions.

In another implementation, a customized storage system is provided. The customized storage system may include a crate movable between a storage position and a collapsed position. The crate may be positionable in at least one of a plurality of selectable crate orientations or a plurality of stacking configurations when the crate is in the storage position. The crate may have a second frame disposed opposite a first frame. The crate may have a first swinging panel disposed opposite a second swinging panel. Each of the first and second swinging panels may be pivotally mounted to the first frame. The first and second swinging panels may each be releasably secured to the second frame end when the crate is in the storage position and rotatable to move the crate into the collapsed position. The crate may have a first folding panel disposed opposite a second folding panel. Each of the first and second folding panels may be foldable to move the crate into the collapsed position.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
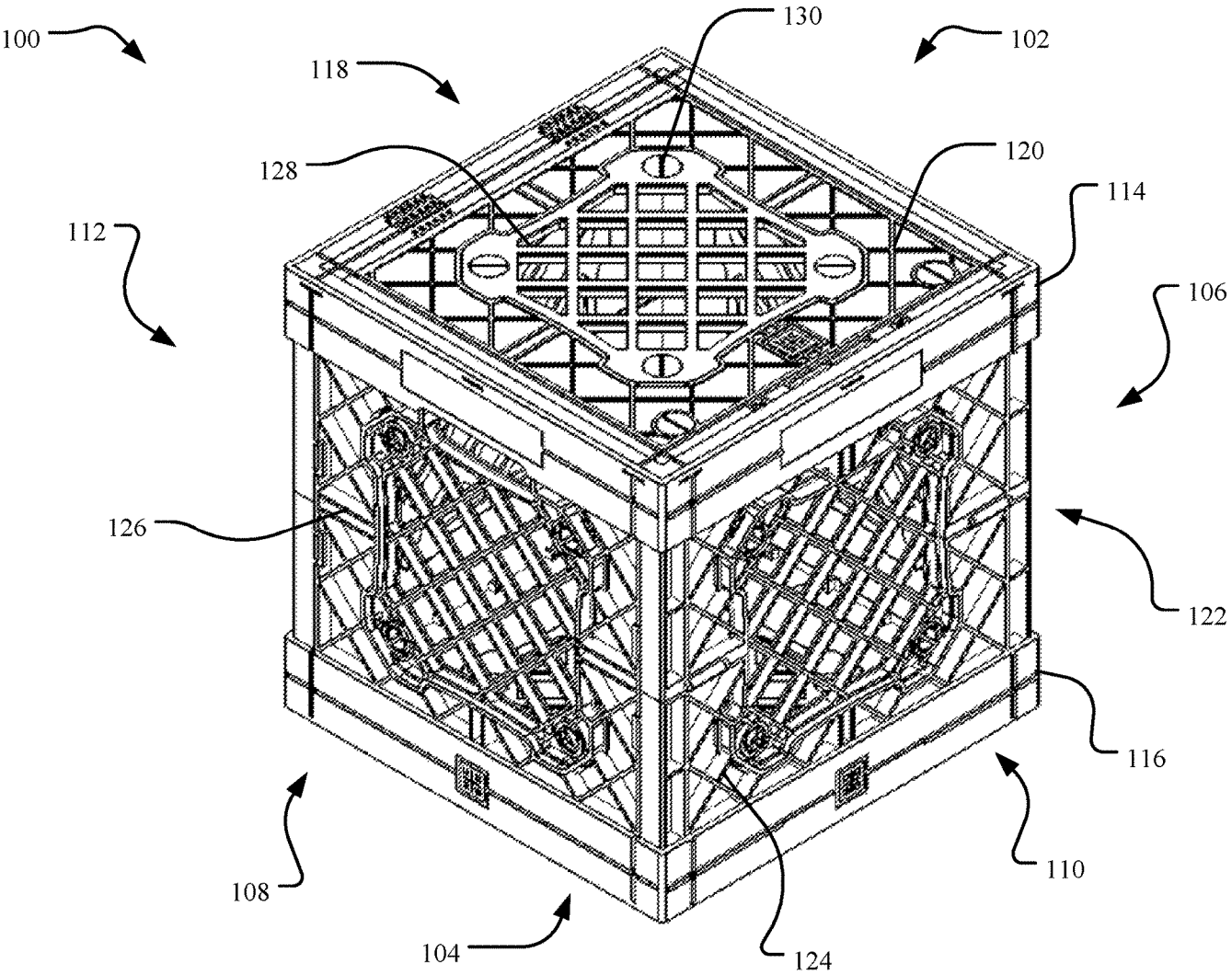
FIG. 1 shows an isometric view of an example crate.

Aspects of the presently disclosed technology relate to a modular crate system having one or more crates customizable for a selected storage configuration and methods related thereto. In one aspect, each of the crates includes a first frame disposed opposite a second frame that are each load bearing. The first frame includes a lid assembly with a removable lid. The lid is releasably connected with a lid frame using a lid hinge assembly. The lid hinge assembly may include a three-part hinge adapted to move the lid between an open position and a closed position, with a stackable dimension of the crate unchanged by the lid assembly in either the open position or the closed position.

The first frame is connected to the second frame with four panels, each having a separate planar direction. The panels may be optional, modular, removable, and/or replaceable with other modular components, such as windows, drawers, and/or the like. One set of the panels are swinging panels that are each pivotally connected to the first frame. The other set of panels are folding panels that are each pivotally connected to the first frame and the second frame and adapted to fold along a folding axis to move the crate from a storing position to a collapsed position. The panels are each hinged at the edges of the frames, such that the crate is moveable between the storage position and the collapsed position without removing the lid or the panels. When the crate is in the collapsed position, it has a dimension of a fraction (e.g., ¼, ⅓, etc.) of its height, and when the crate is in the storing position, the crate has a load bearing value in excess of 150 pounds.

Each panel includes one or more connectors adapted to releasably connect the panel to a selected panel of another crate in a customized stacking configuration. The crate is stackable in a plurality of directions, both vertically and horizontally, in all four of the planar directions. For example, a plurality of crates may be releaseably secured in a side-to-side connection for use as a shelf or during transport. In one aspect, the crate is a symmetrically stackable cube, such that any of the crate sides, including the lid, may be releasably connected to an adjacent crate in one of a plurality of selectable orientations to form a horizontal and/or vertical stacking configuration. With the crate being releaseably connected in one of a plurality of selectable orientations, the lid remains movable between the closed and open positions to access the interior of the crate, even when the crate is stacked with a plurality of adjacent crates.

In some aspects, the interior of the crate is adapted to receive or otherwise include one or more internal modular storage components. For example, the internal modular storage components may be used to organize files, paper, wine, bottles, and other items, using divider panels, internal boxes, drawers, and/or the like. The crate may contain inner fire proofing to protect items from a threat of an external fire and/or prevent a combustible product from creating a fire hazard that may spread to an exterior of the crate. The interior of the crate may further organize a series of internal boxes. For example, the interior of the crate may house a first plurality of inner boxes, which house a second plurality of inner boxes. The crate may then nest upon a larger crate with the edges remaining in alignment. In one example, the crate may house an inner box having a first opening (i.e. a lid) that may be in an open position or a closed position and a side opening that opens separately from the first opening. In the same example, the inner box may be collapsible.

The interior of the crate may be adapted to receive a flexible, foldable, collapsible, and/or sealable housing, such as a bag, for holding liquid. When the crates move from the collapsed position to the storing position the housing may be automatically or manually unfolded or otherwise erected and filled. The housing is secured within the interior of the crate and may be accessible from an exterior of the crate via the lid and/or through one or more ports defined in the panels. In one aspect, a plurality of crates is connected in series, each storing a housing holding liquid. The housings may be connected, such that the liquid flows from one to another via a flow connection, including tubing, pipes, fittings, filters, pumps, and/or the like. The crate storing the housing may be used for water purification, as a cooler, for liquid storage and dispensing, among other uses. The housings may be replaceable, reusable, and/or disposable.

As such, the presently disclosed modular crate system provides optimized storage and load bearing capabilities while facilitating transition between a storage position and a collapsed position. Further, the modular crate system is dynamic and customizable both in terms of storage configuration at the system level and orientation at the individual crate level. Further, each of the crates may have components that are replaceable, interchangeable, modifiable, removable, and/or the like, as well as include various internal modular components. Each of these features and the various associated advantages, among others, will be apparent from the present disclosure.

To begin a detailed description of an example crate 100, reference is made to FIG. 1. In one implementation, the crate 100 includes a first frame end 102 disposed opposite a second frame end 104. The first frame end 102 may be disposed at a top of the crate 100, and the second frame end 104 may form a base at a bottom of the crate 100. The first frame end 102 is connected to the second frame end 104 with a plurality of sides, each having a panel. For example, there may be four sides (106, 108, 110, and 112), each having a panel and associated with a planar direction. As described further herein, each of the sides 106-112 forms a plane that is selectively and releasably securable to a side of an adjacent crate along that direction. As such, the crate 100 may be positioned in an orientation selected from a plurality of selectable orientations and form part of a customized stacking configuration.

Figures 2A, 2B:
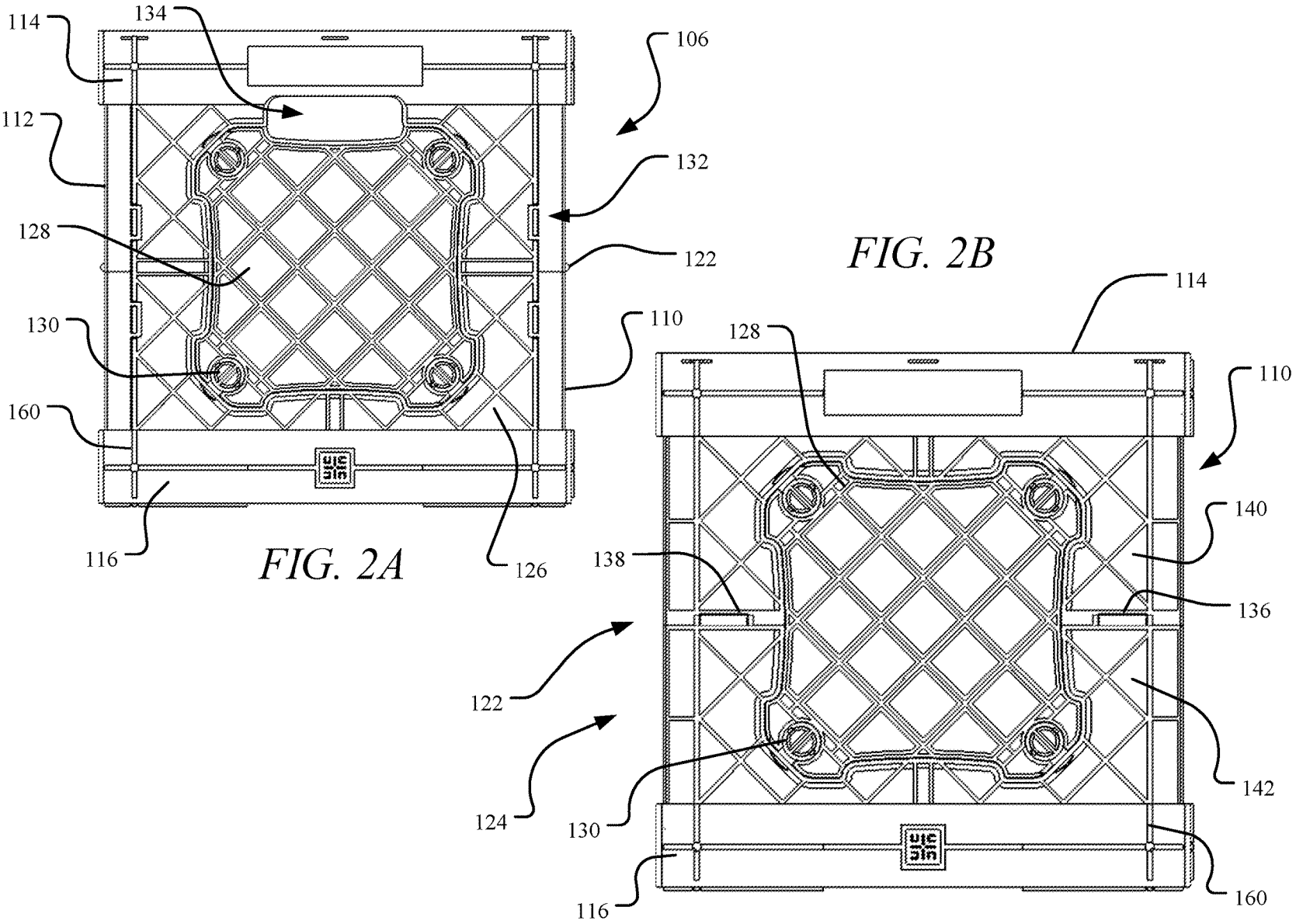
FIGS. 2A and 2B are a front view and a side view, respectively, of the crate.

In one implementation, the sides of the crate 100 include a first swinging side 106, a second swinging side 108, a first folding side 110, and a second folding side 112. In a storage position where the crate 100 receives, holds, supports, and/or otherwise stores item(s), as shown in FIGS. 1-3B, a plane of each of the swinging sides 106 and 108 may be oriented parallel to each other extending between a first frame 114 disposed at the first frame end 102 and a second frame 116 disposed at the second frame end 104. Similarly, a plane of each of the folding sides 110 and 112 may be oriented parallel to each other in the storage position and extending between the first frame 114 and the second frame 116. In one implementation, each of the sides 106-112 are positioned inwardly from an outer edge of the frames 114 and 116, such that at least a portion of each of the sides 106-112 is covered or overlapped with the frames 114 and 116. Such an overlapping relationship where the margins of the frames 114 and 116 extend beyond the surfaces of the sides 106-112 may further enhance stability in the storage position. One or more of the sides 106-112 and/or the frame ends 102-104 may include a carrying opening 134 defined therein, as shown in FIG. 2A, to facilitate lifting, moving, positioning, and carrying of the crate 100.

Referring again to FIG. 1, to access an interior of the crate 100, in one implementation, the first frame end 102 includes a lid 120 releasably connected to the first frame 114 and movable between an open position and a closed position using a lid hinge assembly 118. When the crate 100 is in the storage position and the lid 120 is in the closed position, the lid hinge assembly 118 is flush with or offset inwardly from the lid 120 and/or the first frame 114, such that the first frame end 102 forms one of a plurality of stackably symmetric sides, including the sides 106-112 and/or the second frame end 104, permitting the crate 100 to be positioned in an orientation selected from a plurality of selectable orientations. By enabling placement in such a customized orientation, the lid 120 may be positioned in a direction providing access thereto regardless of whether the crate 100 is part of a larger storage configuration or positioned in a space alone. To provide access without use of the lid 120, the crate 100 may have one or more inner panels 128 that are removable to provide a corresponding access port. The inner panels 128 may be releasably secured using one or more connectors 130, for example, within one or more of the lid 120, a folding panel 124, and a swinging panel 126. The connectors 130 may further be used to releasably secure one of the swinging panels 126, the folding panels 124, the lid 120, and/or other portions of the crate 100 to a side of an adjacent crate.

In one implementation, each of the swinging sides 106 and 108 includes a corresponding swinging panel 126, and each of the folding sides 110 and 112 includes a corresponding folding panel 124. Referring to FIG. 2A, each of the swinging panels 126 are releasably secured to each of the folding panels 124 using one or more fasteners 132. For example, a first portion of each of the fasteners 132 may extend from the folding panel 124 and be adapted to receive a corresponding portion of the fastener 132 on the swinging panel 126 in a snap-fit connection, male-female connection, and/or other mechanical, magnetic, or similar connection.

The swinging panel 126 is secured to the folding panel 124 in the storage position. Upon release of the fastener 132, the swinging panel 126 may be removed or transitioned from the storage position to the collapsed position. As described in more detail herein, in one implementation, the swinging panel 126 of each of the swinging sides 106 and 108 is released from the first frame 114 or the second frame 116 and pivoted inwardly into the other frame. For example, the swinging panel 126 may be released from the second frame 116 and pivoted inwardly along an axis at the first frame 114 until the swinging panel 126 is secured in the collapsed position within the first frame 114.

As can be understood from FIGS. 1 and 2B, each of the folding panels 124 includes a folding hinge assembly 122 having, for example, one or more folding hinges, such as a first folding hinge 136 and a second folding hinge 138. The folding hinge assembly 122 is adapted to separate the folding panel 124 into a proximal folding panel 140 and a distal folding panel 142 and move the first frame 114 and the second frame 116 towards each other until the folding panel 124 is folded and the crate 100 is in the collapsed position. In one implementation, each of the folding panels 124 is folded after each of the swinging panels 126 is pivoted as described above. In the collapsed position, a planar surface of the proximal folding panel 140 may be disposed parallel and/or adjacent to a planar surface of the distal folding panel 142, with the first frame 114 and the second frame 116 enclosing the folding panels 124.

Figure 3B:
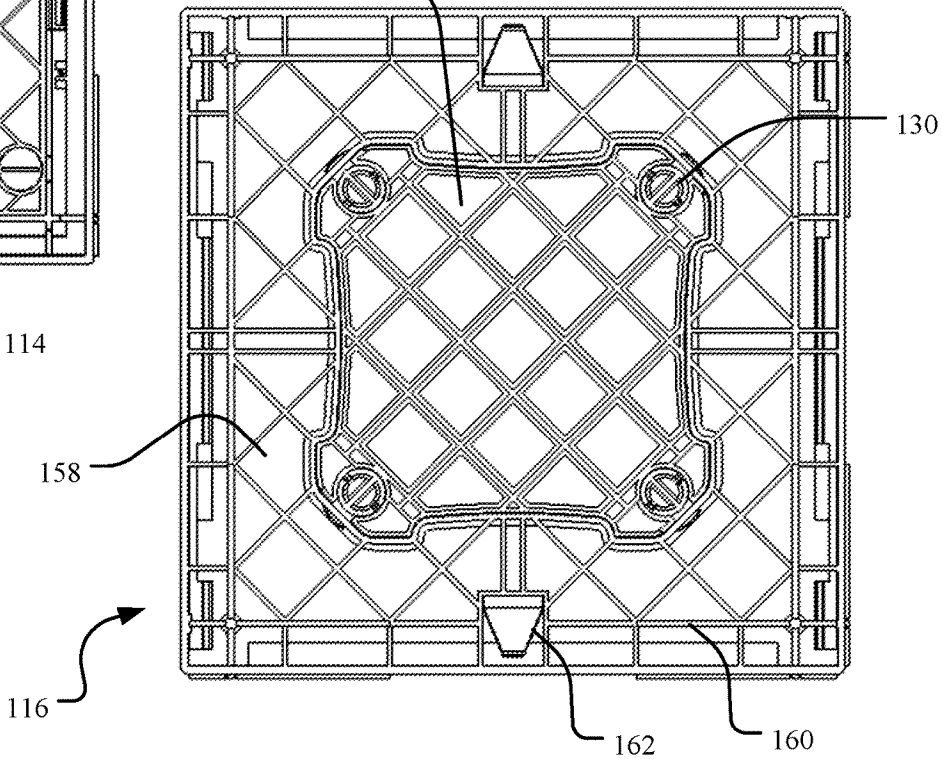
FIGS. 3A and 3B are a top view and a bottom view, respectively, of the crate.
Figure 3A:
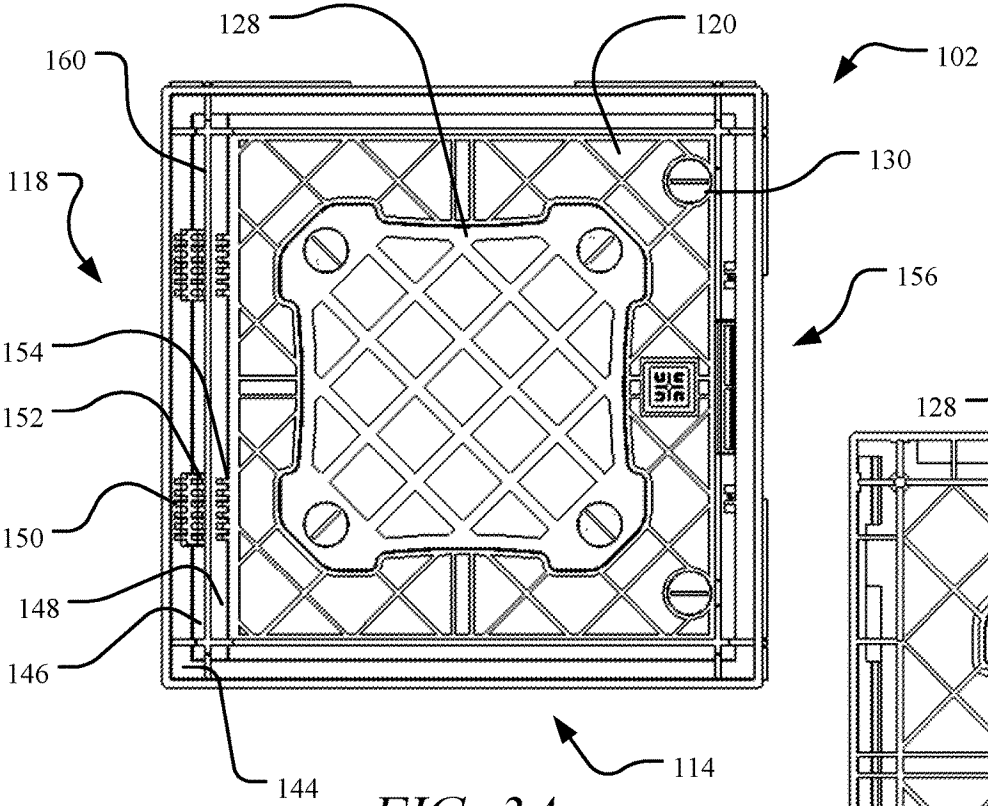

Turning to FIGS. 3A-3B, it will be appreciated that the first frame end 102 and the second frame end 104, together with the sides 106-112, form a stackable symmetric crate, such that any of the six planar sides of the crate 100 may be releasably secured to a side of an adjacent crate in a selected orientation. As described herein, the lid hinge assembly 118 connects the lid 120 to a lid frame assembly without interfering with or impinging a connection of the crate 100 to an adjacent crate at the first frame end 102. In one implementation, the lid frame assembly includes a plurality of frames, each associated with a set of one or more lid hinges. For example, the lid frame assembly may include a middle lid frame 146 positioned between an outer lid frame 144 and an inner lid frame 148. The outer lid frame 144 may be positioned proximal to the first frame 114, and the inner lid frame 148 may be positioned proximal to the lid 120. An inner lid hinge set 154 connects the lid 120 to the inner lid frame 148, a middle lid hinge set 152 connects the inner lid frame 148 to the middle lid frame 146, and an outer lid hinge set 150 connects the middle lid frame 146 to the outer lid frame 144. Such a tri-hinge configuration of the lid hinge assembly 118 facilitates movement of the lid 120 between the open and closed positions without interfering with the stacking symmetry of the crate 100. It will be appreciated that more or fewer lid frames and associated sets of lid hinges may be included and that each of the sets of lid hinges may include one or more lid hinges, for example, two lid hinges in each set, as shown in FIG. 2A. The lid 120 may be secured to the outer lid frame 144 in the closed position using a lid latch assembly 156, and following release of the lid latch assembly 156, moved to the open position using the lid hinge assembly 118.

Referring to FIGS. 3A and 3B, the lid 120 is disposed opposite a base panel 158, which may be fixed to or otherwise integrated with the second frame 116. In one implementation, the base panel 158 includes one or more latches 162 extending inwardly from the base panel 158 preventing undesirable inward movement of the swinging panels 126. As can be understood from FIGS. 2A-3B, each of the various sides of the crate 100 includes one or more stackably symmetrical tracks 160, which releasably mate with a corresponding track on a side of an adjacent crate. This stackable symmetry of the tracks 160 permits the crate 100 to be positioned in a selected orientation and connected along any planar direction of the sides to one or more adjacent crates in a customized stacking configuration.

Figure 4:
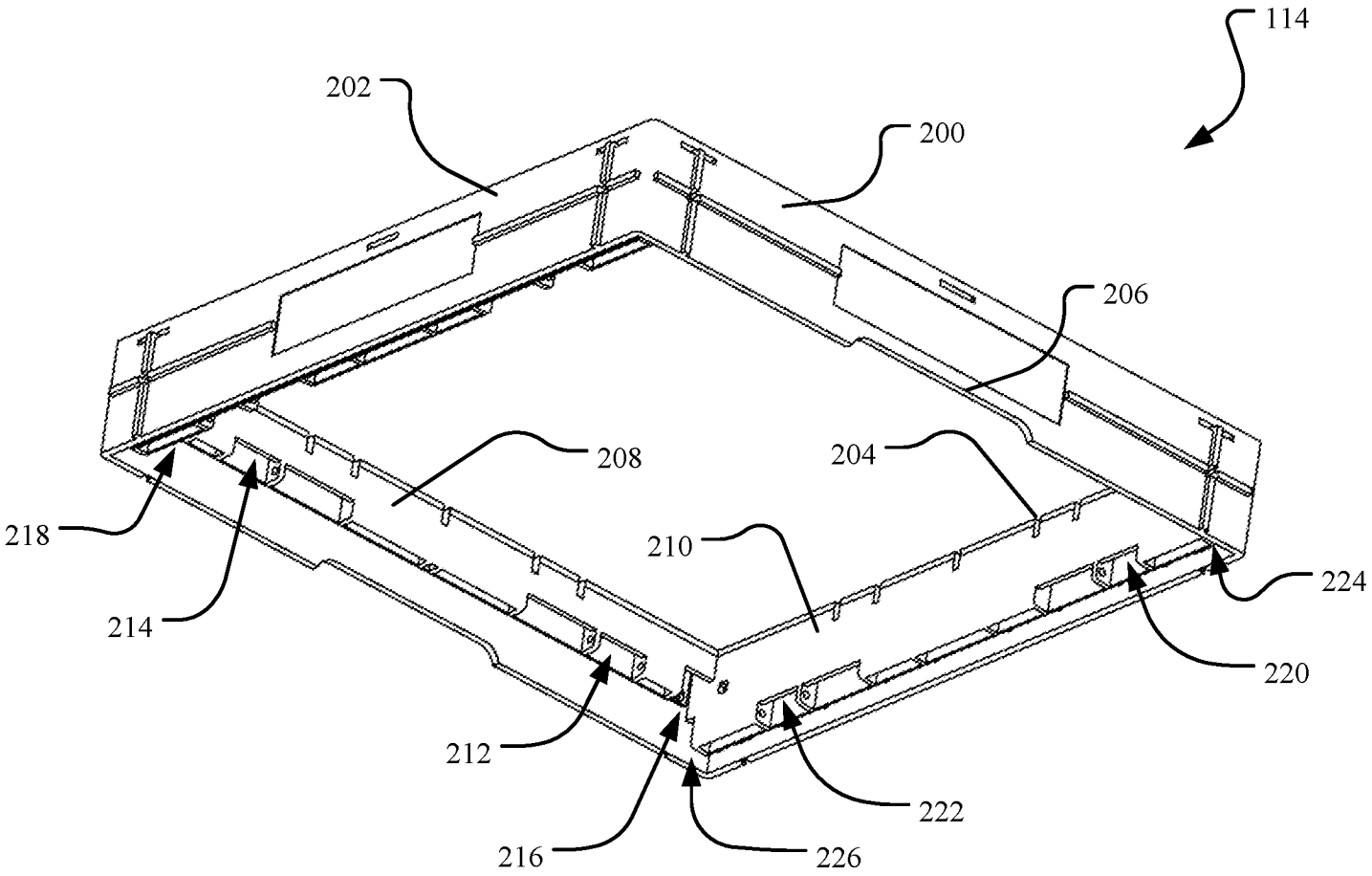
FIG. 4 shows an example first frame of the crate.

For a detailed description of the first frame 114, reference is made to FIG. 4. In one implementation, the first frame 114 includes a set of proximal swinging frame side panels 200 connected to each other with a set of proximal folding frame side panels 202. The proximal frame side panels 200 and 202 each extend transversely to and distally from the lid 120 when the lid 120 is in the closed position. One or more of the proximal frame side panels 200 and 202 may include a groove 206 forming the carrying opening 134 in part or in whole. For example, the proximal swinging frame side panels 200 may each include the groove 206 that together with a corresponding groove in the swinging panel 126 forms the carrying opening 134. One or more locking tracks 204 may be defined at a proximal end of the first frame 114, for example in a set of one or more swinging panel mounts 208 and a set of one or more proximal folding panel mounts 210, to connect the lid frame assembly to the first frame 114.

Each of the swinging panels 126 may be connected to the first frame 114 with the swinging panel mount 208, and each of the folding panels 124 may be connected to the first frame 114 with the proximal folding panel mount 210. In one implementation, the swinging panel mounts 208 each include one or more swinging hinge channels (e.g., first and second swinging hinge channels 212 and 214) and one or more swinging notch channels (e.g., first and second swinging notch channels 216 and 218). The channels 212-218 receive corresponding features of the swinging panel 126, as described herein, to pivotally mount the swinging panel 126 to the first frame 114. The swinging panels 126 are pivotable from the storage position into an internal space of the first frame 114 along an axis defined by the swinging panel mount 208. The internal space of the first frame 114 is adapted to receive each of the swinging panels 126 in the collapsed position.

Similarly, the proximal folding panel mounts 210 each include one or more proximal folding hinge channels (e.g., first and second folding hinge channels 220 and 222) and one or more proximal folding tab channels (e.g., first and second proximal folding tab channels 224 and 226). The channels 220-226 receive corresponding features of the folding panel 124, as described herein, to pivotally mount the folding panel 124 to the first frame 114. Each of the folding panels 124 pivots along an axis defined by the proximal folding panel mount 210 at the first frame 114 as the folding panel 124 separates into the proximal folding panel 140 and the distal folding panel 142 and folds, as described herein.

Figure 5:
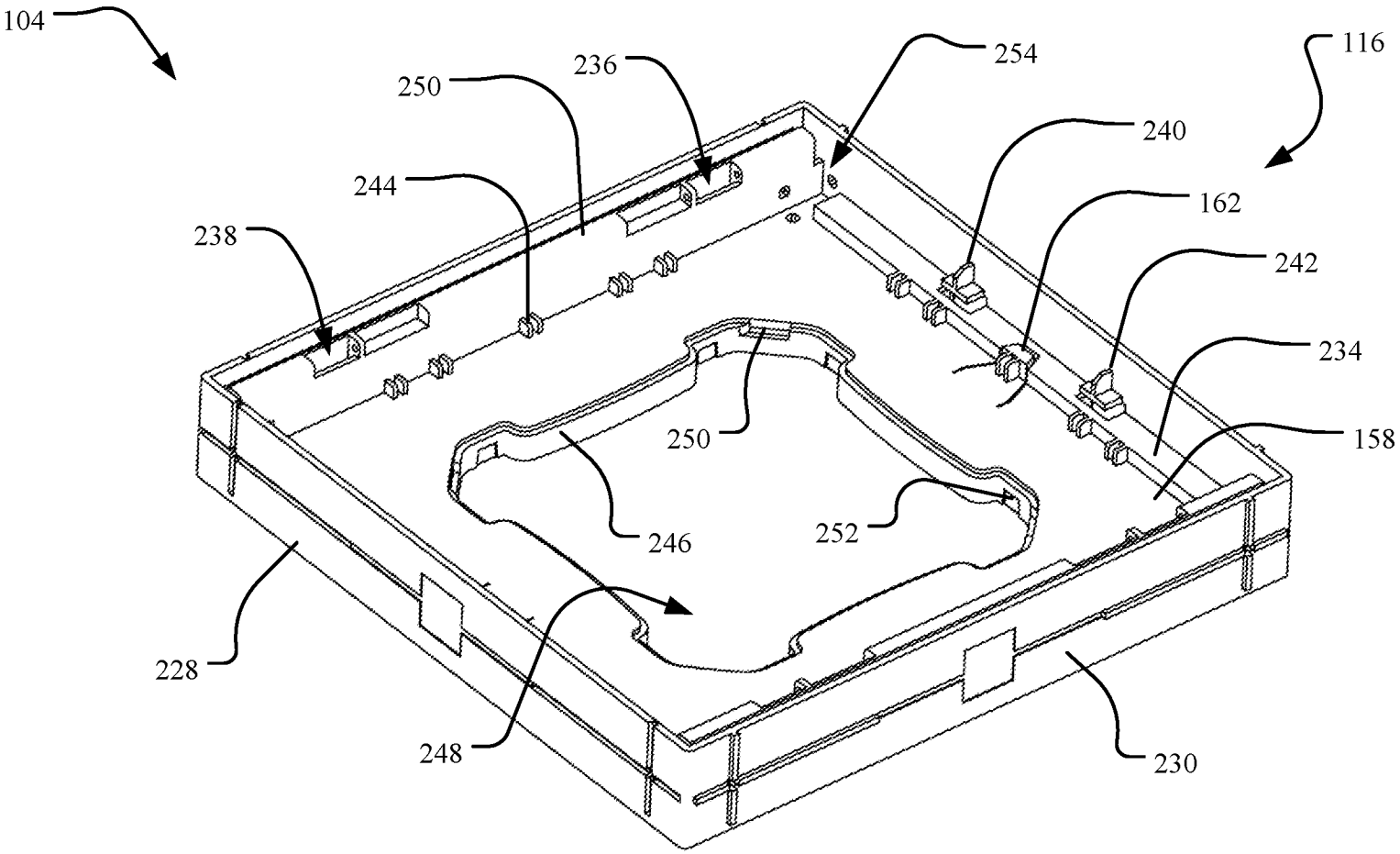
FIG. 5 illustrates an example second frame of the crate.

Turning to FIG. 5, in one implementation, the base panel 158 extends between a set of distal swing frame side panels 228 and a set of distal folding frame side panels 230 of the second frame 116. The set of distal swing frame side panels 228 are disposed relative to the set of proximal swing frame side panels 200, and the set of distal folding frame side panels 230 are disposed relative to the set of proximal folding frame side panels 202.

In one implementation, one or more distal folding panel mounts 250 extend from the base panel 158 along the distal folding frame side panels 230 in an inner space of the second frame 116. Like the proximal folding panel mounts 210, the distal folding panel mounts 250 each include one or more distal folding hinge channels (e.g., first and second distal folding hinge channels 236 and 238) and one or more distal folding tab channels. The channels, including 236-238, receive corresponding features of the folding panel 124, as described herein, to pivotally mount the folding panel 124 to the second frame 116. Each of the folding panels 124 pivots along an axis defined by the distal folding panel mount 250 at the second frame 116 as the folding panel 124 separates into the proximal folding panel 140 and the distal folding panel 142 and folds, as described herein.

One or more shelves 234 may be positioned on and/or extend from the base panel 158 along the distal swing frame side panels 228. The latch 162 and one or more catches (e.g., first and second catches 240 and 242) may be disposed along each of the shelves 234 and releasably attachable to the swing panel 126. In one implementation, the catches 240 and 242 each include support ribs and a gap recessed from a distal end of the swinging panel 126. The catches 240 and 242 and/or the shelf 234 accommodate the swinging movement of the swinging panel 126, while providing stability to the swinging panel 126 for supporting an outward force with the crate 100 is in the storage position and loaded with a weight of one or more items. Similarly, the catches 240-242 and/or the shelf 234 prevent undesired translational movement of the swinging panel 126 along a plane of the swinging panel 126 while in the storage position, and the latch 162 prevents inward movement of the swinging panel 126 while in the storage position.

Various other attachment mechanisms may be included in the second frame 116. For example, one or more guides 244 may be located at various points along the base panel 158, including, but not limited to, along the distal folding frame mounts 250 and/or the shelves 234. Internal modular components, such as a divider, may be releasably secured by the guide 244 to customize the internal storage space of the crate 100. Further, one or more attachment points 254 may be defined in the second frame 116, for example, for attachment to adjacent crates. In one implementation, the base panel 158 includes an inner edge 246 defining a panel opening 248. One or more attachment mechanisms, such as tab(s) 250 and indent(s) 252 may be disposed along the inner edge 246 for releasably engaging the inner panel 128. The other panels, including the lid 120, the swinging panels 126, and/or the folding panels 124, may similarly include these features for releasably engaging a corresponding inner panel 128.

Figure 6:
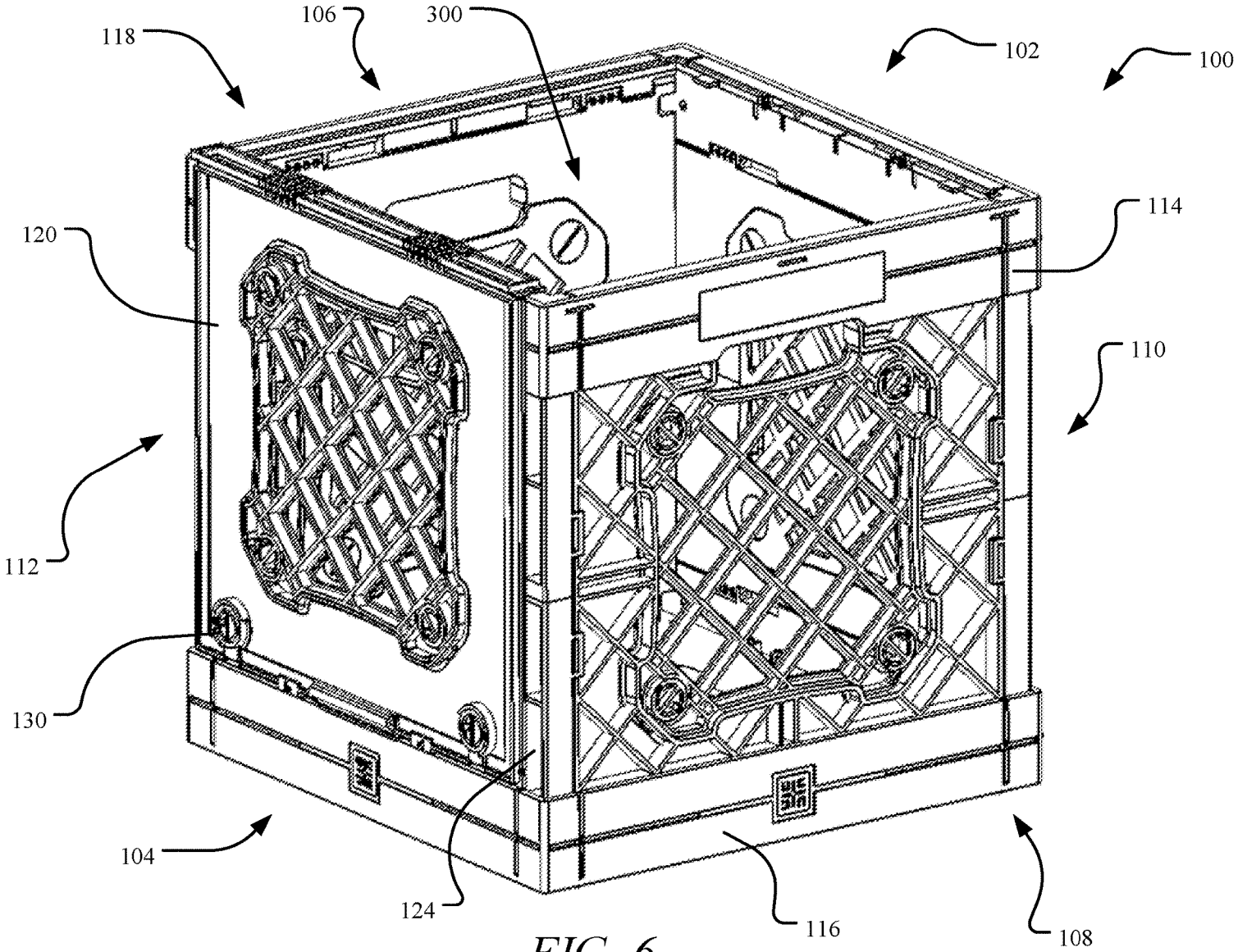
FIGS. 6 and 7 depict a side perspective view and a front view, respectively, of the crate with an example lid in an open configuration.
Figure 7:
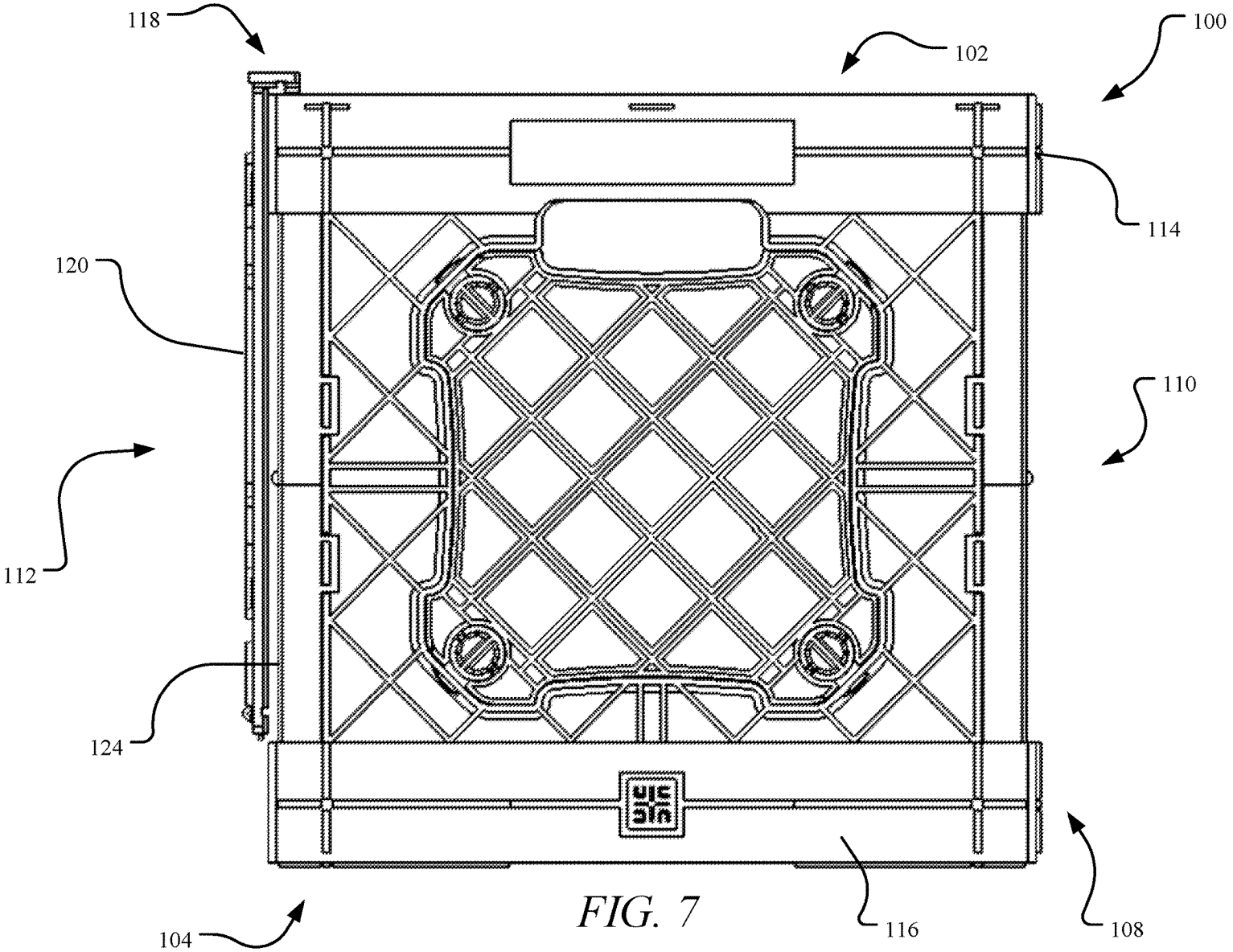
Figure 8:
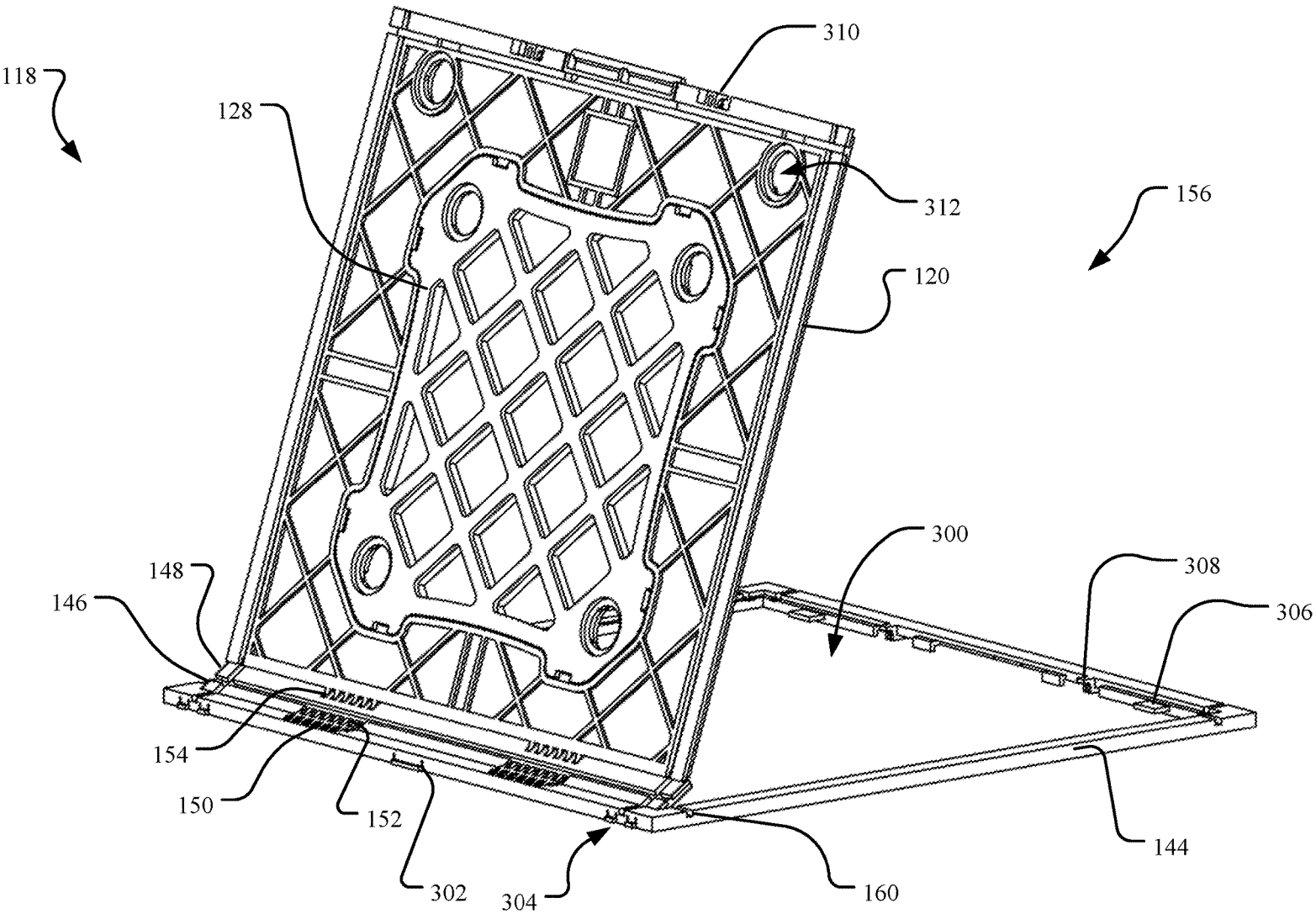
FIG. 8 shows an example lid frame with the lid partially open.

Referring to FIGS. 6-9, the lid assembly is dynamic, permitting further customization of storage by the crate 100. For example, as shown in FIGS. 6-8, the lid 120 may be moved and secured to one of the side panels in the open position without hindering the stacking symmetry of the crate 100. More particularly, whether the lid 120 is in the open position or the closed positon, one or more of the tracks 160 and/or connectors 130 remain accessible for releasable engagement to an adjacent crate. Additionally, as shown in FIG. 7, the lid frames of the lid hinge assembly 118 form a flat surface along the first frame 114, and the lid 120 is positioned adjacent and/or parallel to one of the side panels, such as the folding panel 124. Corresponding connectors 130 on the lid 120 and the folding panel 124 releasably secure the lid 120 in the open position. The connectors 130 may each connect or extend through corresponding connector openings 312. In the open position, a crate opening 300 provides access to the interior of the crate 100.

From FIGS. 6-8, it will be appreciated that the lid latch assembly 156 may be used to secure the lid 120 in the closed position and release the lid 120 for movement to the open position. In one implementation, the lid latch assembly 156 includes one or more lid hooks 310 adapted to releasably engage corresponding frame hooks 308. The outer lid frame 144 may further include one or more inner frame tabs 306 for engaging corresponding features.

Figure 9:
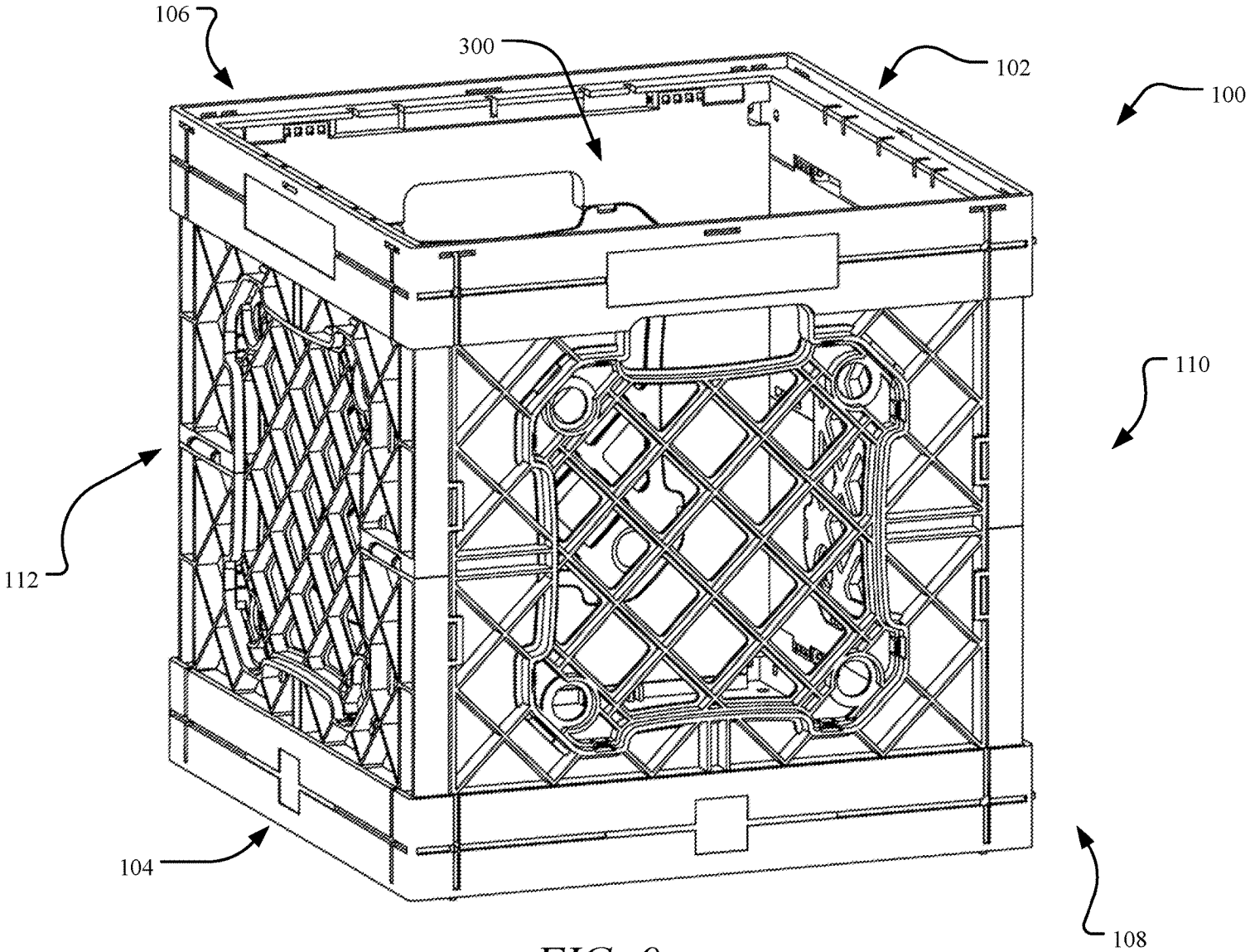
FIG. 9 illustrates the crate with the lid removed.

As can be understood from FIGS. 8-9, the lid assembly may be removed. In one implementation, the lid frame assembly includes various releasable attachment mechanisms for engaging and releasing the lid assembly from the first frame 114. For example, the outer lid frame 144 may include one or more corner frame tabs 302 and a center frame tab 302. The first frame 114 may include various corresponding attachment mechanisms, including but not limited to the locking tracks 204.

Figure 10:
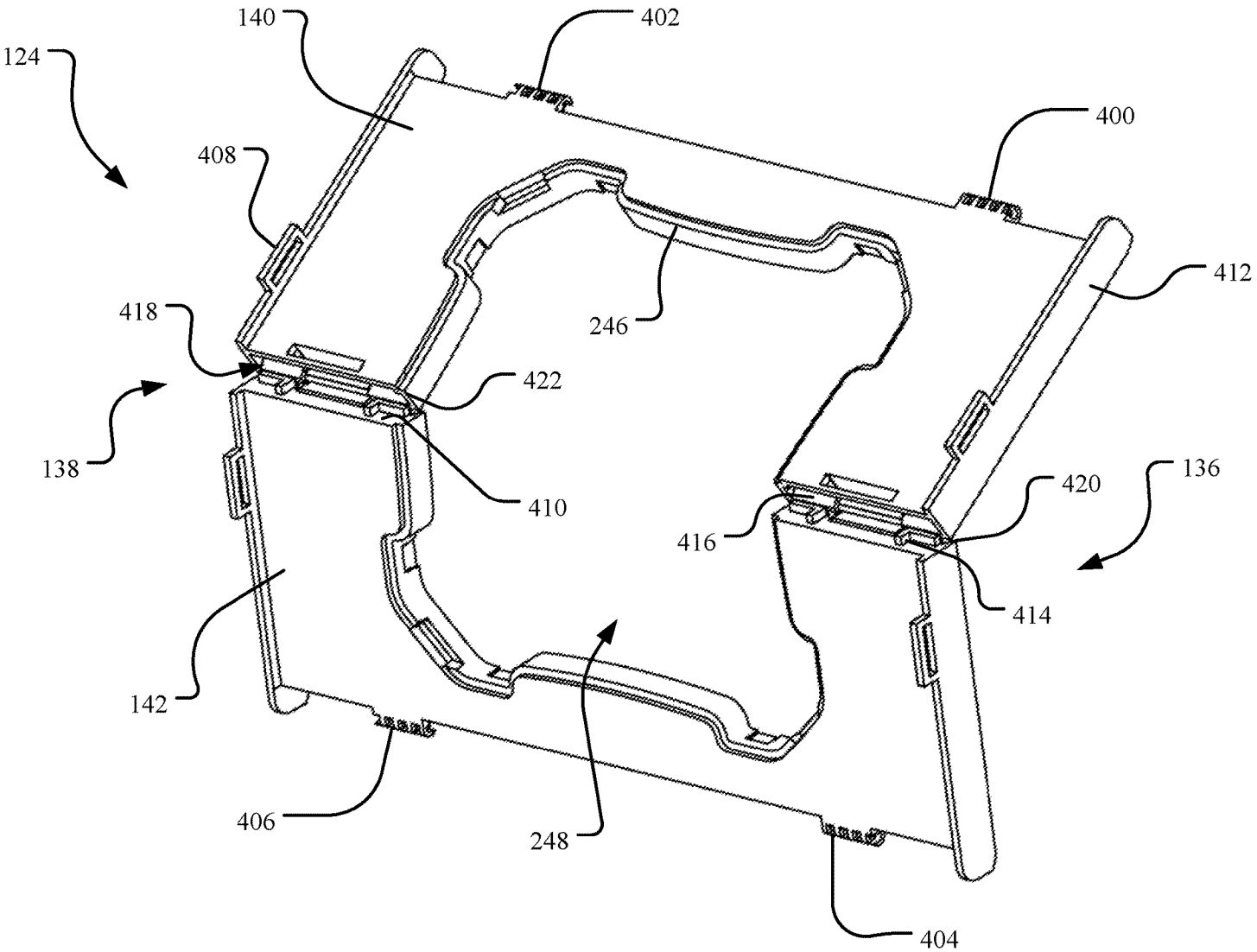
FIG. 10 depicts an example folding panel partially folded.

To continue a detailed description of the folding panel 124, reference is made to FIG. 10. In one implementation, the folding panel 124 includes one or more proximal folding hinges (e.g., first and second proximal folding hinges 400 and 402) corresponding to the one or more proximal folding hinge channels (e.g., 220-222) and one or more distal folding hinges (e.g., first and second distal folding hinges 404 and 406 corresponding to distal folding hinge channels (e.g., 236-238). The proximal folding hinges 400-402 extend proximally from the proximal folding panel 140, and the distal folding hinges 404-406 extend distally from the distal folding panel 142.

In one implementation, a set of lips 412 each extend between the proximal and distal ends of the folding panel 140 and transversely to a plane of the folding panel 124 at opposite sides. The lips 412, together with a portion of the planar surface of the folding panel 124 may form the corners of the crate 100. The lips 412 may further include one or more portions of the fasteners 132. For example, one or more fastener receivers 408 may be disposed along each of the lips 412. Each of the fastener receivers 408 may include a tab extending from an inner edge of the lip 412 with an opening defined therein. The folding tab channels (e.g., 224-226) may be adapted to accommodate the proximal and distal ends of each of the lips 412 during movement of the folding panel 124.

The proximal folding panel 140 extends distally to a distal edge 422, and the distal folding panel 142 extends proximally to a proximal edge 410. When the folding panel 124 is in the storage position, the distal edge 422 is touching or otherwise supported by the proximal edge 410 at each of the folding hinges 136 and 138. As the folding panel 124 begins folding, as shown in FIG. 10, the distal edge 422 separates from the proximal edge 410 at the inner side. The edges 422 and 410 continue to pivot about a folding axis 420 relative to each other until the outer planar surfaces of the proximal folding panel 140 and the distal folding panel 142 are disposed parallel to each other and the edges 422 and 410 forming a contiguous plane and/or being offset relative to each other.

In one implementation, the distal edge 422 of the proximal folding panel 140 extends about an outer boundary of the proximal folding panel 140, and the proximal edge 410 of the distal folding panel 142 is a solid continuous surface. Here, the distal edge 422 defines a cavity 418 adapted to house a folding hinge pin 416 generating the pivot of the proximal folding panel 140 relative to the distal folding panel 142 along the folding axis 420. The cavity 418 may further house one or more projections 414 extending from the surface of the proximal edge 410 and adapted to align the panels 140-142 during the transition from the collapsed position to the storage position when the proximal edge 410 meets the distal edge 422 and the projections 414 are disposed in the cavity 418.

Figure 11:
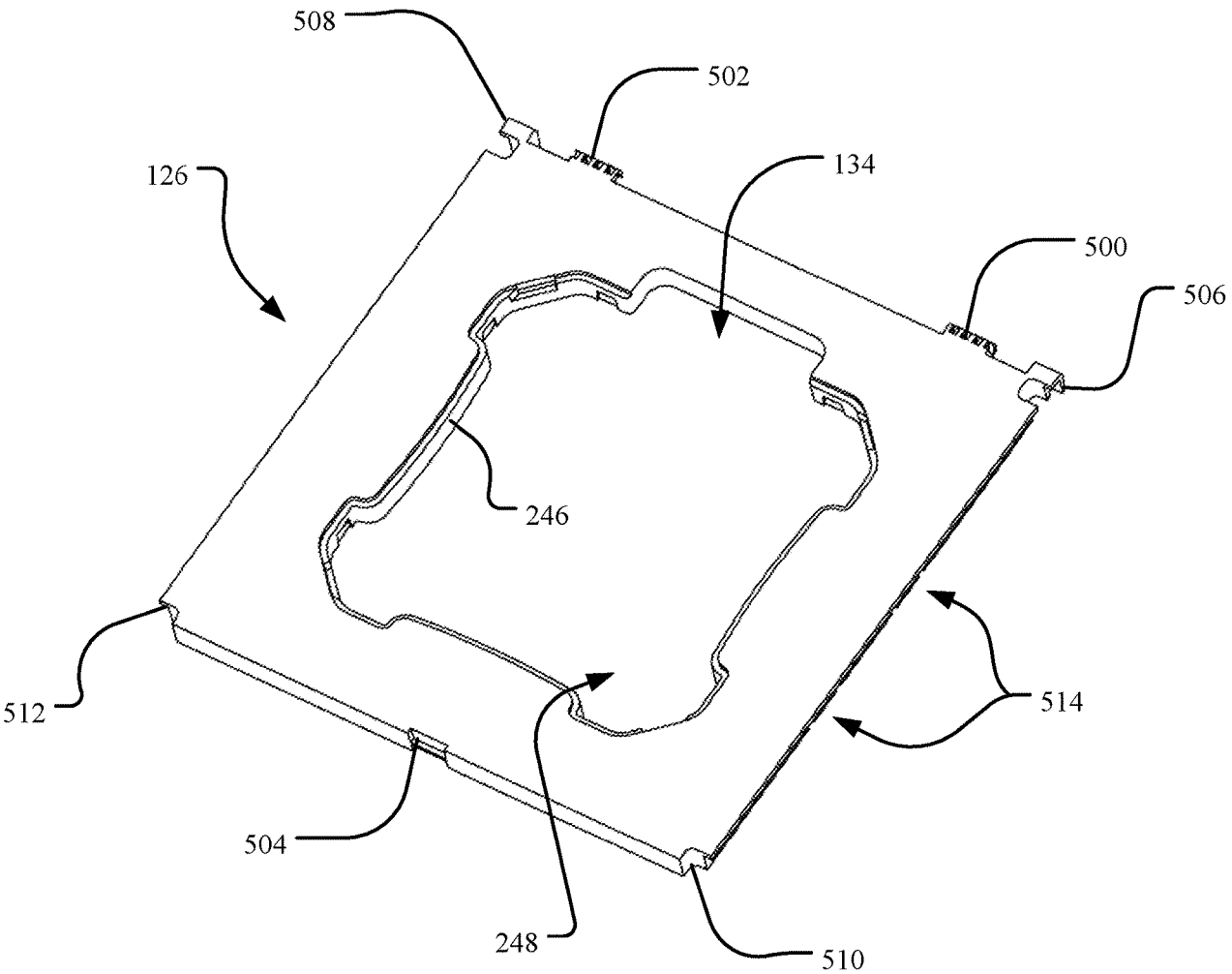
FIG. 11 shows an example swinging panel.
Figure 12:
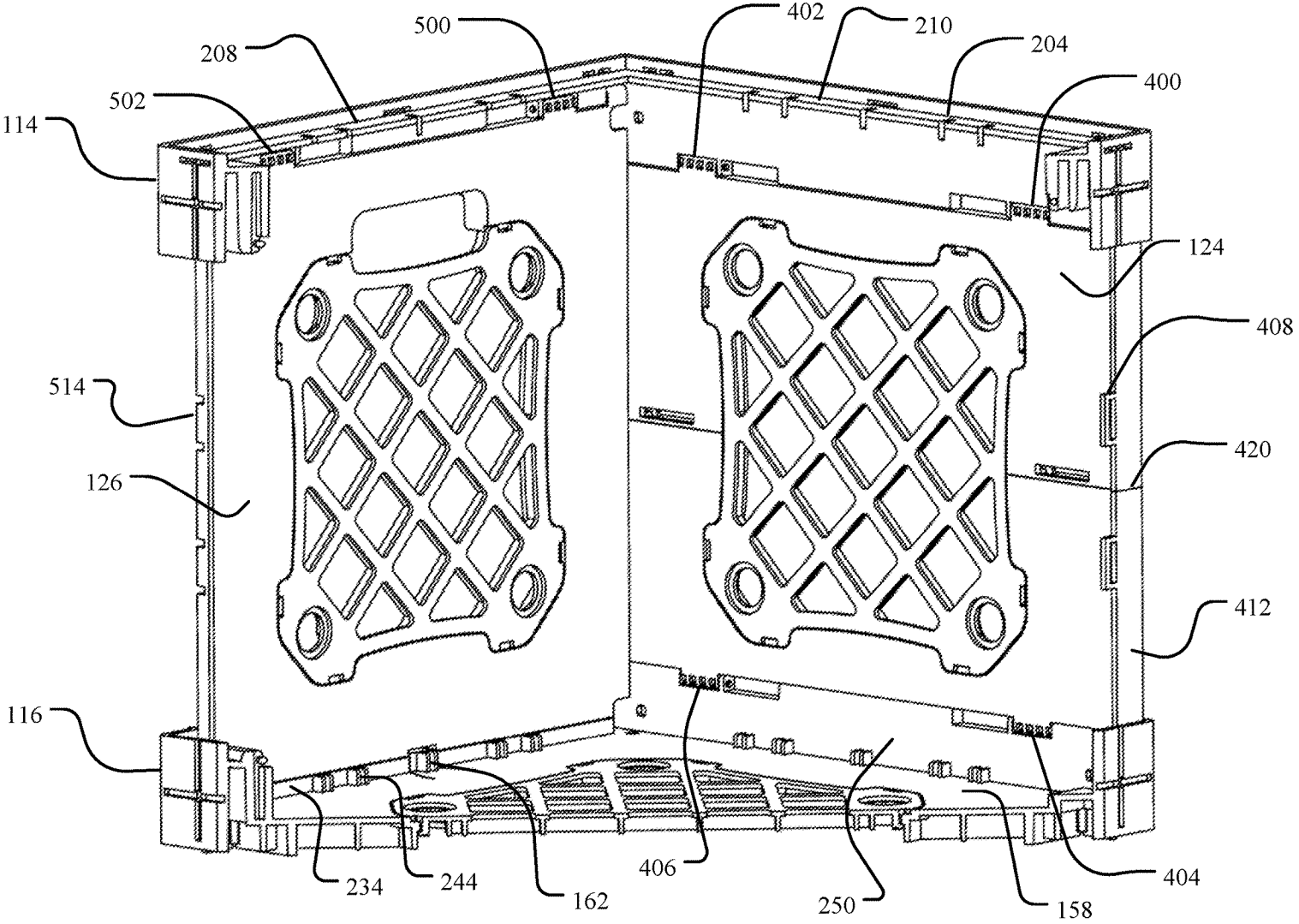
FIG. 12 illustrates an interior of the crate with a portion of the crate not shown for clarity.
Figure 13:
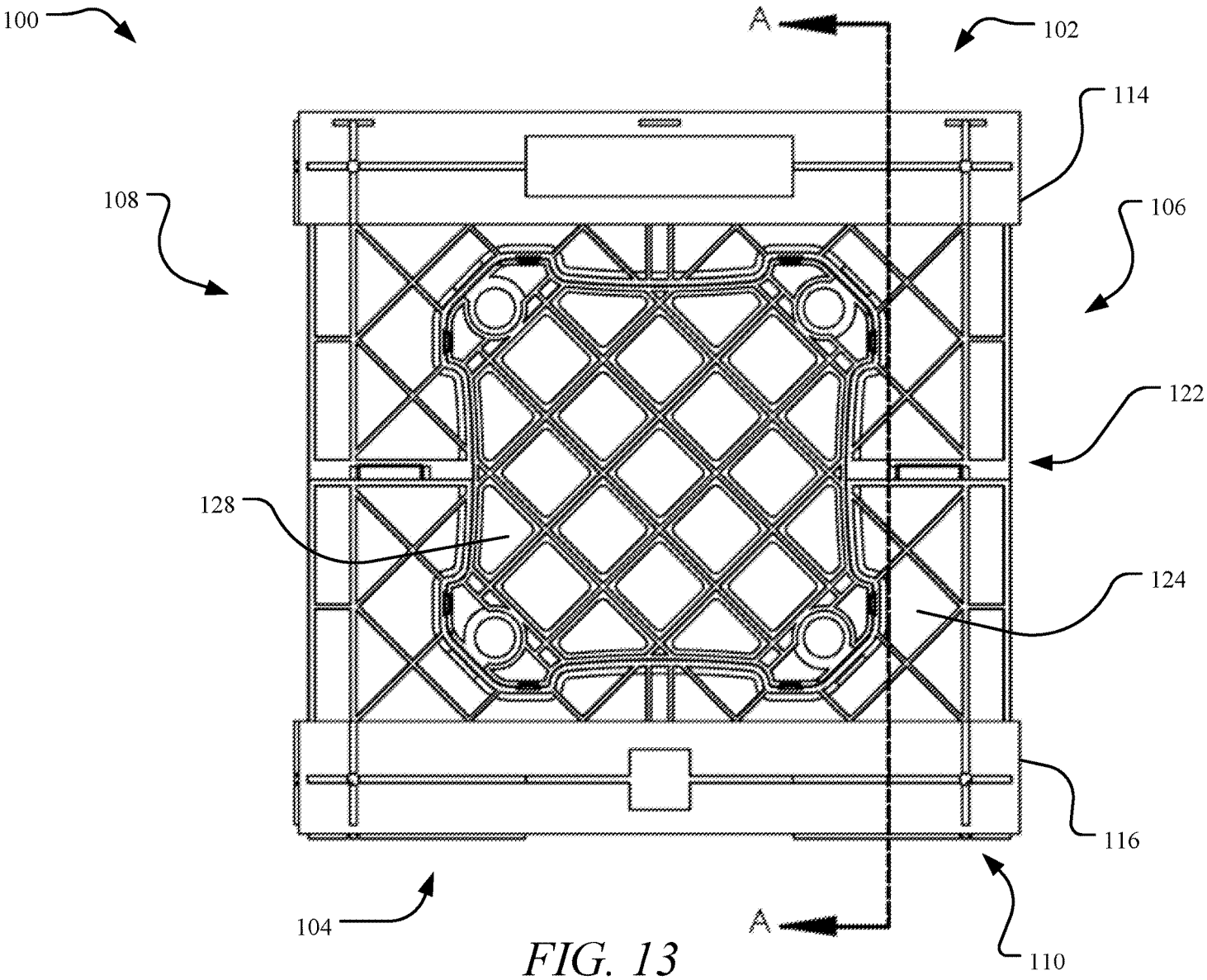
FIG. 13 shows a side view of the crate.
Figure 14:
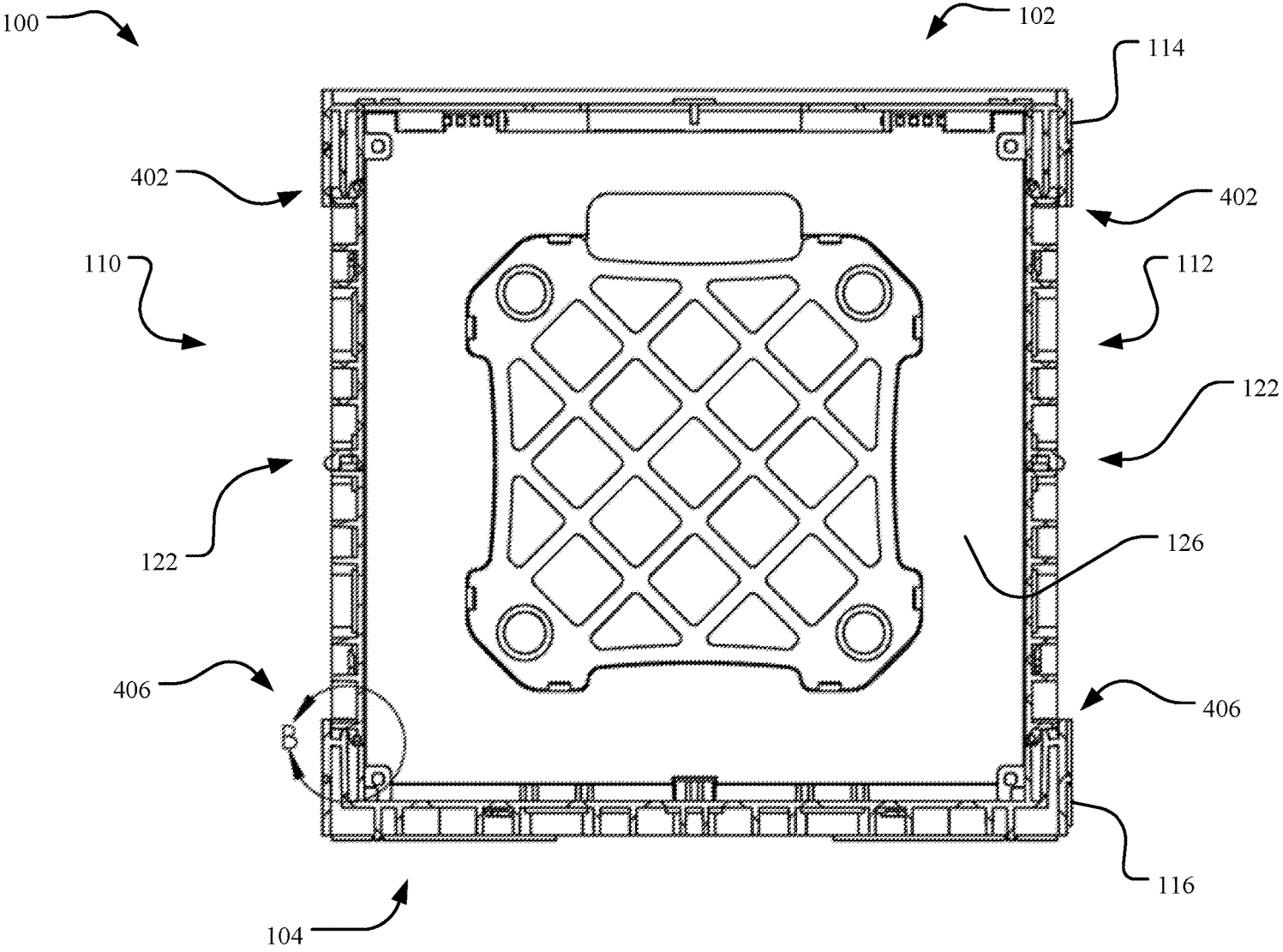
FIG. 14 depicts a cross-sectional view of the crate taken along line A shown in FIG. 13.
Figure 15:
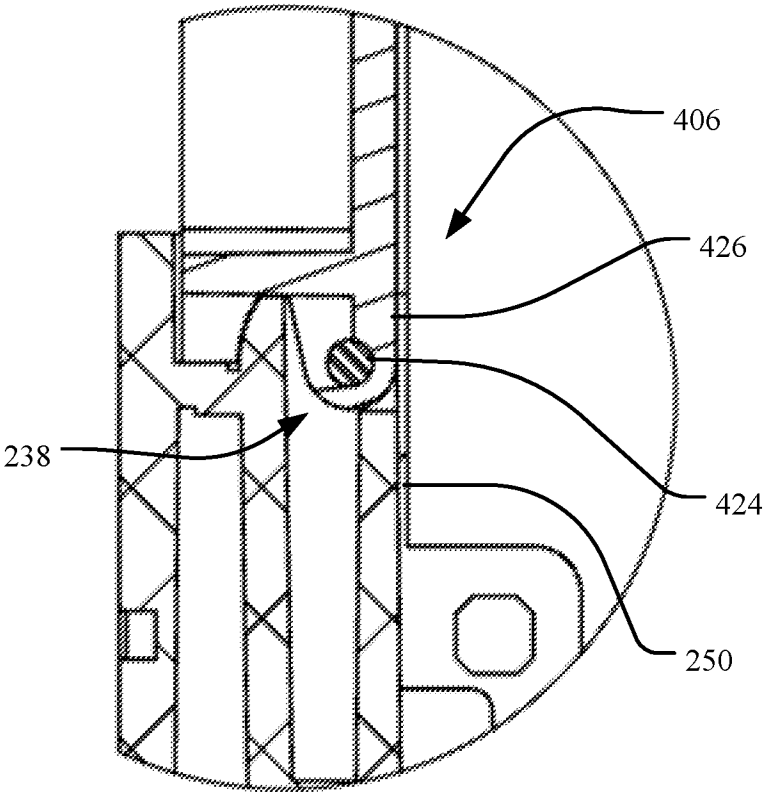
FIG. 15 is a detailed view of the hinge depicted in area B shown in FIG. 14.
Figure 16:
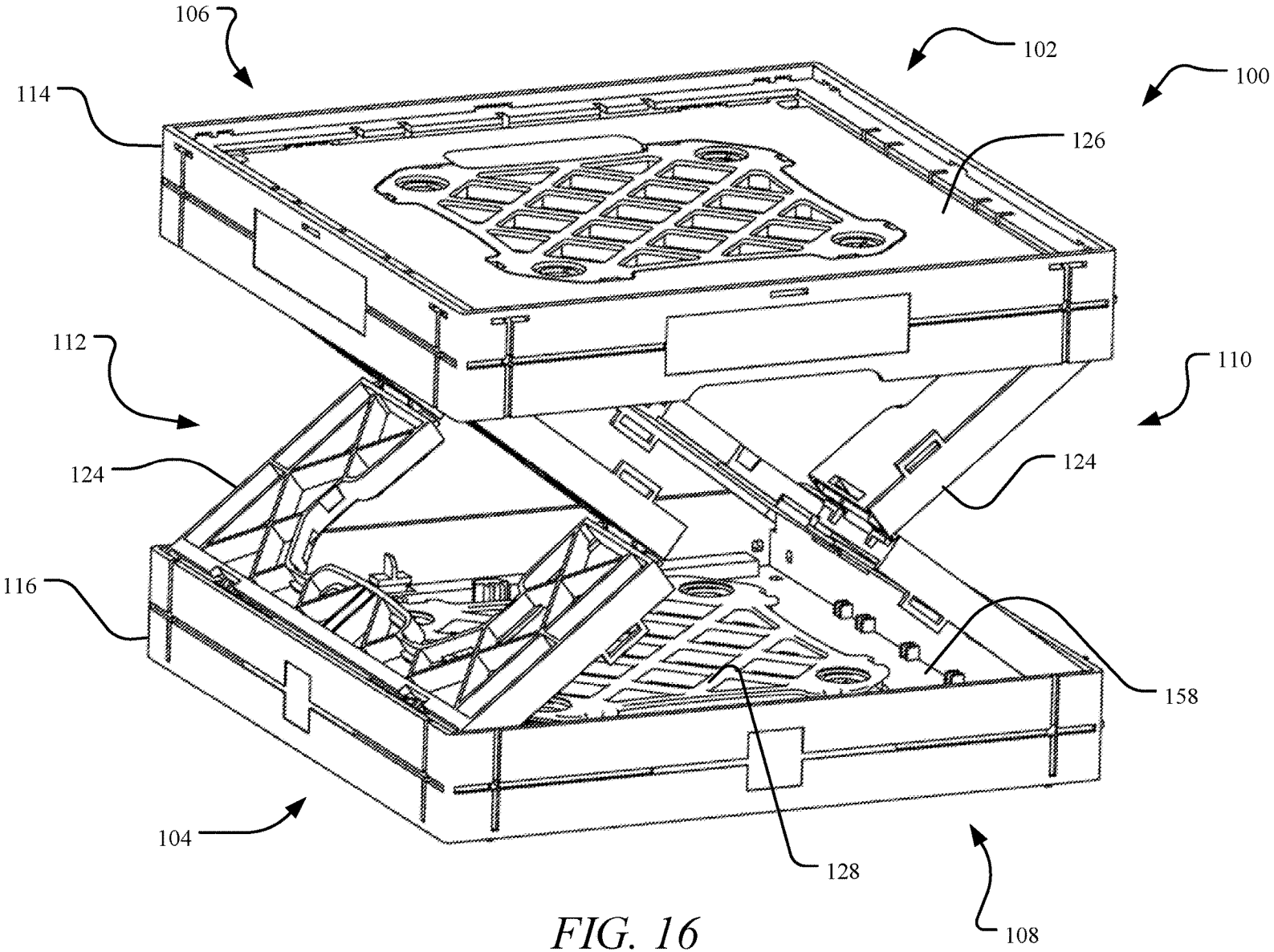
FIG. 16 illustrates the crate partially collapsed.
Figure 17:
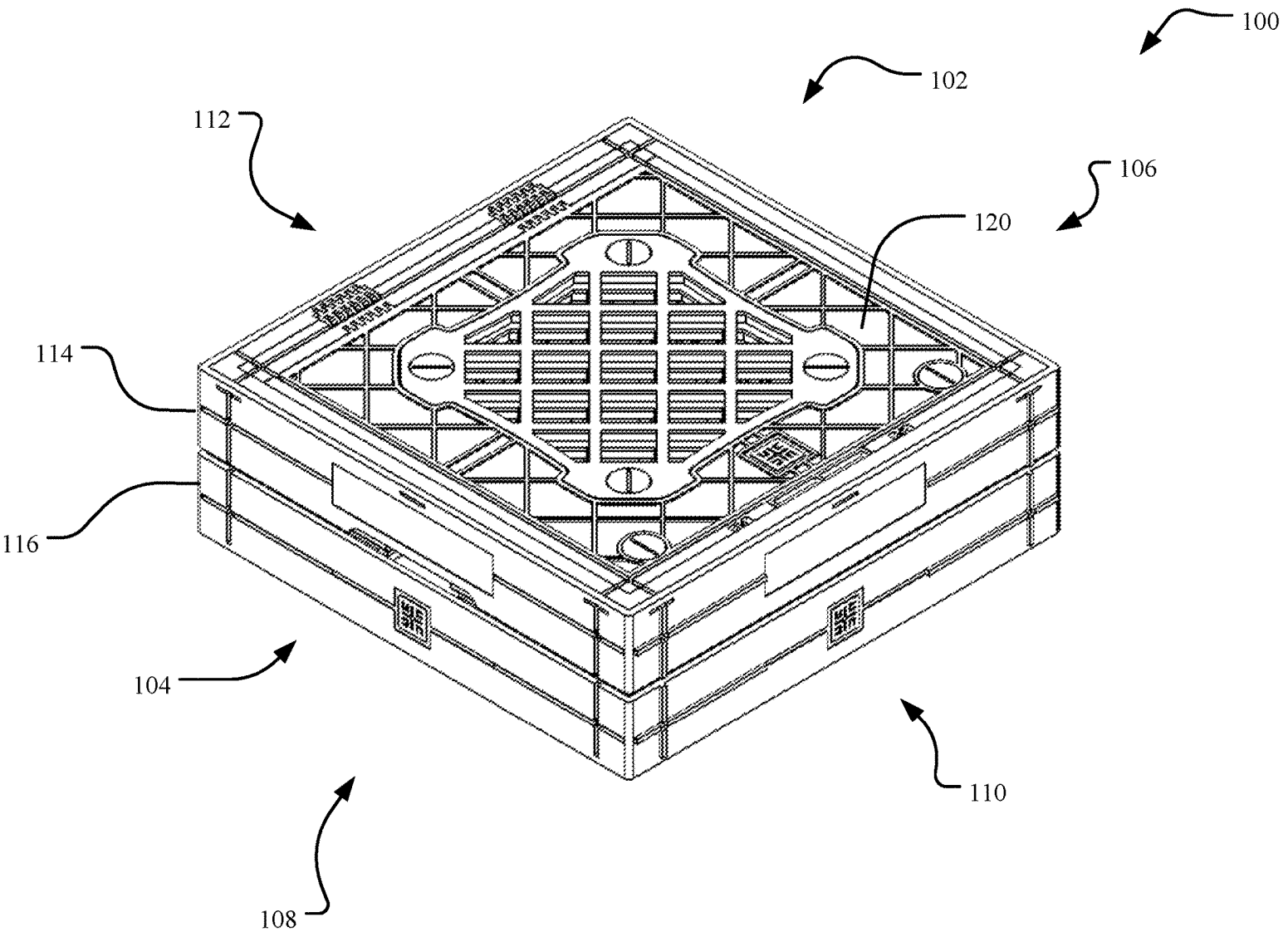
FIG. 17 and FIG. 18 are a top perspective view and a bottom perspective view, respectively, of the crate in a collapsed position.
Figure 18:
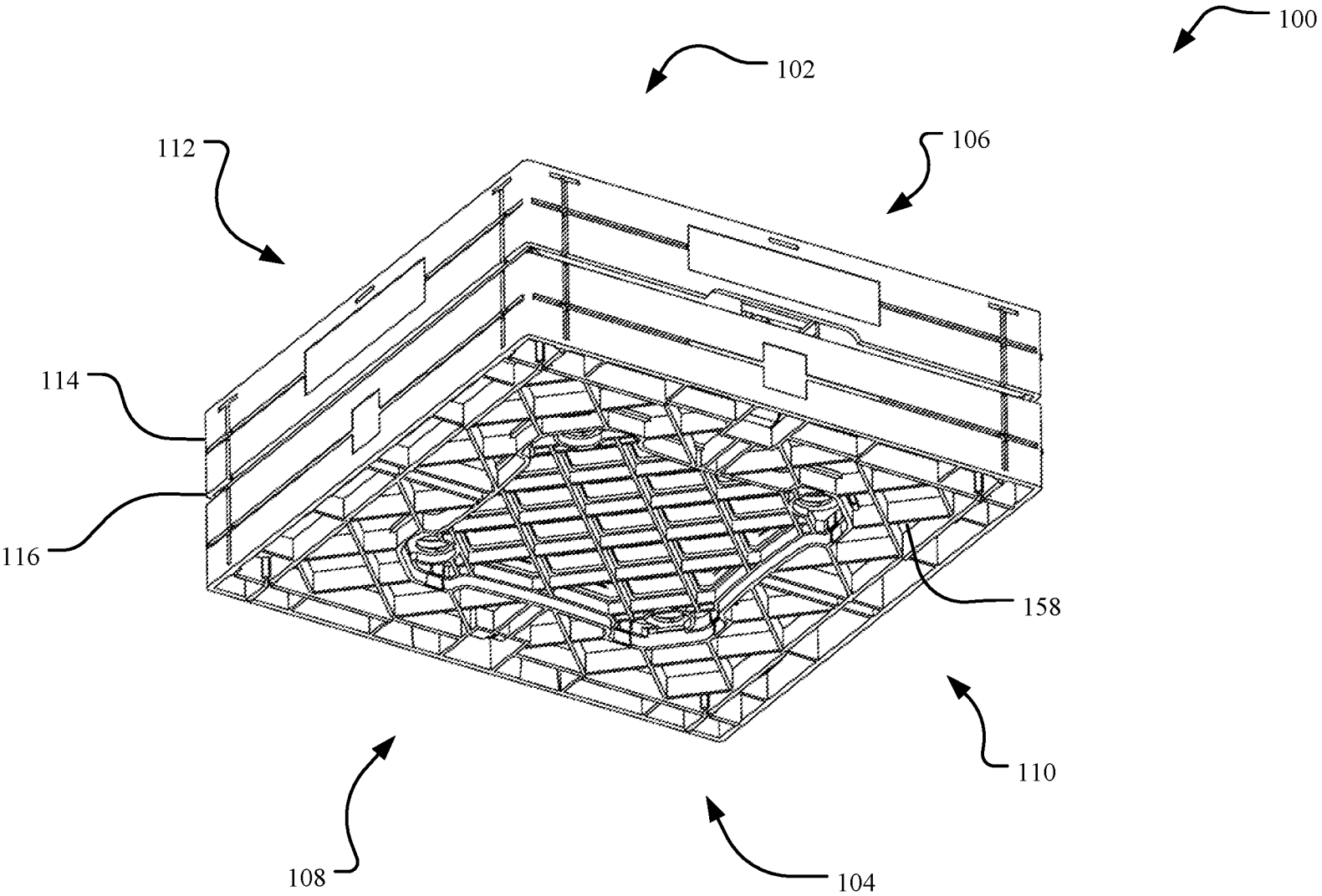
Figure 19B:
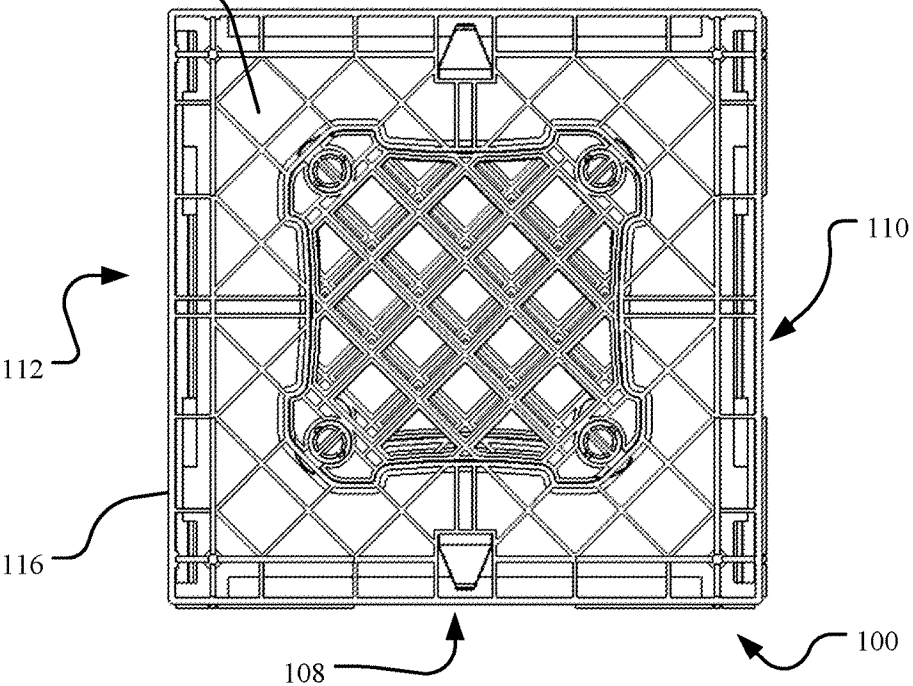
FIG. 19A and FIG. 19B are a top view and a bottom view, respectively, of the crate in the collapsed position.
Figure 19A:
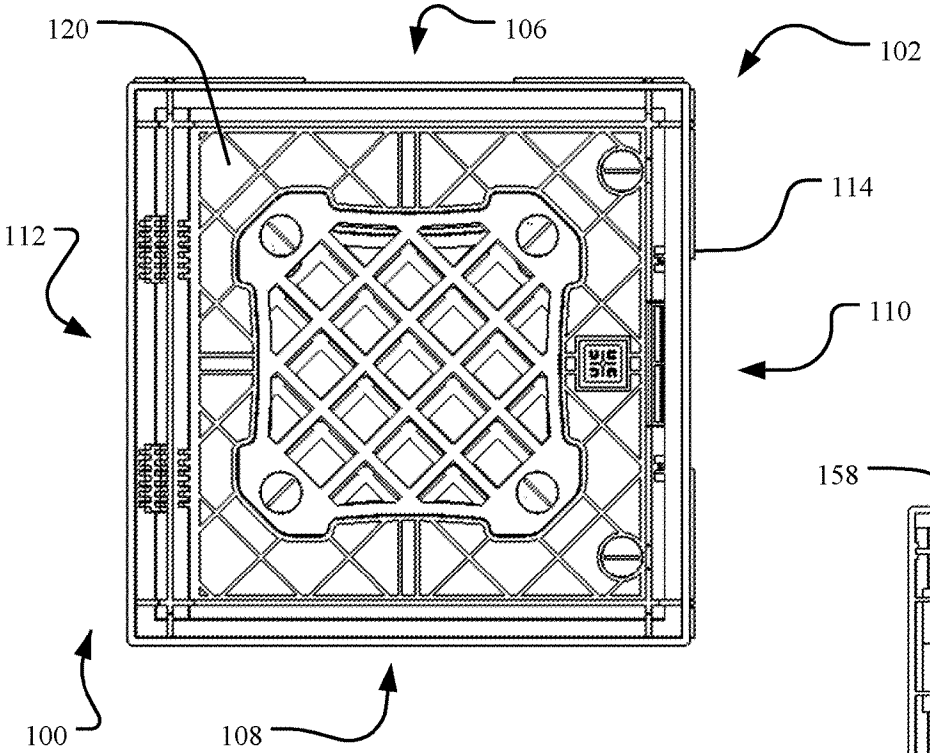
Figure 20A:
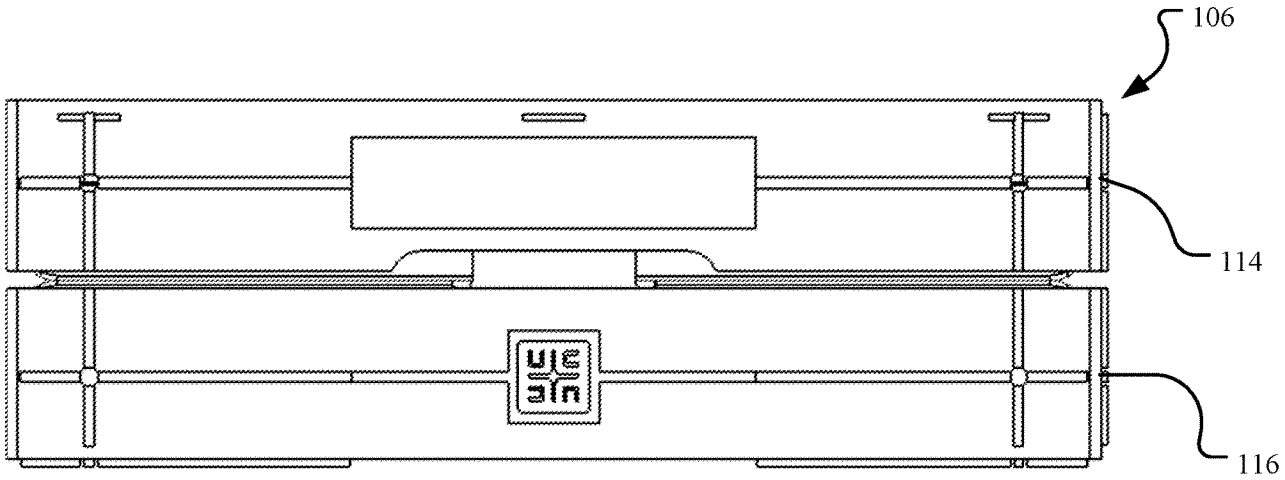
FIG. 20A and FIG. 20B are a front view and a side view, respectively, of the crate in the collapsed position.
Figure 20B:
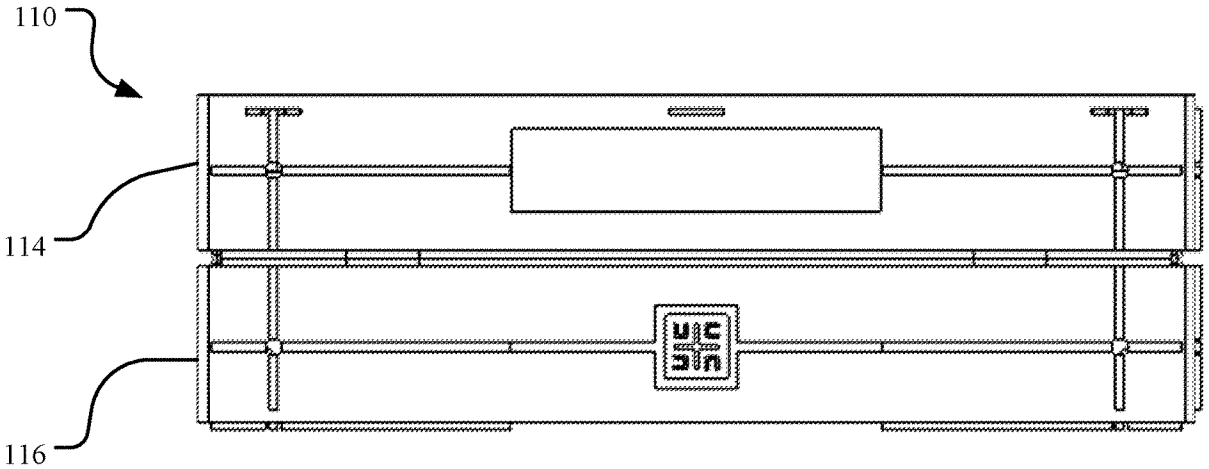

Turning to FIG. 11, in one implementation, the swinging panel 126 includes one or more swinging hinges (e.g., first and second swinging hinges 500 and 502) corresponding to the one or more swinging hinge channels (e.g., 212-214) and one or more swinging notches (e.g., first and second swinging notches 506 and 508) corresponding to the one or more swinging notch channels (e.g., 216-218). The swinging hinges 212-214 and the swinging notches 506-508 each extend from or are otherwise disposed at a proximal end of the swinging panel 126. The swinging hinges 212-214 are pivotally mounted within the swinging hinge channels 212-214, such that the swinging panel 126 may be rotated between the storage position and the collapsed position along an axis defined at the first frame 114. The swinging notches 506-508 align the swinging panel 126 relative to the first frame 114 during this pivotal movement and rotate within the swinging notch channels 216-218. One or more guide notches (e.g., first and second guide notches 510 and 512) may be disposed at a distal end of the swinging panel 126 and similarly align with corresponding channels in the second frame 116 in the storage position. Each of these notches 506-512 may further provide structural stability and load bearing capability to the crate 100 when in the storage position.

In one implementation, the swinging panel 126 includes one or more fastener features for releasably securing the swinging panel 126 in the storage position and providing load bearing stability to the crate 100. For example, the swinging panel 126 may include a catch fastener 504 disposed opposite the swinging hinges 212 and 214 for releasably engaging the catches 240-242, the latch 162, and/or other features of the shelf 234 in the storage position. While engaged, these features provide stability to the swinging panel 126 for supporting an outward force with the crate 100 is in the storage position and loaded with a weight of one or more items preventing undesired translational and/or inward movement of the swinging panel 126 while in the storage position.

Similarly, one or more portions of the fasteners 132 may be disposed along the body of the swinging panel 126, for example, along an edge of the side(s). One or more fastener projections 514 may be disposed along and/or extend from the edge of the swinging panel 126. Each of the fastener projections 514 are receivable in the opening of the tab of the corresponding fastener receiver 408, releasably securing the swinging panel 126 to the adjacent folding panel 124 in the storage position. The various fastener features of the swinging panel 126 may be released to transition the swinging panel 126 from the storage position to the collapsed position.

As described herein, the folding panel 124 and the swinging panel 126 may optionally include the inner edge 246 defining the panel opening 248 for receiving and releasably engaging the inner panel 128. Alternatively, the panels 124 and 126 may include other features. In one implementation, an inner surface of each of the panels 124 and 126 is substantially smooth, while an outer surface includes a molded grid with one or more tracks 160 in spaced relation to the outer margins for stacking in a plurality of directions and/or orientations.

To continue a detailed description of the movement of the crate 100 between the storage position and the collapsed position, reference is made to FIGS. 12-22. Turning first to FIGS. 12-15, the swinging panels 126 and the folding panels 124 are secured in the storage position. The swinging hinges 500-502 of the swinging panel 126 are pivotally mounted to the swinging panel mount 208 along an axis in the first frame 114, and the catch fastener 504 is releasably secured to the shelf 234 at the second frame 116.

In one implementation, in the storage position, the proximal folding panel 140 is coplanar with the distal folding panel 142, forming a continuous interior surface and a continuous exterior surface, and the lip 412 is a continuous surface. The proximal folding hinges 400-402 of the folding panel 124 are pivotally mounted to the proximal folding panel mount 210 along an axis of the first frame 114, and the distal folding hinges 404-406 are pivotally mounted to the distal folding panel mount 250 along an axis of the second frame 116. In one implementation shown in FIG. 15, the second distal folding hinge 406 include a hinge arm 426 with a hinge pin 424 extending therethrough and rotationally mounting the second distal folding hinge 406 within the second distal folding hinge channel 238 of the distal folding panel mount 250. It will be appreciated that the other various hinges may have similar features. In the storage position, the swinging panels 126 may each be secured to the folding panels 124 through the engagement of the fastener receivers 408 and the corresponding fastener projections 514.

As described herein, the swinging panel 126 and the folding panel 124 each extends between the first frame 114 and the second frame 116 in the storage position. In the storage position, the relationship of the swinging panel 126 and the folding panel 124 to the first frame 114 and the second frame 116 provides structural stability and optimized load bearing capability.

Referring to FIGS. 12-16, to transition the crate 100 from the storage position to the collapsed position, in one implementation, the swinging panel 126 of each of the first swinging side 106 and the second swinging side 108 is released from the second frame 116 and pivoted into the internal space in the first frame 114, where they are secured in the collapsed position. More particularly, in one implementation, each of the fastener projections 514 of the swinging panels 126 is disengaged from the corresponding fastener receiver 408 of the folding panels 124. The various fastening features at distal end of the swinging panel 126, such as the catch fastener 504, are disengaged from the shelf 234.

Once released, the swinging panel 126 is rotated proximally and inwardly along the axis of the first frame 114 defined by the swinging hinges 500-502. The swinging panel 126 may be pivoted from a vertical orientation extending in a direction between the first frame 114 and the second frame 116, as illustrated for example in FIG. 12, to a horizontal orientation within the internal space of the first frame 114, as illustrated for example in FIG. 16. The horizontal orientation includes the swinging panel 126 being transverse to the vertical orientation and/or parallel to the lid 120 when in the closed position. The swinging panel 126 of the first swinging side 106 and the swinging panel 126 of the second swinging side 108 are each moved to the collapsed position and secured using one or more of the fastening features and/or the connectors 130. While the lid 120 is shown removed in FIG. 16 for illustrative purposes showing the swinging panels 126 in the collapsed position, as described herein, the crate 100 may be moved from the storage position to the collapsed position and maintained in the collapsed position without removal of the lid 120 or lid assembly.

In one implementation, following the securement of the swinging panels 126 in the collapsed position within the internal space of the first frame 114, the folding panels 124 are moved from the storage position to the collapsed position. Upon an application of a force upon the first frame end 102 and/or each of the folding panels 124, the proximal folding panel 140 separates from the distal folding panel 142 at the inner surface and folds along the folding axis 420 at the exterior surface. As such, the folding panels 124 of each of the first folding side 110 and the second folding side 112 fold inwardly as the first frame end 102, housing the swinging panels 126, displaces distally towards the second frame end 104. As the folding panels 124 fold, the edges 422 and 410 of each of the folding panels 124 continue to pivot about the folding axis 420 relative to each other until the outer planar surfaces of the proximal folding panel 140 and the distal folding panel 142 are disposed parallel to each other.

As shown in FIGS. 17-22, when the crate 100 is secured in the collapsed position, a distal end of the first frame 114 is disposed adjacent to a proximal end of the second frame 116, with the remaining components housed in a collapsed interior space defined by the first frame end 102 and the second frame end 104. The collapsed interior space may be formed by the lid 120, the first frame 114, the second frame 116, and the base panel 158.

The crate 100 is not only collapsible without removing the lid 120, the lid 120 and lid assembly may remain removable independent of the crate 100 being in the storage position or the collapsed position. Further, the crate 100 may remain stackable in a plurality of crate orientations and/or stacking configurations independent of being in the storage position or the collapsed position. The crate 100 easily collapses to a fraction (e.g., ¼) of its dimension while in the storage position, while housing all its components.

Figure 21:
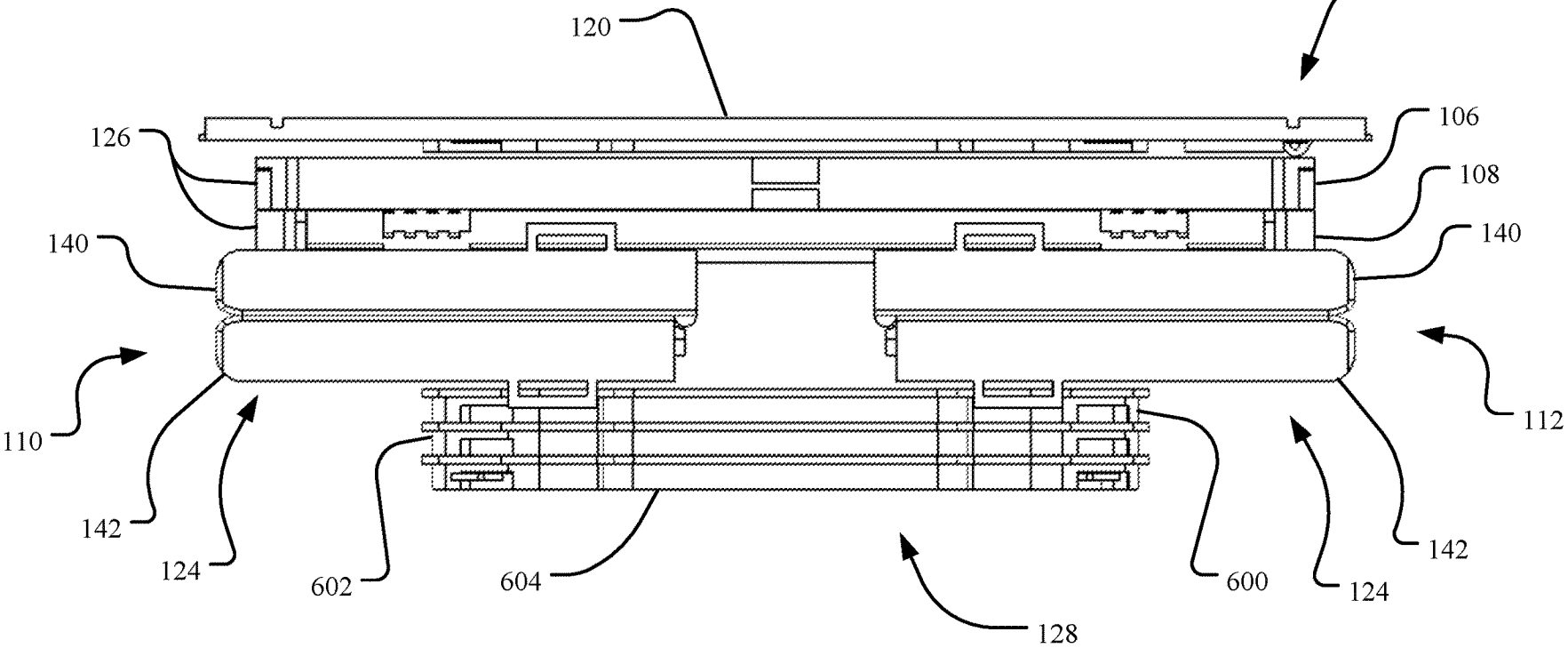
FIG. 21 and FIG. 22 are a front view and a side view, respectively, of the crate in the collapsed position with the first frame and the second frame removed for clarity.
Figure 22:
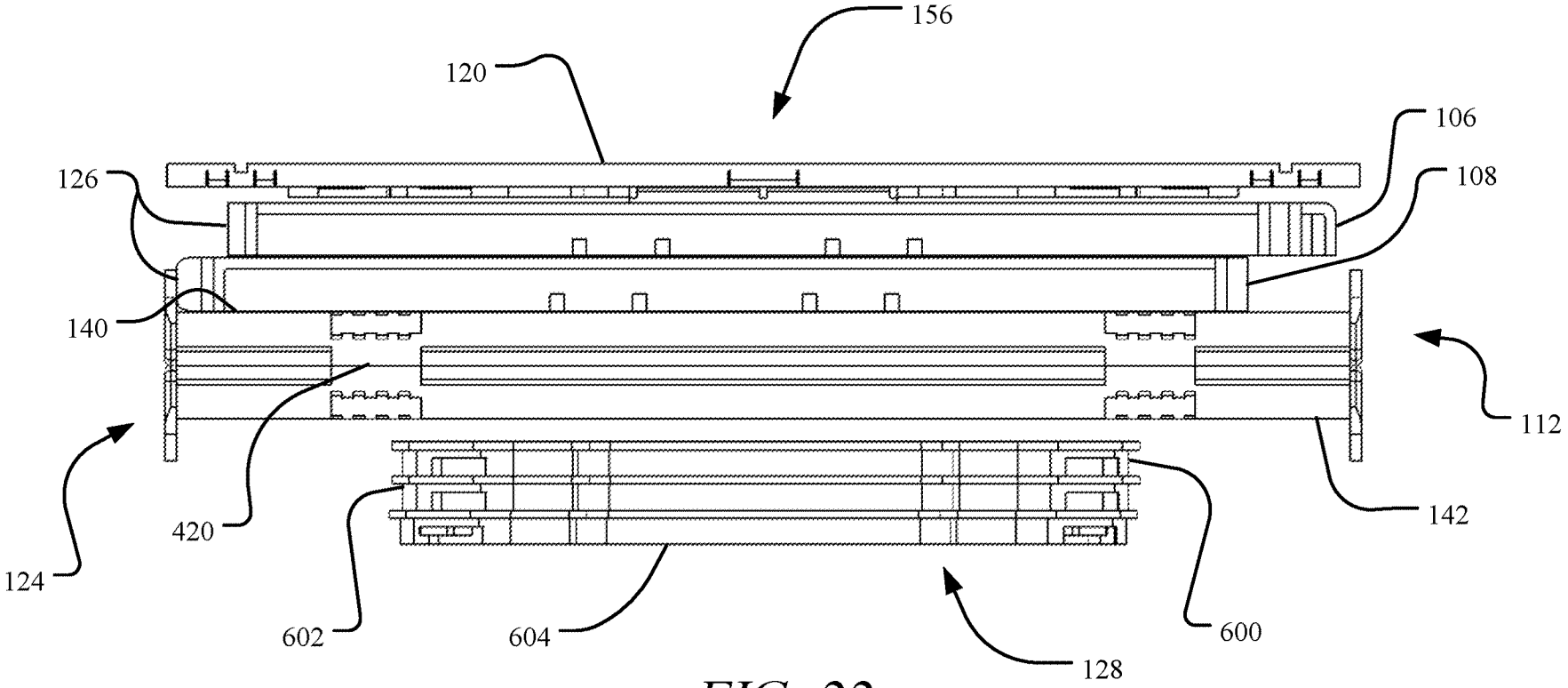

As shown in FIGS. 21-22, in one implementation, the various components of the crate 100 are housed in the collapsed interior space in a stacking arrangement. As an example, the swinging panel 126 of the first swinging side 106 and the swinging panel 126 of the second swinging side 108 may each be stacked in the portion of the collapsed interior space corresponding to the internal space of the first frame 114 distal to the lid 120. While the first swinging side 106 is shown proximal to the lid 120, it will be appreciated that either the first swinging side 106 or the second swinging side 108 may be positioned adjacent to the lid 120 depending on the order in which the swinging panels 126 are moved to the collapsed position.

Distal to the swinging panels 126, the folding panels 124 are each disposed in the collapsed position within the collapsed interior space. The proximal folding panel 140 of each of the folding panels 124 may be disposed between the swinging panel 126 and the corresponding distal folding panel 142.

In one implementation, prior to moving the folding panels 124 from the storage position to the collapsed position, the internal panels 128 may be removed to permit the folding panels 124 to fold along the folding axes 420. The internal panels 128 may also be removed from the swinging panels 126. Where the internal panels 128 are removed from one or more of the panels 124-126, the internal panels 128 may be housed in the collapsed interior space distal to the distal folding panels 142 in the portion corresponding to an internal space of the second frame 116.

For example, a first internal panel 600 may be stacked onto a second internal panel 602 in the collapsed interior space relative to a base internal panel 604 of the base panel 158. The first internal panel 600 and the second internal panel 602 may be the internal panels 128 corresponding to the folding frames 124. Here, the internal panels 128 of the swinging panels 126 may remain engaged thereto when the swinging panels 126 are secured in the collapsed position.

Figure 23B:
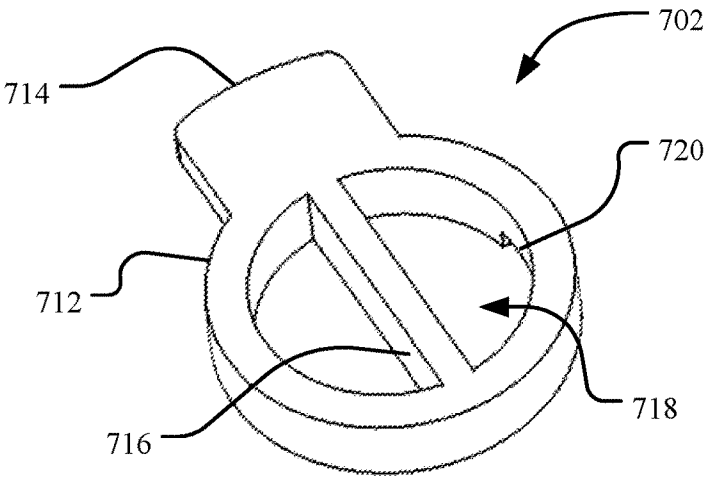
FIGS. 23A and 23B show a male connector and a female connector, respectively.
Figure 23C:
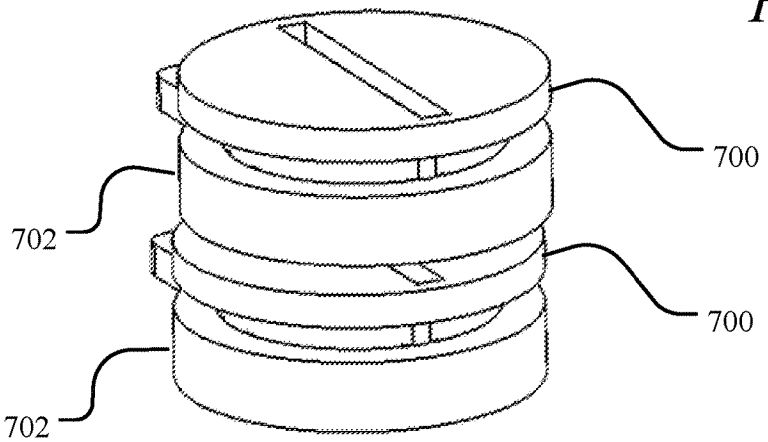
FIG. 23C illustrates a series of engaged male and female connectors.
Figure 23A:
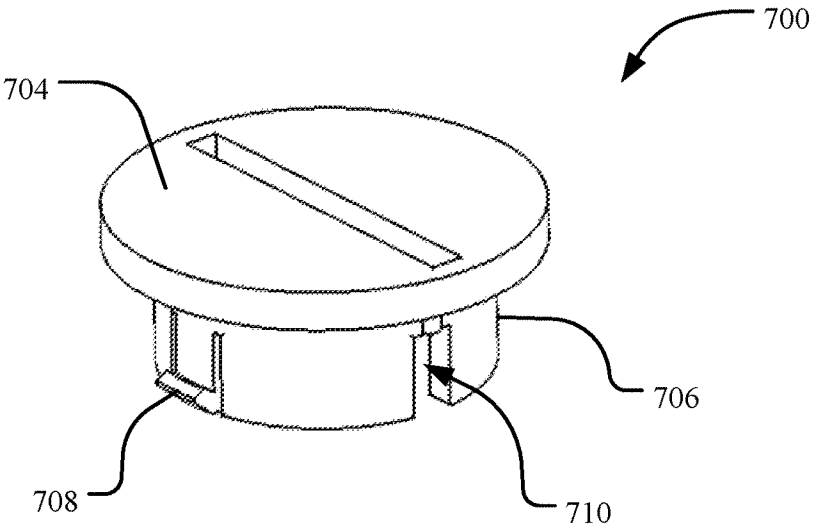

With respect to FIGS. 23A-23C, in one implementation, each of the connectors 130 is a male connector 700 or a female connector 702. The male connector 700 includes a male connector surface 704 from which a projection 706 extends. One or more slits 710 and/or tabs 708 are defined in or otherwise disposed on the projection 706 for engaging corresponding features on the female connector 702. In one implementation, the female connector 702 includes having a grip 714 extending from a body 712. An opening 718 of the body 712 is adapted to receive the projection 706 with a separator 716 received in the slit 710. The tab(s) 708 releasably engage corresponding grooves 720. As shown in FIG. 23C, the male and female connectors 700 and 702 may engage in a stacking arrangement with a low profile.

Figure 24:
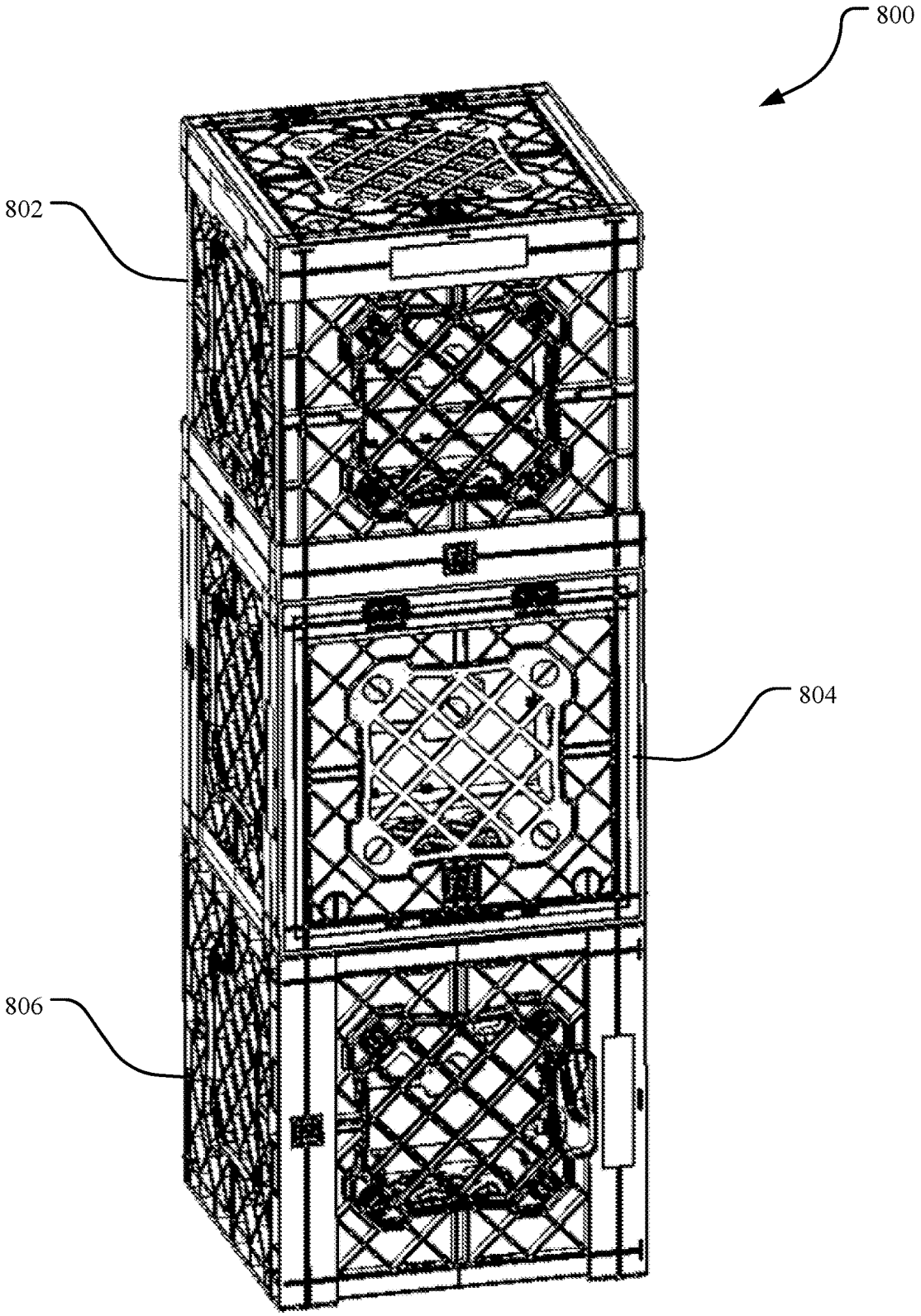
FIGS. 24-26 show a plurality of crates stacked in a various customized stacking configurations.
Figure 25:
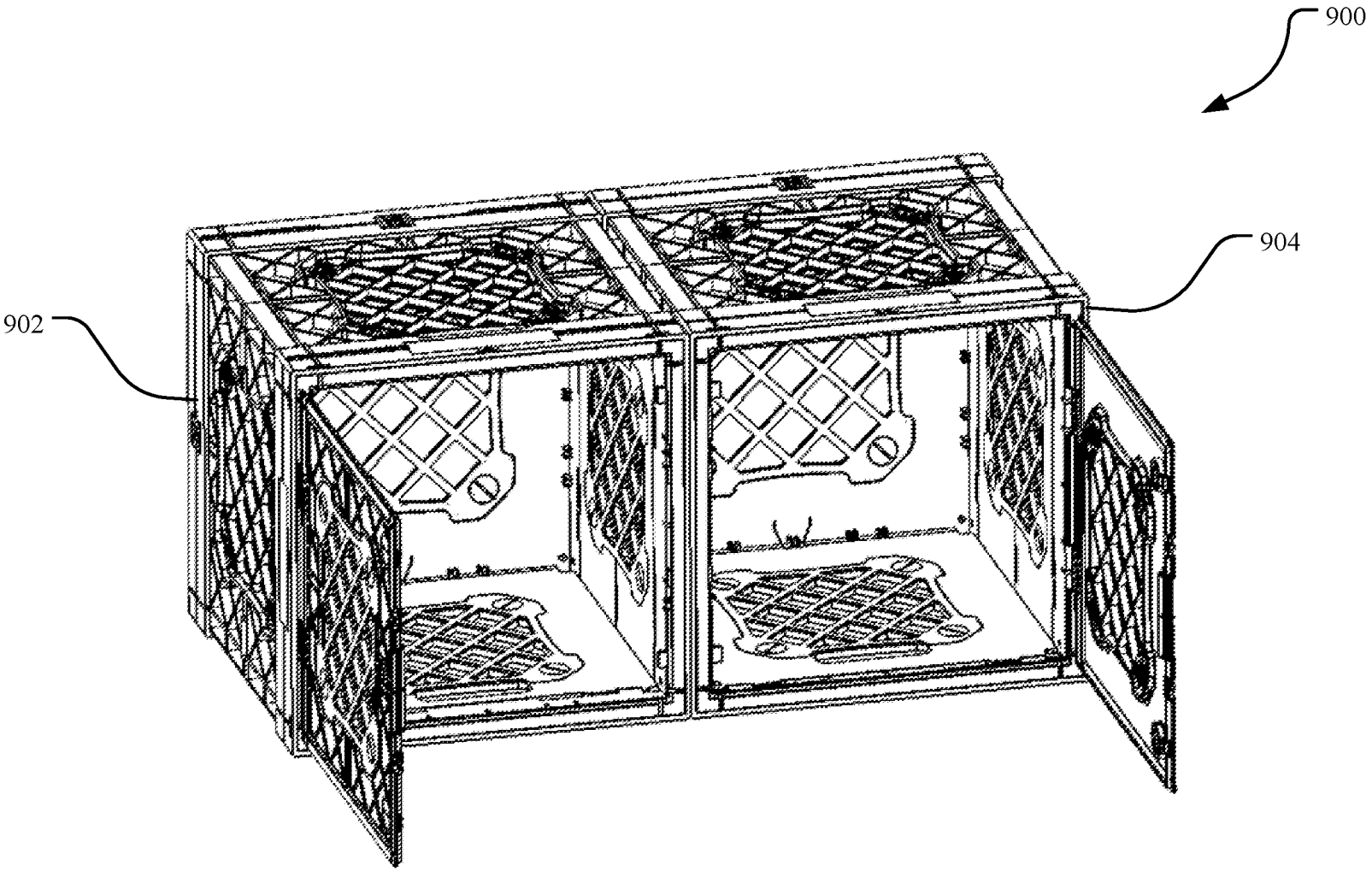
Figure 26:
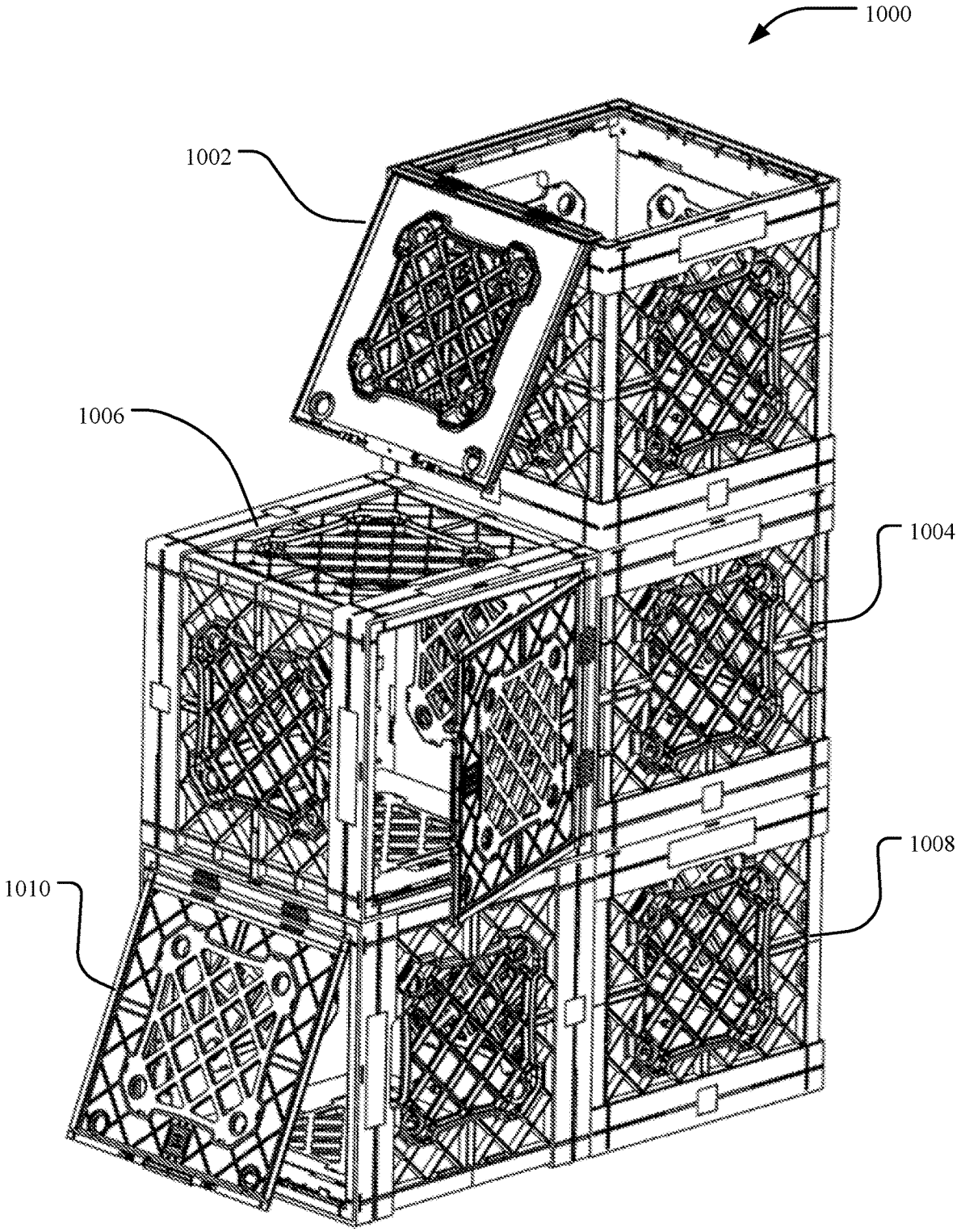

Turning to FIGS. 24-26, example stacking configurations are illustrated. As described herein, the crate 100 may be stacked in a plurality of customized orientations of the crate 100 and forming part of various customized stacking configurations. The crate 100 may be releasably secured to an adjacent crate along a side selected from the first frame end 102, the second frame end 104, the first swinging side 106, the second swinging side 108, the first folding side 110, and/or the second folding side 112. Stated differently, the crate 100 may be secured in a customized orientation in a plurality of planar directions. Further, the crate 100 may be positioned in a crate system with adjacent crates in a customizable stacking configuration, including a horizontal direction, vertical direction, and/or the like, and/or with the lid 120 and therefore the interior storage space remaining accessible.

FIG. 24 shows one example customized stacking configuration 800, including a first crate 802, a second crate 804, and a third crate 806 in a vertical stacking configuration. Each of the crates 802-806 is in a customized crate orientation to form the vertical stacking configuration, while ensuring the interiors remain accessible. More particularly, the lid of the first crate 802 is facing upwardly, the lid of the second crate 804 is facing in a first horizontal direction, and the lid of the third crate 806 is facing in a second horizontal direction. The ability to have the lid facing different directions permits the user to customize the stacking configuration according to the storage space and needs, including avoiding other obstacles within the storage space that would prevent the lids from being opened at various levels.

Referring to FIG. 25, another example customized stacking configuration 900, including a first crate 902 and a second crate 904 in a horizontal stacking configuration. The crates 902-904 each have the lid facing in the same horizontal direction and are secured to each other with a side-to-side horizontal connection. In this configuration, the crates 902-904 may be mounted to a wall or positioned on a rail or shelf in a row. The lids may further be removed, as desired, to create an open cubby configuration.

FIG. 26 shows another example customized stacking configuration 1000, including a first crate 1002, a second crate 1004, a third crate 1006, a fourth crate 1008, and a fifth crate 1010 in a horizontal and vertical stacking configuration. Again, the crates 1002-1010 may each be oriented in a customized crate orientation for releasably connecting to an adjacent crate and/or to ensure the interior remains accessible, as needed. For example, the interiors of the crates 1004 and 1008 may not need to be accessible, so they are stacked in the vertical orientation under the crate 1002, such that the lids cannot open. However, the user may desire to access the interior of the remaining crates 1002, 1006, and 1010, and orient them such that they are secured to adjacent crates within the configuration 1000 and the lids are free to open.

Figure 30:
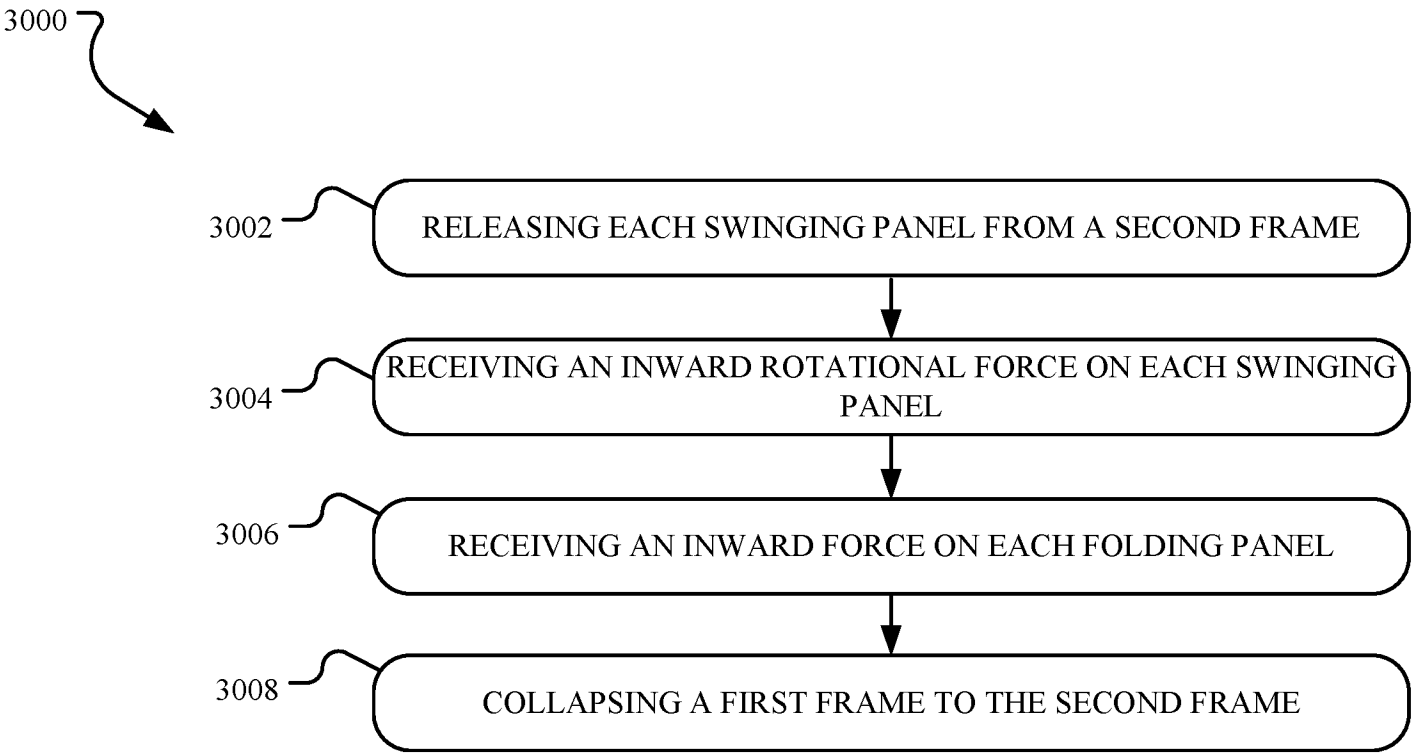
FIG. 30 illustrates example operations for moving the crate from a storage position to a collapsed position.

FIG. 30 illustrates example operations 3000 for moving the crate from a storage position to a collapsed position. An operation 3002 releases each swinging panel from a second frame. An operation 3004 receives an inward rotational force on each swinging panel to rotate each swinging panel into an internal space of a first frame. An operation 3006 receives an inward force on each folding panel to pivot each folding panel inwardly. An operation 3008 collapses the first frame to the second frame, thereby resulting in the crate being in the collapsed position.

Figure 31:
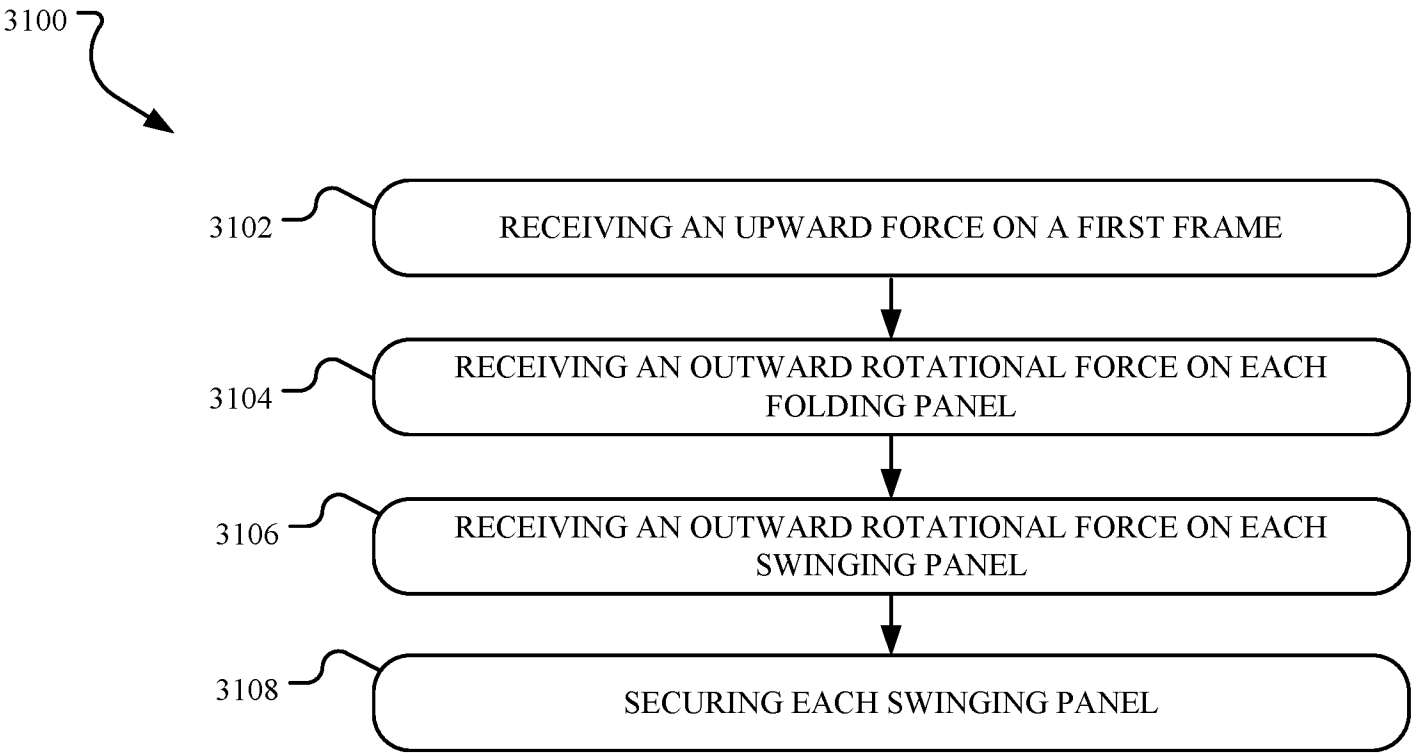
FIG. 31 illustrates example operations for moving the crate from a collapsed position to a storage position.

FIG. 31 illustrates example operations 3100 for moving the crate from a collapsed position to a storage position. An operation 3102 receives an upward force on a first frame to move the first frame from a second frame. An operation 3104 receives an outward rotational force on each folding panel to pivot each folding panel outwardly. An operation 3106 receives an outward rotational force on each swinging panel to rotate each swinging panel from an internal space of the first frame. An operation 3108 secures each swinging panel to the second frame.

Figure 27:
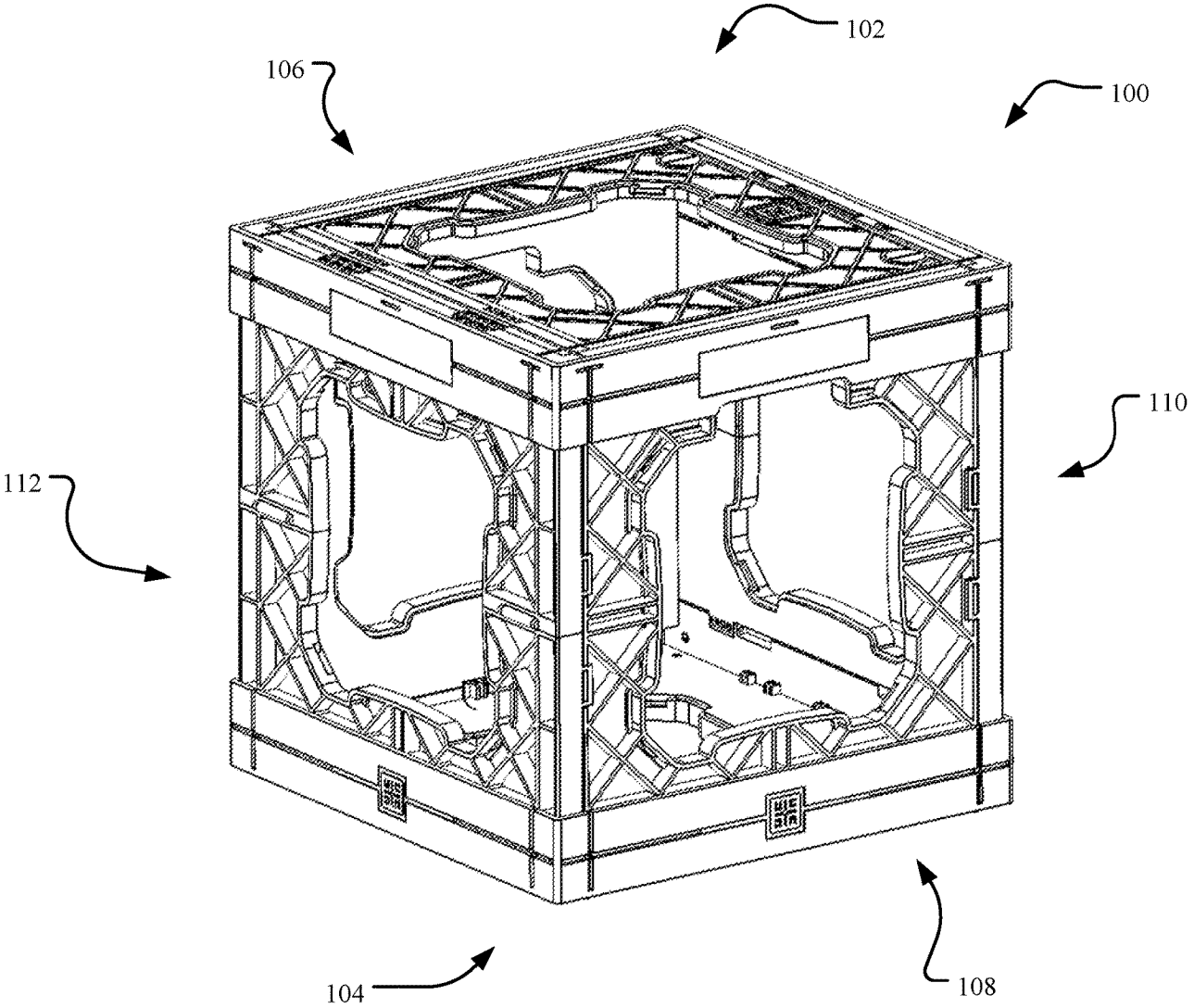
FIG. 27 depicts the crate with inner panels removed.
Figure 28:
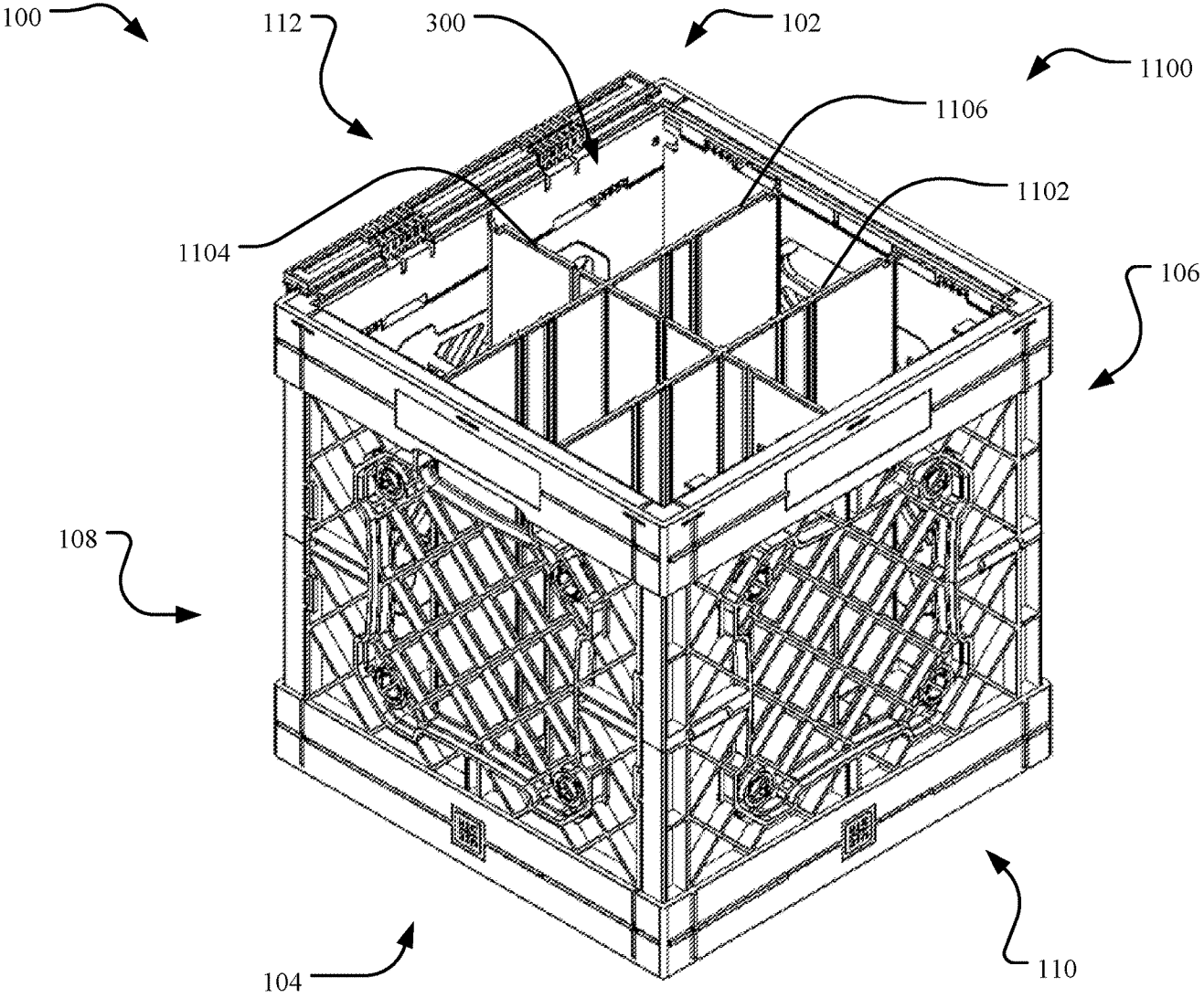
FIGS. 28 and 29 show a perspective view and a top view, respectively, of the crate with example interior dividers.
Figure 29:
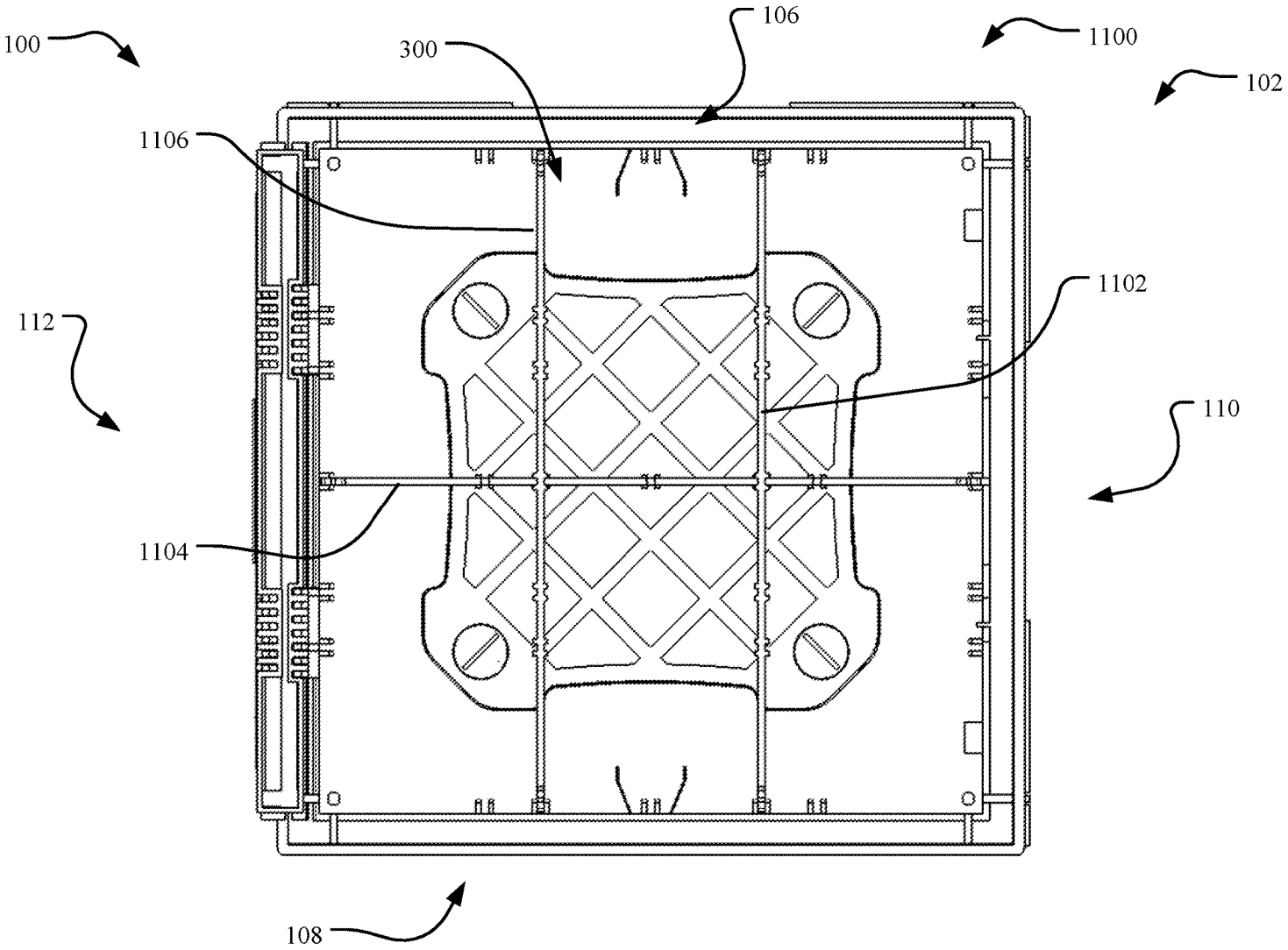

As described herein, the crate 100 may be customizable in a variety of other manners. For example, as shown in FIG. 27, the inner panels 128 may be removed from one or more of the first frame end 102, the second frame end 104, and/or any of the sides 106-112 to form ports opening into the interior of the crate 100. Further, various internal modular components may be customizable. For example, as shown in FIGS. 28-29, a subdivided storage space 1100 of the interior of the crate 100 may be formed using one or more divider panels (e.g., 1102-1106). The guides 244 may be used to align and support each of the divider panels 1102-1106.

As can be understood from the present disclosure, the crate 100 is generally a customizable modular storage device adapted to house and support various heavy items in a storage position, collapse into a collapsed position for shipping and storage, stack with one or more other crates or alone in customized crate orientations and/or stacking configurations, and form a customized interior, for example, through the use of one or more internal modular components. With the crate being collapsible from the sides with hinges disposed at the edges, modular side walls may be used. The sides may include hinges halves or be molded as a single unit and snapped in after the crate is erected, providing additional load strength and design options. The crate orientation may be along a plane direction selected from a plurality of plane directions, and the crate may be symmetrically stackable in a vertical and/or horizontal stacking configuration. The crates may be releasably connected to each other using various fasteners and/or connectors, keeping the crates aligned and secured. The crate may include grooves and spacing to receive accessories, such as smaller inner boxes. The units may snap onto or otherwise affix to a cart.

The crate may be used in variety of contexts and environments and customized according to a selected storage configuration. Examples of the various contexts and environments, include but are not limited to, trunk, truck, shelves, drawers, vehicle, garage, pantry, bedroom, closet, crawlspace, storage unit, lock box, and/or the like. Similarly, the crate may be used alone or in a customized system to store various items, including, without limitation, wine, shows, purses, food, bottles, containers, tools, and/or the like. In some cases, the crate may be used in the context of a water purifier or cooler exoskeleton. In other cases, the crate may include or be used with a digital or mechanical lock. The digital lock may be used with an application, for example, on a user's cellular phone, computer, or other connected device. In some aspects, the crate may be wall mounted. The crate may also be used as a modular building block for a variety of other structures.

The lid, the first frame end, the sides, and/or the second frame end may be modular, such that the component is replaceable with other versions, including without limitation, seats, windows, different styles, different aesthetic or ornamental features, and/or the like. The crate, for example, may be constructed of plastic, metal, ceramic, etc. with large grate sides that are monolithic, stamped, slotted, and/or the like.

Aspects of the present disclosure also include customizable and modular attachments to the storage crates. In one instance, the modular attachments may lock within an opening on any side of the crate, such as a diamond-shaped opening of the crate sides. The modular attachments may include, among other aspects, a universal connector portion that connects within the opening in the crate and/or an accessories portion configured to mate with the universal connector, with each of the accessories having a specific use or utility.

Figure 32A:
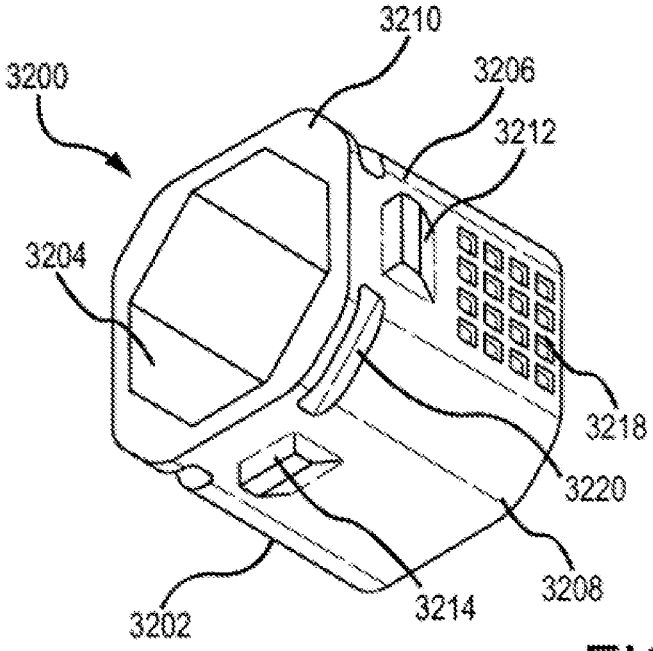
FIG. 32A shows an isometric view of a connector for attaching one or more modular attachments to the crate.
Figure 32B:
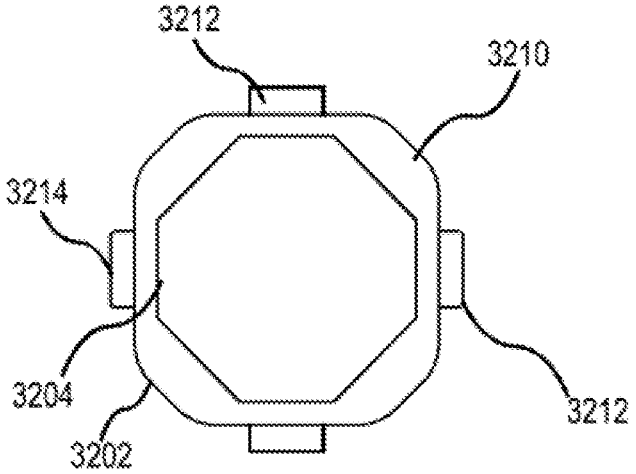
FIG. 32B shows a front view of the connector for attaching one or more modular attachments to the crate.
Figure 32C:
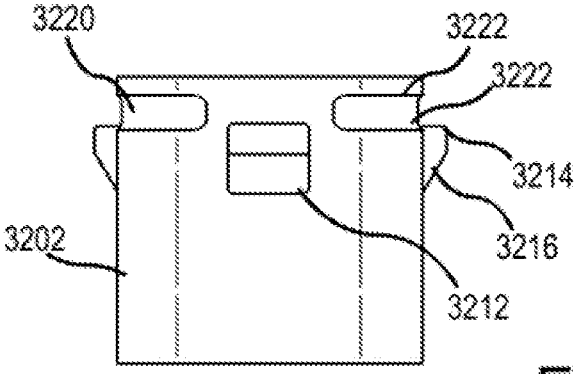
FIG. 32C shows a top view of a connector for attaching one or more modular attachments to the crate.

FIGS. 32A-32C illustrate a universal connector 3200 for attaching one or more modular attachments to a crate. As noted above and explained in more detail below, the universal connector 3200 may be a portion of a modular attachment system or may be a separate connector device. In the example illustrated in FIGS. 32A-32C, the connector 3200 is tubular in shape with a rearward portion 3206 and a forward portion 3208. In some instances, the connector 3200 may have an octagonal cross-section shape defining eight corners around the perimeter of the connector. However, the connector 3200 may have other shapes, including circular, pentagonal, hexagonal, etc. with or without a corresponding number of corners. The connector 3200 includes an outer surface 3202 and an inner bore hole 3204 extending partially or entirely along the length of the connector. The bore hole 3204 may or may not have a similar cross-section as the outer surface 3202. For example, the bore hole 3204 may be an octagonal cross-section shape similar to the outer surface 3202, as illustrated in FIGS. 32A-32C, and having eight inner surfaces. Other instances of the connector 3200 may have more or fewer inner surface sides. In still other instances, the bore hole 3204 may not be present through the connector 3200. The bore hole 3204 may extend through the connector 3200 from a rear surface 3210, or rear face, to a front surface or front face.

The outer surface 3202 of the connector 3200 may include one or more offsetting tabs 3212 or stops that extend from the outer surface. In one instance, the tabs 3212 may include a rearward-facing surface 3214 that extends vertically or substantially vertically from the outer surface 3202. Each tab 3212 may also include a forward-facing surface 3216 extending from the outer surface 3202 of the connector 3200 at an angle. A top end of the forward-facing surface 3216 of the tab 3212 located away from the outer surface 3202 may connect to a top end of the rearward-facing locking surface 3214. In some instances, a substantially horizontal bridging surface may span a distance between the top end of the forward-facing surface 3216 and the top end of the rearward-facing locking surface 3214. As described in more detail below, the tabs 3212 may engage an inner surface portion of the side of a crate during insertion and locking of the connector 3200 within an opening of the crate side.

In general, the tabs 3212 may be located equidistant around the outer surface 3202 of the connector 3200. For example, the connector 3200 may include four tabs 3212, each extending from a flat portion or substantially flat portion of the outer surface 3202 and spaced equidistant around the connector. Forward of one or more of the tabs 3212, one or more gripping features 3218 may be included on the outer surface 3202 of the connector 3200. The gripping feature 3218 may take many forms configured to provide a high-friction surface for manipulation of the connector 3200, such as when locking the connector into the opening of the side of the crate. In the example shown, a plurality of dimples may be located within the outer surface 3202. In another example not shown, one or more ridges may extend from the outer surface 3202. In still another example, a plurality of raised surfaces may extend from the outer surface. Further, although illustrated as being located forward of one or more tabs 3212, it should be appreciated that the gripping feature may be located anywhere on the connector 3200 to provide a mechanism for gripping the connector to locate and secure the connector in place within the opening of the crate side.

One or more locking grooves 3220 may also be located at equidistant or non-equidistant intervals around the outer surface 3202 of the connector 3200. In one particular implementation, the locking grooves 3220 may be located between two tabs 3212 such that the grooves and tabs alternate around the circumference of the outer surface 3202 of the connector 3200. For example, in an octagonally-shaped connector 3200, the tabs 3212 may be located on four sides of the octagon, with each of the tabs located on a side directly opposite another tab. The sides of the octagon shape between the tabs may each include a locking groove 3220. For other connectors 3200, the locking grooves may be located at other locations around the outer surface 3202 of the connector. In general, the locking grooves comprise a groove or furrow cut into the outer surface 3202 transverse to the length of the connector 3200. The locking groove 3220 may include a forward edge 3222 and a rearward edge 3224. Each of the forward edge 3222 and the rearward edge 3224 of the grooves 3220 may be vertical or substantially vertical, extending into the outer surface 3202 of the connector 3200 and defining a depth of the groove. Similarly, the space between the forward edge 3222 and the reardward edge 3224 of the grooves 3220 may define a width of the locking grooves. Each locking groove 3220 may be rearward of the tabs 3212 on the outer surface 3202. For example, the tabs 3212 may be located a first distance from the rear face 3210 of the connector 3200. The locking grooves 3220 may be located a second distance from the rear face that is less than the first distance such that the locking grooves are closer to the rearward end 3210 of the connector 3200. The forward edge 3222 of the locking grooves 3220 may align with the rearward surface 3214 of the tabs 3212. In other words, the forward edge 3222 of the locking grooves 3220 and the rearward surface 3214 of the tabs 3212 may be the same or similar distance from the rear face 3210 of the connector 3200.

Figure 33:
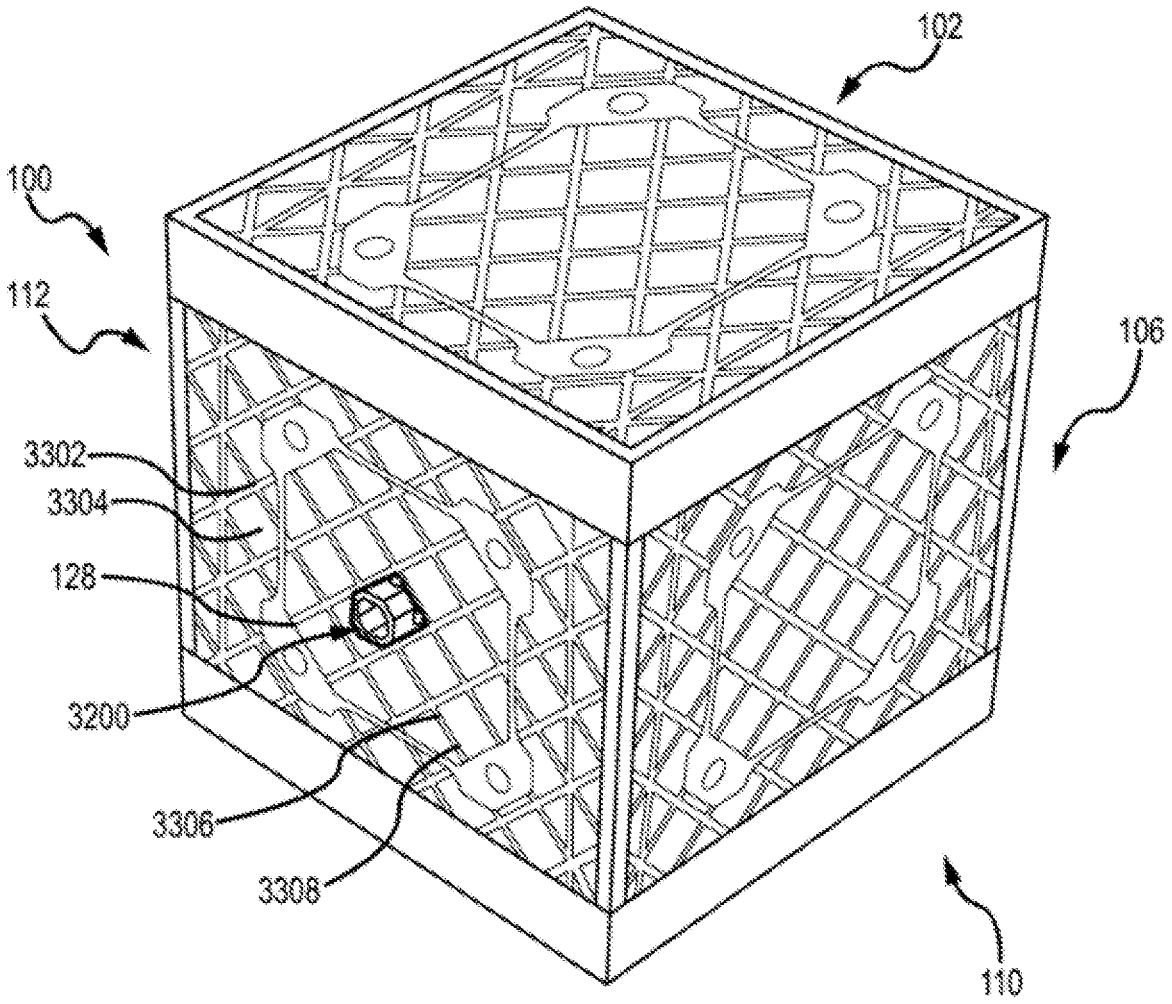
FIG. 33 shows an isometric top view of a crate with a connector attached to a side of the crate for receiving one or more modular attachments.
Figure 34:
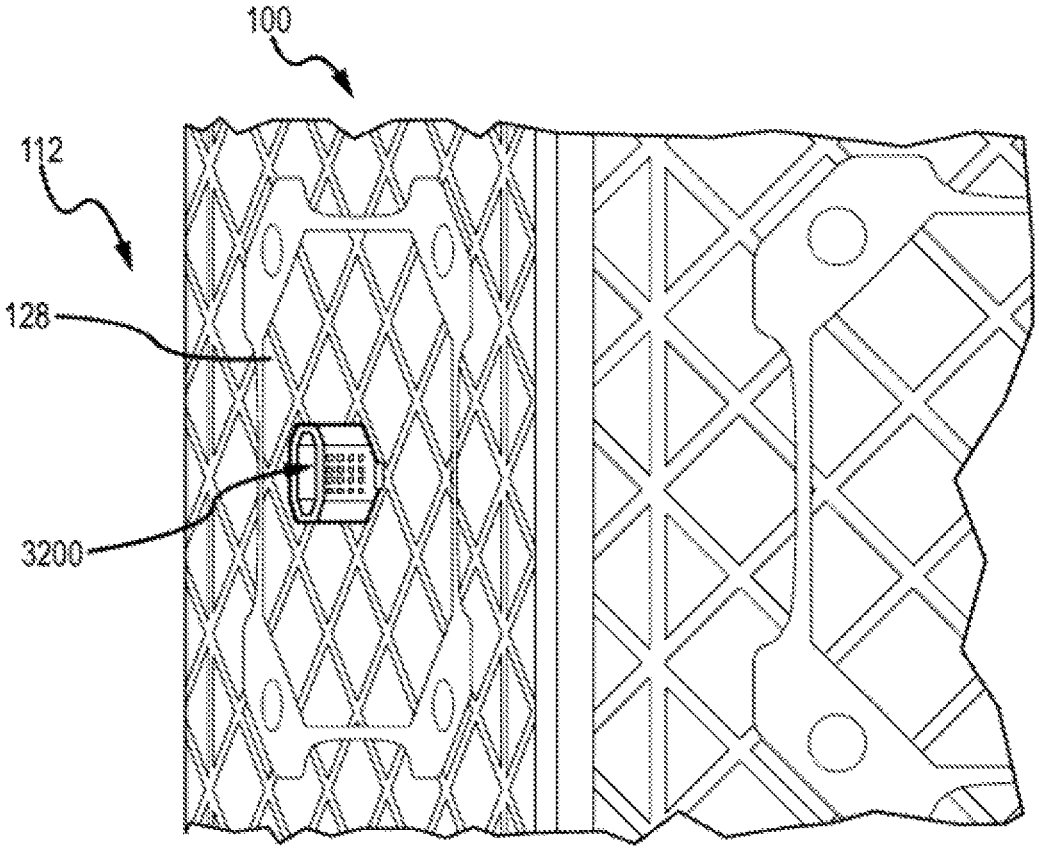
FIG. 34 shows an isometric side view of a crate with a connector attached to a side of the crate for receiving one or more modular attachments.

Turning now to FIG. 33, an isometric top view of a crate 100 as discussed above is shown. In particular, the crate 100 includes sides 106-112, with some sides including inner panels, such as inner panel 128 of side 112. One or more of the sides 106-112 of the crate 100 may include spines 3302 that extending from an edge of the side to another in a crosshatched pattern. The spines 3302 therefore form several diamond-shaped openings 3304 or holes within the sides panel 112. The inner panel 128 may include the same pattern and may or may not continue the pattern established on the crate side 112 outside of the inner panel 128. Regardless, portions of the side panel 112 may include one or more openings 3304 or holes through which the connector 3200 may be inserted and locked. In other instances, the side panel openings 3304 may be circular, square, pentagonal, or any other shape.

Each spine 3302 of the inner panel 128 of the crate 100 may comprise a flat surface 3306 extending along a length from an outer edge of the side to an inner edge of the inner panel. At some location along the length of the flat surface 3306 of the spine 3302, a ridge 3308 perpendicular to the flat surface extends into a corresponding opening 3304. The ridge 3308 may be located at any position along the length of the flat surface 3306. In one particular instance, the ridge 3308 may extend from the flat surface 3306 of the spine 3302 at the inner edge of the inner panel 128. One or more of the openings 3304 may therefore have a first circumference defined by the flat surfaces 3306 of the corresponding spines 3302 surrounding the respective opening and a second circumference, less than the first circumference, defined by the ridges 3308 of the corresponding spines 3302 surrounding the respective opening. As described in more detail below, the ridges 3308 extending into the opening 3304 may be inserted into the locking grooves 3220 of the connector 3200 to lock the connector into place within the corresponding opening 3304.

As illustrated on FIGS. 33-36, the connector 3200 may be placed into one of the openings 3304 of the inner panel 128 or side panel 112. Although illustrated as located within an opening 3304 of the inner panel 128 of side panel 112, it should be appreciated that the connector 3200 may be located in any opening on any portion of the crate 100. To lock the connector 3200 in the opening 3304, the connector may be placed within the opening oriented such that the rearward surfaces 3214 of the tabs 3212 of the connector contact the ridges 3308 extending into the opening from the crate spines 3302. The tabs 3212 provide a stopping mechanism for the insertion of the connector 3200 into the opening as the rearward surfaces 3214 engage the spine ridges 3308 of the opening 3304. Once located in this position, the connector 3200 may be rotated in a clockwise or counter-clockwise rotation. As the connector 3200 is rotated, the outer surface 3202 of the connector 3200 may cause an outward force on the spines 3302 defining the opening 3304. More particularly, the ridges 3308 of the spines 3302 may engage the outer surface 3202 in several locations around the connector 3200 and may deflect or bend slightly in response to the force applied to the ridges. Rotation of the connector 3200 may be aided by the gripping feature 3218. For example, a user may grasp the connector 3200 by the gripping feature to rotate the connector 3200. Due to the outward force applied to the spines 3302 through the rotation, a slight resistance to the rotation may be present. Continued rotation of the connector 3200 locates the ridges 3308 of the spines 3302 within the locking grooves 3220. Rotation of the connector 3200 of about ¼ of the circumference of the connector may lock the connector into the opening, for connectors that have four locking grooves 3220. Fewer grooves may require more of a rotation and more grooves may require less of a rotation. The grooves 3220 allow the spines 3302 to return to the pre-deformed shape as the resistance to the rotation diminishes. Through the resistance to the rotation prior to the ridges 3308 being located within the grooves 3220 and the release of the resistance once located within the grooves, a tactile sensation of the connector 3200 locking into place within the opening 3304 may be felt by the user. A similar rotation of the connector 3200 in a clockwise or counter-clockwise direction may unlock the connector for removal from the opening 3304.

Figure 35:
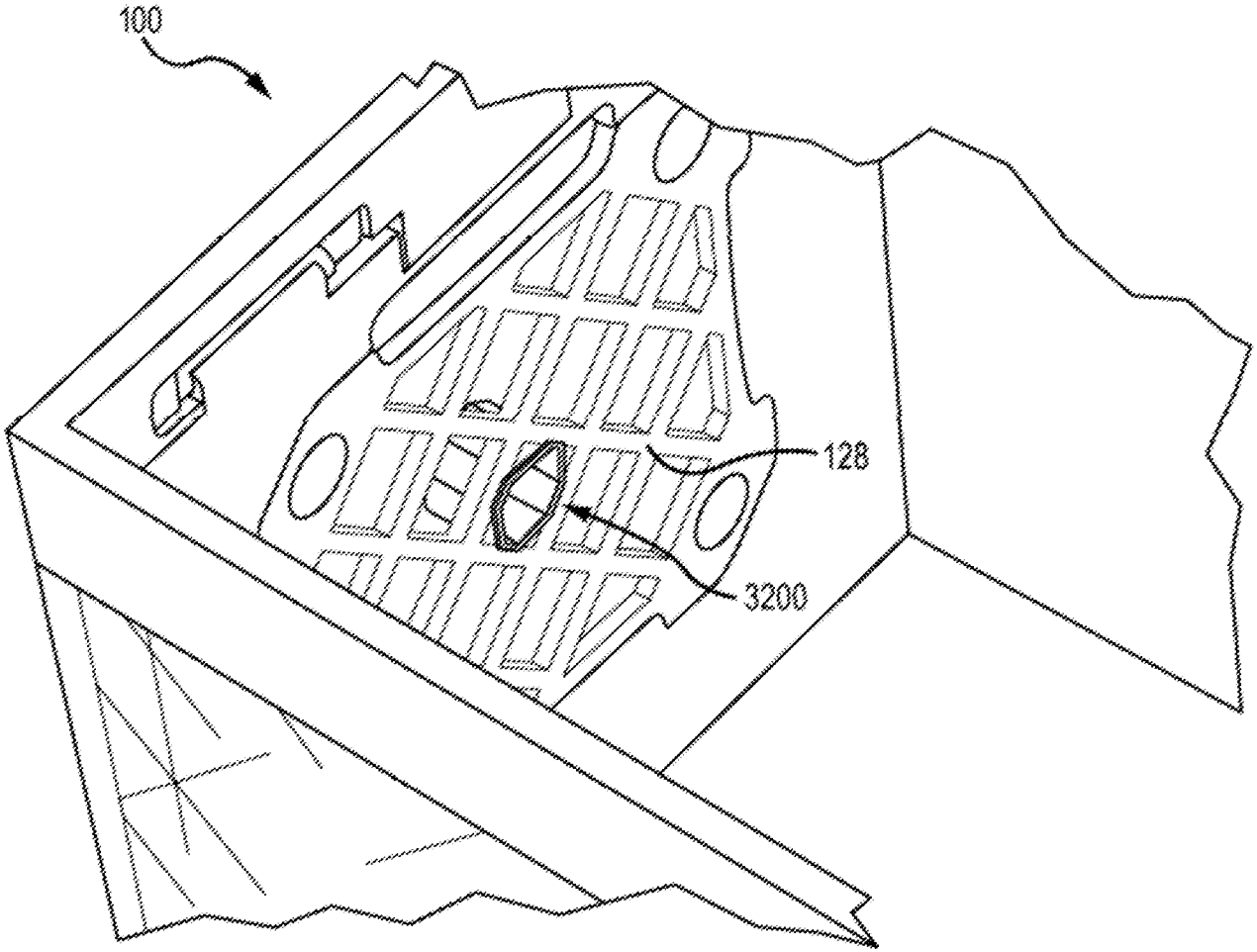
FIG. 35 shows an isometric side view of an interior of a crate with a connector attached to a side of the crate for receiving one or more modular attachments.
Figure 36:
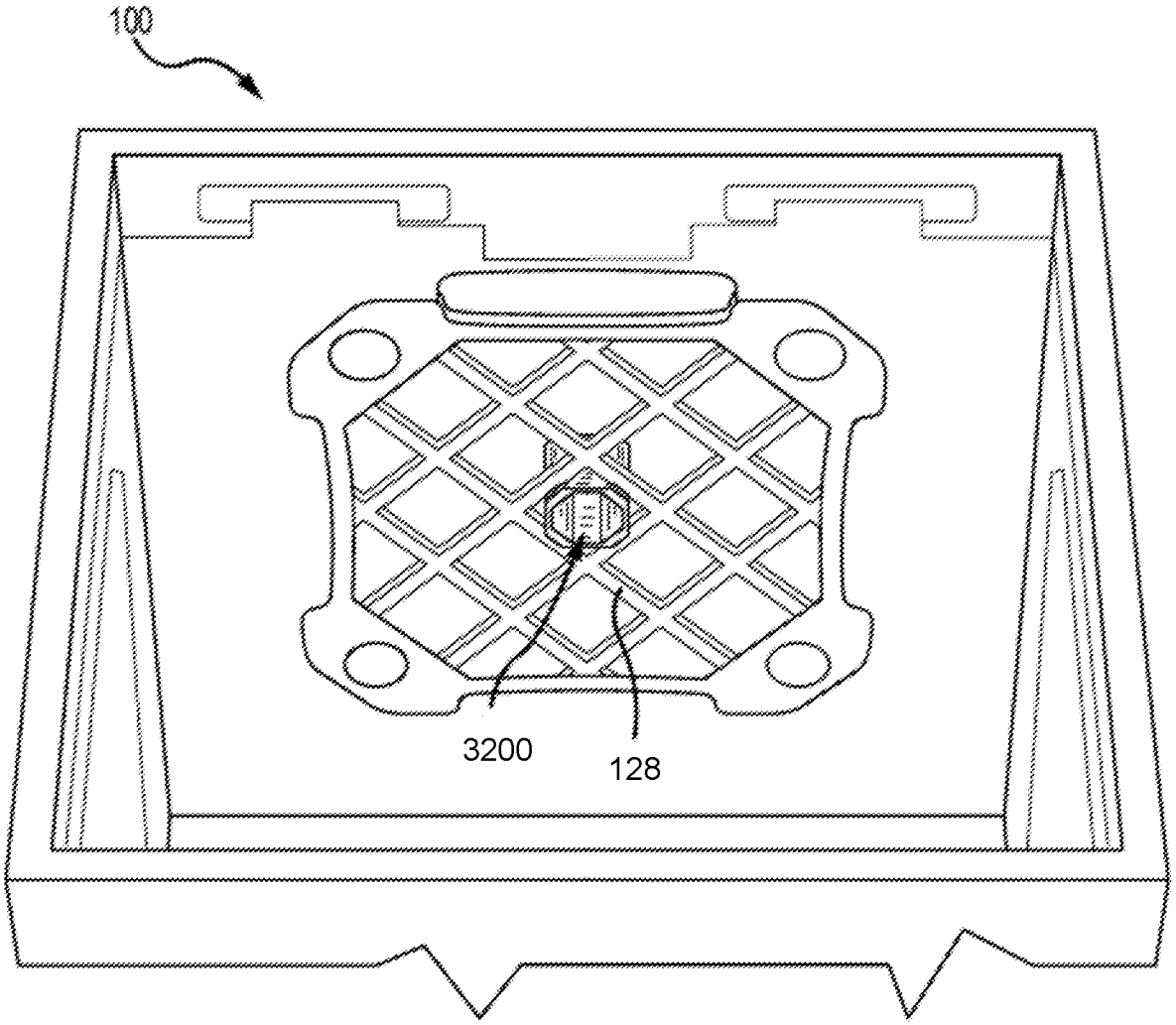
FIG. 36 shows an isometric back view of an interior of a crate with a connector attached to a side of the crate for receiving one or more modular attachments.

As best shown in FIG. 35, the connector 3200 may partially extend into the interior of the crate 100 when in the locked position. The ridges 3308 along the inner edge of the spines 3302 are located within the locking grooves 3220 around the outer surface 3202 of the connector 3200. The rearward edge 3224 of the grooves 3220 engage an inner surface of the ridges 3308 to prevent the connector 3200 to extend further into the interior of the crate 100 through the opening. Similarly, the forward edge 3222 of the grooves 3220 engage an outer surface of the ridges 3308 to prevent the connector 3200 from being removed from the opening 3304 when in the locked position. The ridges 3308, when located within the locking grooves 3220, thus retain the connector 3200 within the opening 3304 such that the connector cannot be removed from the opening unless rotated.

As noted above, the connector 3200 may form a part of a modular attachment for a crate system, such as that described herein. Several types of modular attachments are described herein for use with the connector 3200 described above. In some instances, the attachments may be integrated with the connector as a single manufactured piece. In other instances, the attachments may connect to the connector 3200. For example, the attachment may include a mating arm insertable into the bore hole 3204 of the connector 3200. One or more securing mechanisms, such as a snap, a ridge and groove connection, or any other mechanism for retaining the mating arm in the bore hole 3204 may be utilized on the inner surface of the connector 3200. In another example, the attachments may connect to the tabs 3212 of the connector 3200. Regardless of the mechanism utilized, the attachment may connect to the locking connector 3200 in a secure manner. As many different types of attachments may be created, the attachments are modular in that attachments may be exchanged for other attachments with or without unlocking of the connector 3200 from the crate 100. For example, a drink holder attachment may be removed from the connector 3200 and a toolholder attachment may be secured to the connector without removing the connector from the opening 3304 in the side of the crate 100. Alternatively, each attachment may include a connector portion such that alternating between attachments may include rotating the connector portion of the attachment to unlock a first attachment and locking a connector portion of a second attachment to the opening 3304. In this manner, the universal connector 3200 described above provides for any number of attachments to be connected to the side of the crate 100 through the ¼ turn rotation of the connector to lock and/or unlock the attachment from the opening 3304.

Figure 37:
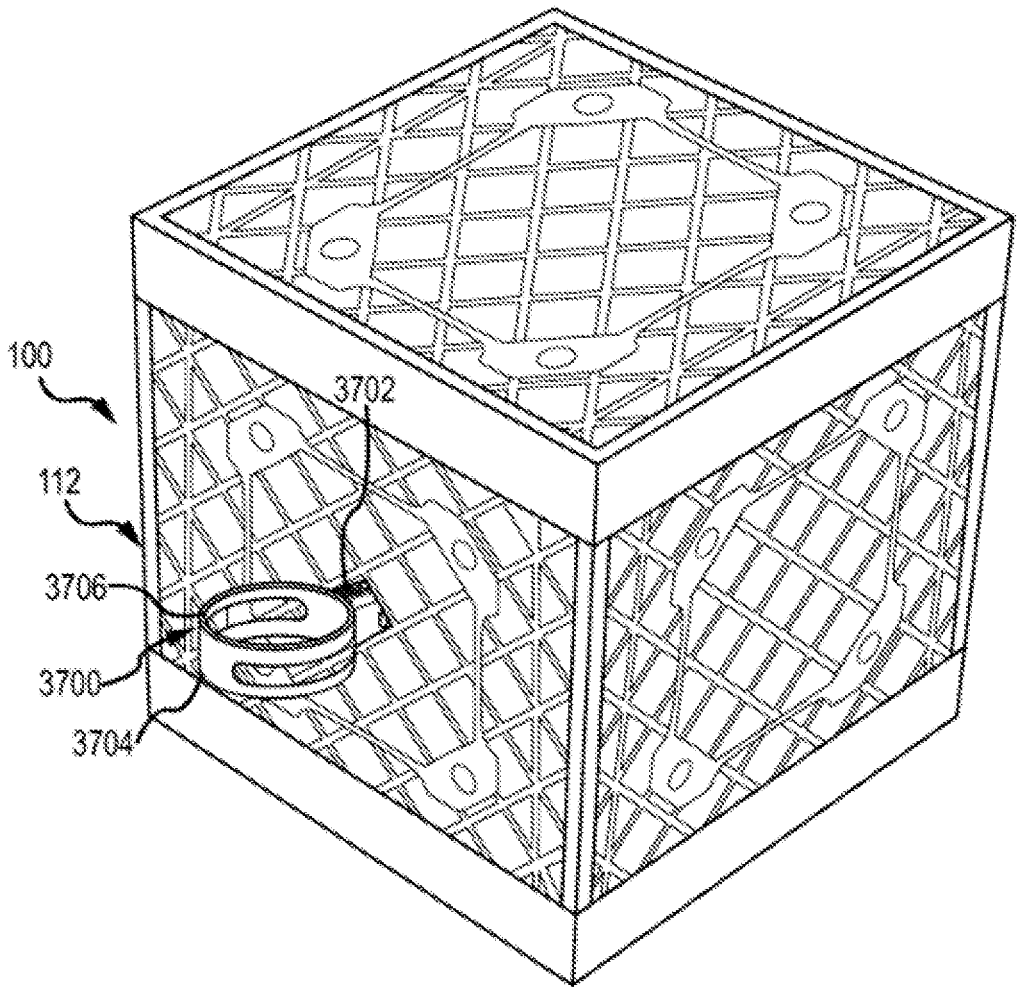
FIG. 37 shows an isometric side view of a crate with a cupholder attachment connected to a side of the crate.
Figure 38A:
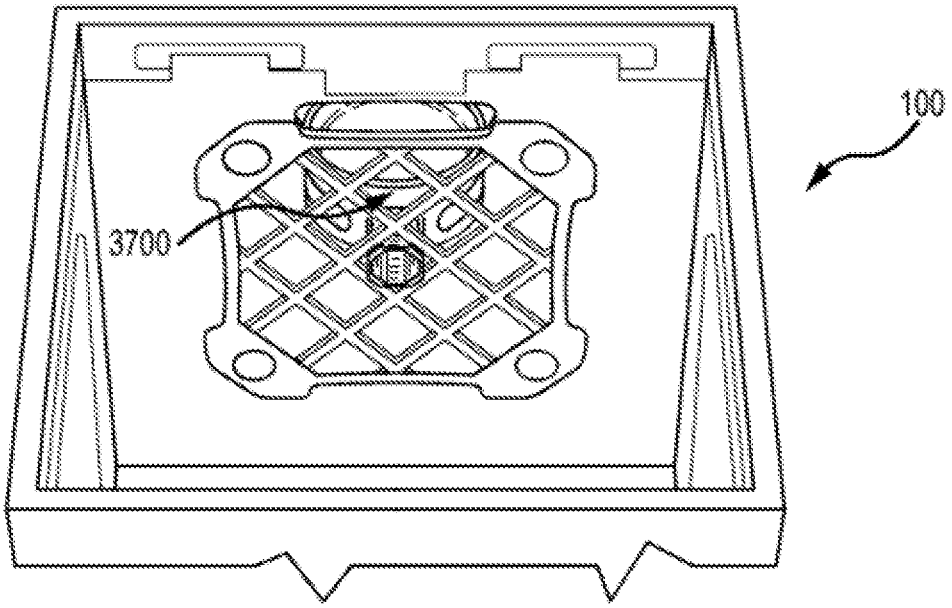
FIG. 38A shows an isometric back view of an interior of a crate with a cupholder attachment connected to a side of the crate.
Figure 38B:
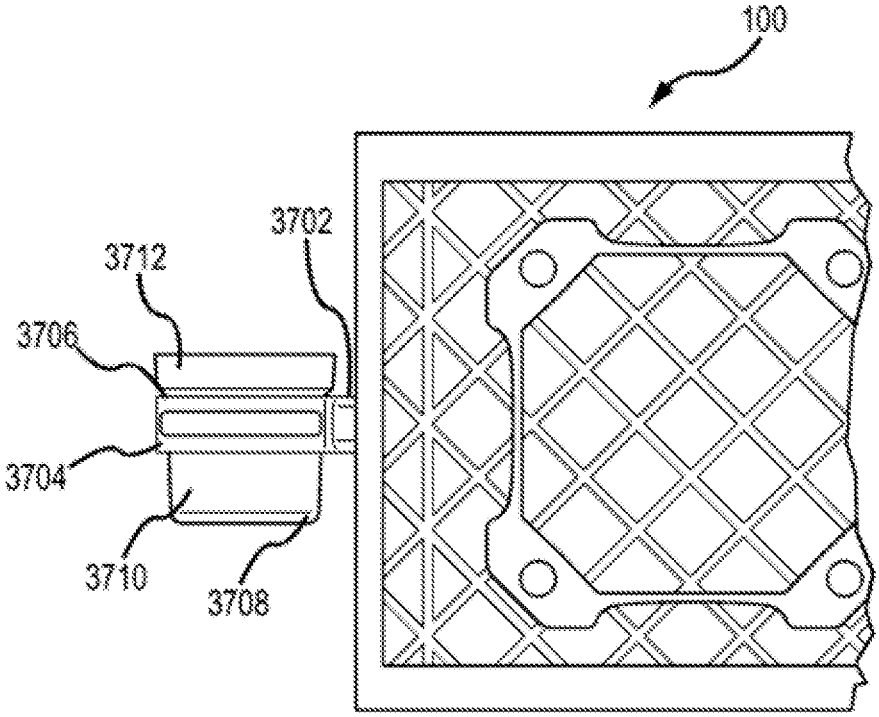
FIG. 38B shows a side view of a crate with a cupholder attachment connected to a side of the crate.

A first attachment example is illustrated in FIGS. 37-38B as a cupholder attachment. The cupholder attachment 3700 may comprise a connector portion 3702 which is similar to the connector 3200 described above. Thus, the connector portion 3702 may include a plurality of tabs 3212 and locking grooves 3220 for insertion of the attachment 3700 into an opening 3304 of the side 112 of the crate 100 and for securely locking into place within the opening. The different embodiments and/or instances of the connector 3200 described above may also be incorporated into the cupholder attachment 3700. A cupholder portion 3704 may extend from the connector portion 3702 away from the crate 100 and may comprise a hoop with a circumference and a width. The circumference of the cupholder portion 3704 may be configured such that the body 3710 of a cup 3708 or other beverage receptacle may pass through the middle of the hoop while a lip 3712 or top portion of the cup may engage an upper edge 3706 of the hoop. In this manner, the cup holder attachment 3700 may retain the cup 3708 upright within the cupholder portion 3704 when locked into the crate side opening. In some instances, the circumference of the cupholder portion 3706 may be adjustable to accommodate different sizes of cups or receptacles. Further, as mentioned above, the cupholder portion 3704 may be integral with the connector portion 3702 such that the attachment 3700 includes the connector and cupholder portion as a single manufactured piece. In other instances, the cupholder portion 3704 may be removable from the connector portion 3702.

Figure 39:
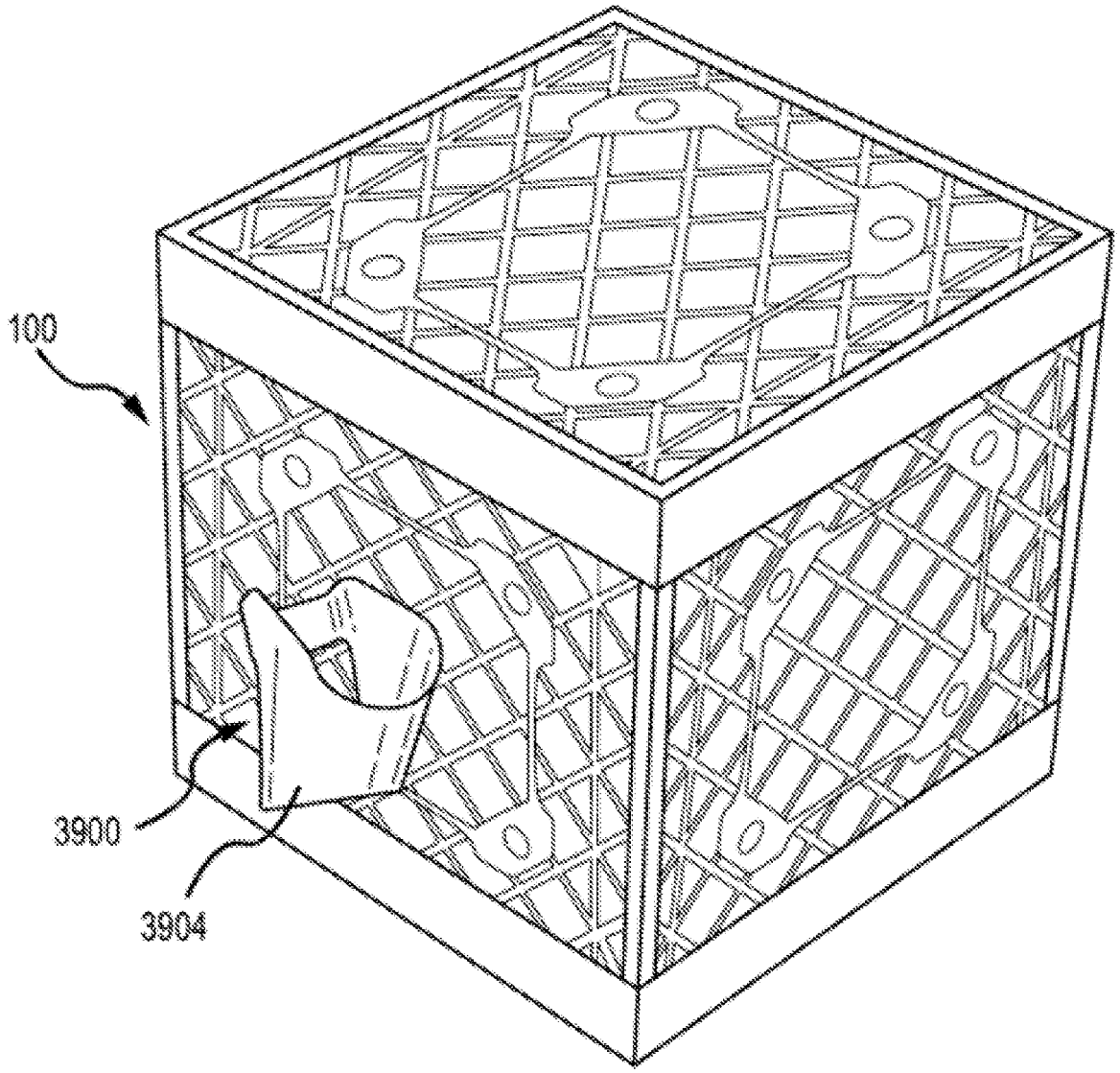
FIG. 39 shows an isometric side view of a crate with a toolholder attachment connected to a side of the crate.
Figure 40:
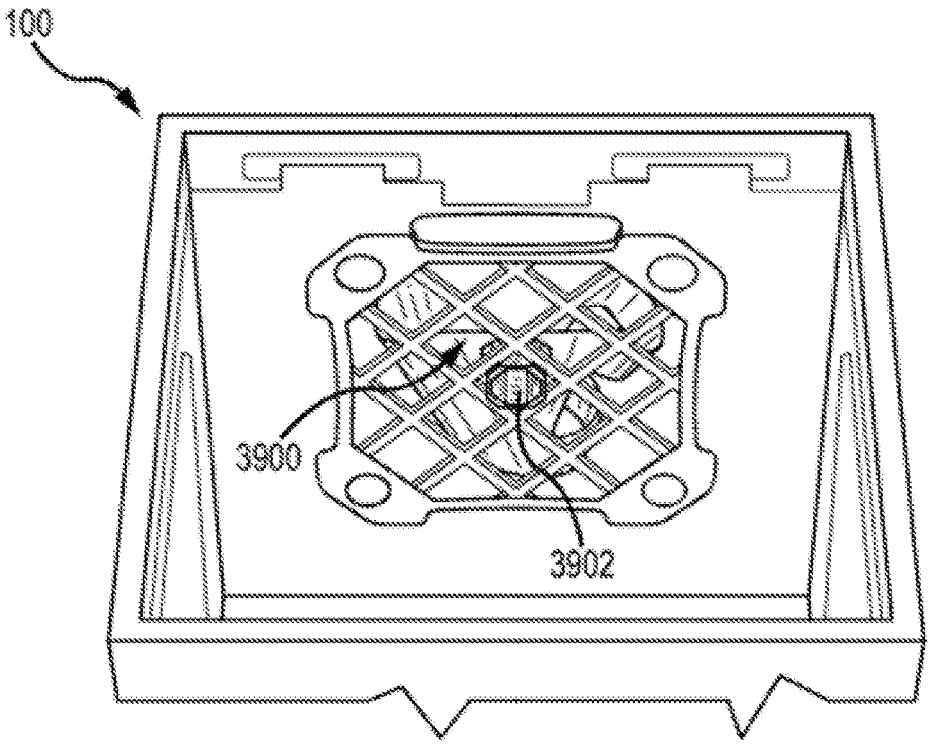
FIG. 40 shows an isometric back view of an interior of a crate with a toolholder attachment connected to a side of the crate.

FIGS. 39 and 40 illustrate another attachment example that may connect to the crate 100 through the connector 3200 assembly described above. In this example, a toolholder 3900 is shown. More particularly, a drill saddle 3900 is illustrated in in which a drill tool or other types of tools may be placed. The toolholder 3900 may include a connector portion 3902 (best seen in FIG. 40) and a toolholder portion 3904. As above, the connector portion 3902 may include a plurality of tabs 3212 and locking grooves 3220 for insertion of the attachment 3900 into an opening 3304 of the side 112 of the crate 100 and for securely locking into place within the opening. The toolholder portion 3904 may extend from the connector portion 3902 away from the crate 100 and may comprise a saddle, hook, or other mechanism configured to carry a tool when placed within the saddle or on the hook. In this manner, the cup holder attachment 3700 may retain the cup 3708 upright within the cupholder portion 3704 when locked into the crate side opening. The toolholder portion 3904 may, in some instances, be integral with the connector portion 3902 such that the attachment 3900 includes the connector and toolholder portions as a single manufactured piece. In other instances, the toolholder portion 3904 may be removable from the connector portion 3902.

Figure 41A:
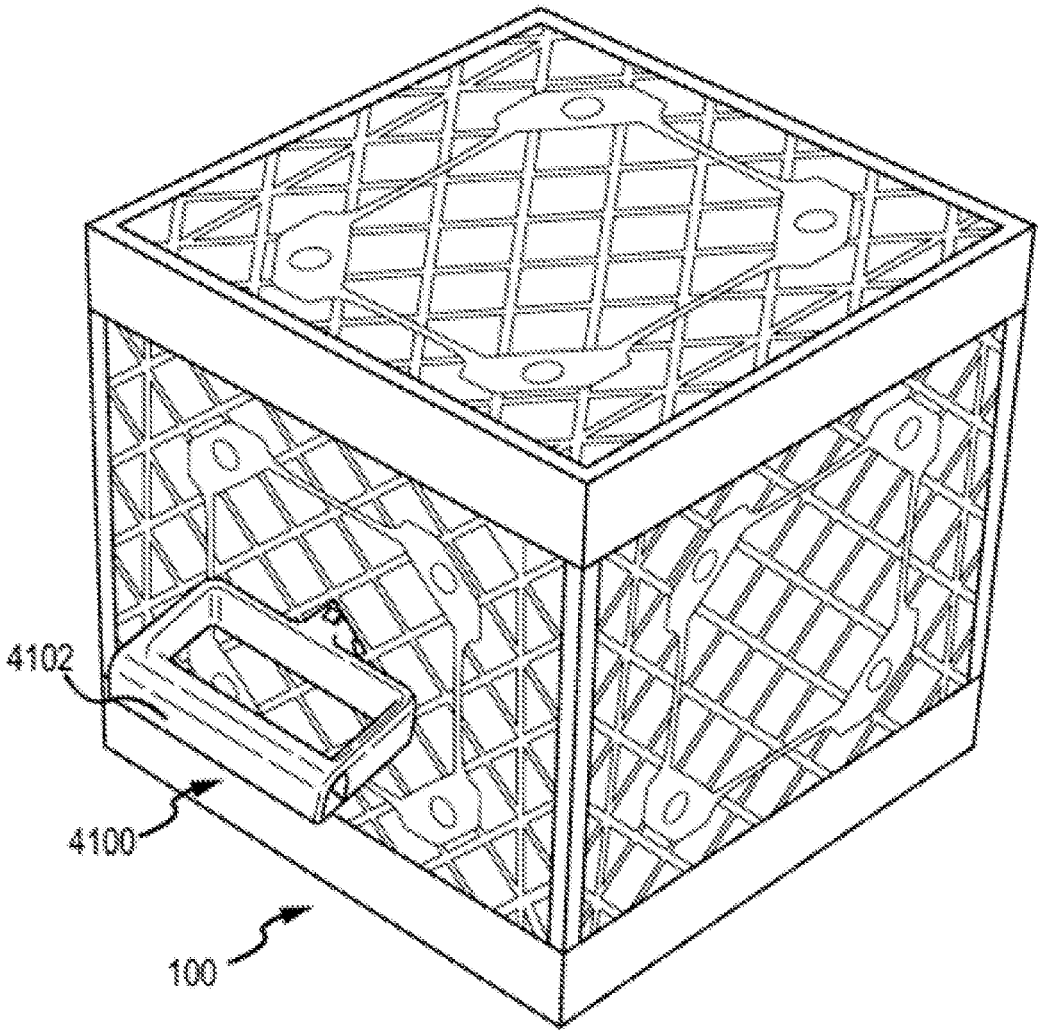
FIG. 41A shows an isometric top view of a crate with a handle attachment connected to a side of the crate.
Figure 41B:
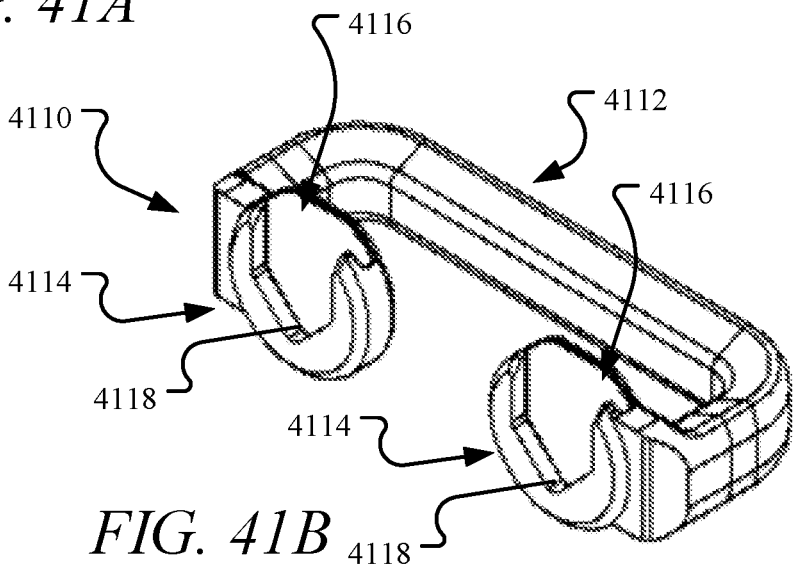
FIG. 41B shows an isometric view of a second handle attachment for connection to the crate.

Still another attachment example is illustrated in FIG. 41A. In this example, a handle attachment 4100 is illustrated for locking onto the crate 100 such that the crate may be carried using the handle attachment. Similar to the other modular attachments above, the handle attachment 4100 may include a connector portion and a handle portion 4102. The handle portion 4102 may extend from a connector portion away from the crate 100 and may comprise a handle for carrying the crate 100. The handle portion 4102 may form a single piece with the connector portion or may be removable from the connector portion. The handle attachment 4100 may attach and lock to the crate 100 through the connector as described above. FIG. 41B illustrates an alternate handle attachment 4110 for attaching onto the crate 100. The alternate handle attachment 4110 include a handle portion 4112 similar to above. However, in this implementation, the attachment may include two connector portions 4114 opposite the handle portion 4112 for attaching the handle to the side of the crate 100. In particular, the alternate handle attachment 4110 may include a pair of circular receptacles 4114, open to a rearward end of the attachment, for engaging with a locking connector 3200 locked onto the side of the crate 100. For this implementation, two locking connectors 3200 may each be engaged to separate opening 3304 in the side of the crate 100 in a similar manner as explained above. For example, a first locking connector 3200 may be engaged within a first opening 3304 of the side 112 of the crate 100 and a second locking connection may be engaged with a second opening of the side of the crate. Each locking connector 3200 may include a locking portion that engages with a corresponding opening 3304 of the crate 100 and a handle attachment portion corresponding to the circular receptacles 4114 of the handle attachment 4110. In particular, the circular receptacles 4114 may each comprise a mating slot 4116 on a top edge of the receptacle. A corresponding circular tab of the locking connector 3200 may be slid into a corresponding mating slot 4116 of the handle 4110 to engage the handle with the locking connectors. The tabs of the locking connectors 3200 may be held within the circular receptacles 4114 through friction such that the crate 100 may be lifted by the attachment handle. More particularly, when lifted, the tabs of the locking connectors 3200 may engage a lower inner surface 4118 of the circular receptacles 4114 such that the entire crate 100, and contents within, may be carried by the handle portion 4112 of the attachment 4110.

Figure 42A:
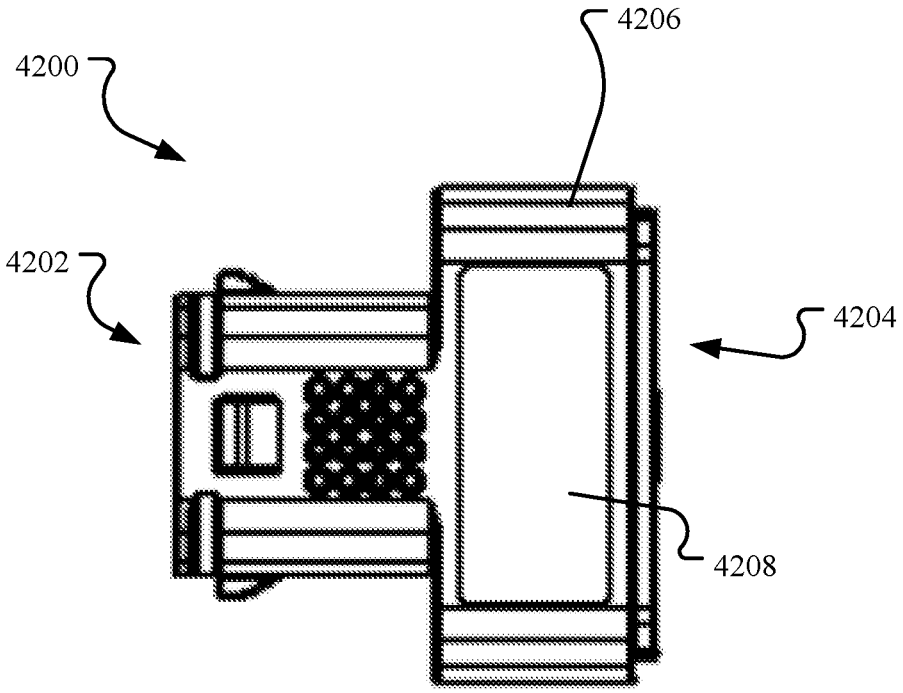
FIG. 42A shows a side view and FIG. 42B shows an isometric view of a tether rope attachment for connection to a side of the crate.
Figure 42B:
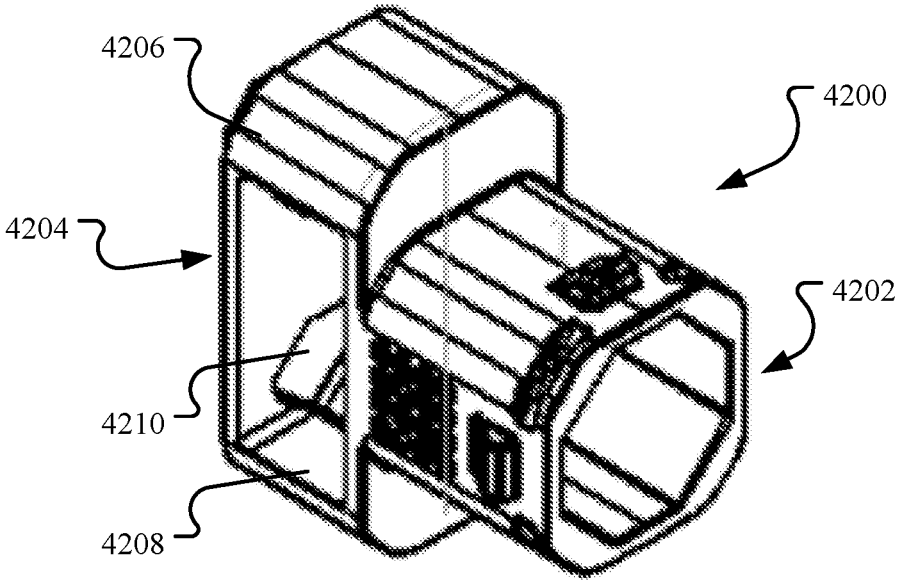

FIG. 42A shows a side view and FIG. 42B shows an isometric view of a tether rope attachment 4200 for connection to a side 118 of the crate 100. The tether rope attachment 4200, in general, provides a mechanism for attaching a tether rope to the crate 100 via the attachment. The tether rope attachment 4200 may include a connector portion 4202 similar to that described above. The connector portion 4202 may therefore attach to and lock into place in a diamond-shaped opening 3304 in the side 118 of the crate 100. Extending from the front of the connector portion 4202 is a rope attachment portion 4204 for receiving a tether rope or other type of connecting rope or strap. The rope attachment portion 4204 may include a housing 4206 that is generally oval in shape with an opening 4208 on either side of the housing. The opening 4208 on the side of the housing 4206 of the rope attachment portion 4204 may have a larger height than a width, defining a general rectangular shape. The openings 4208 on either side of the housing 4206 may be oriented opposite each other such that a rope or tether may pass through the housing through both openings. In some implementations, such as that shown in FIG. 42B, one or more engagement surfaces 4210 may be disposed within the housing 4206. A rope or tether that passes through the openings 4208 may be located against the engagement surfaces 4210. The engagement surfaces 4210 may receive the majority of the force the rope or tether applies to the tether rope attachment 4200 to remove strain on the housing 4206. The tether rope attachment 4200 may be constructed to withstand the strain of a lifting of the crate 100 and the contents therein by a rope or tether passing through the rope attachment portion 4204 of the tether rope attachment 4200.

Figure 43A:
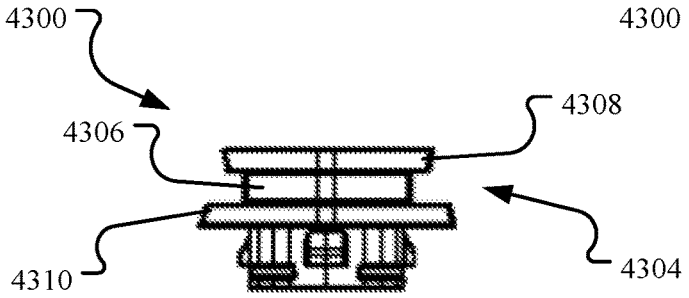
FIGS. 43A-43D show various views of a diamond-shaped tether rope attachment for connection to a side of the crate.
Figure 43B:
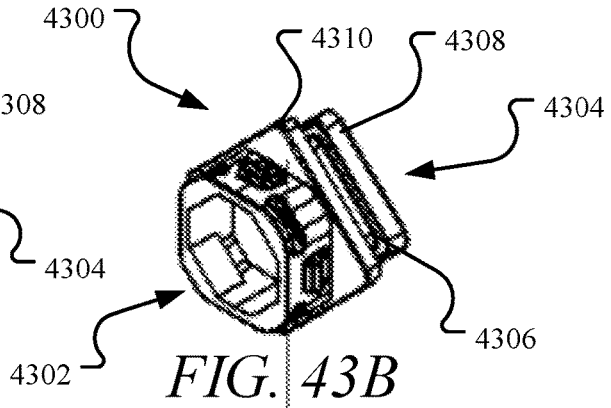
Figure 43C:
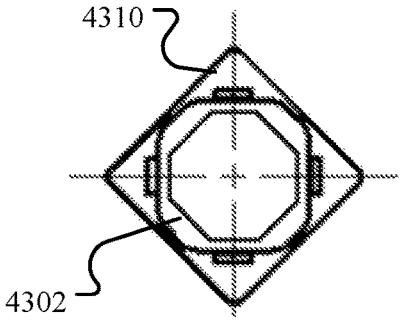
Figure 43D:
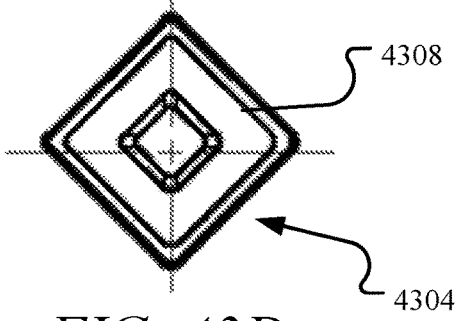

An alternate tether rope attachment is illustrated in FIGS. 43A-43D. In particular, FIG. 43A illustrates a side view of a second tether rope attachment, FIG. 43B illustrates an isometric view of the second tether rope attachment, FIG. 43C illustrates a back view of the second tether rope attachment, and FIG. 43D illustrates a front view of the second tether rope attachment. Similar to the tether rope attachment 4200 described above, the second tether rope attachment 4300 may include a connector portion 4302 similar to that described above for attaching to and locking into place in a diamond-shaped opening 3304 in the side 118 of the crate 100. Extending from the front of the connector portion 4202 is a second rope attachment portion 4304 for receiving a tether rope or other type of connecting rope or strap. In one implementation, the second rope attachment portion 4304 may include a series of parallel diamond shape surfaces 4306-4310. For example, a first diamond-shaped surface 4310 may be adjacent to the connector portion 4302 of the attachment 4300. A rearward portion of the first diamond-shaped surface 4310 may contact the side 118 of the crate 100 when the connector portion 4302 is engaged within the opening of the crate side. A second diamond-shaped surface 4306 may be adjacent to and extend forward from the first diamond-shaped surface 4310. A diameter of the second diamond-shaped surface 4306 may be less than a diameter of the first diamond-shaped surface 4310. A third diamond-shaped surface 4308 may be adjacent to and extend forward from the second diamond-shaped surface 4306. A diameter of the third diamond-shaped surface 4308 may be more than a diameter of the second diamond-shaped surface 4306. In some implementations, the diameter of the third diamond-shaped surface 4308 may be less than a diameter of the first diamond-shaped surface 4310, although not required.

Figure 44:
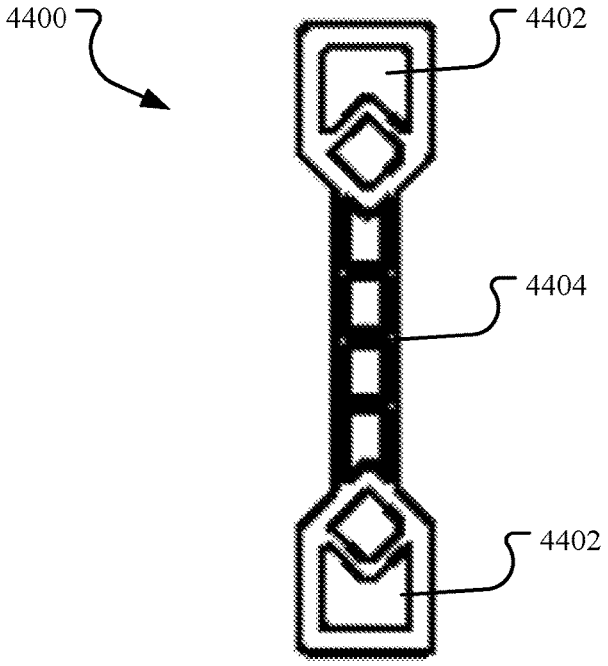
FIG. 44 shows a top view of a tether rope for connection to the tether rope attachments of the crate.

Each of the diamond-shaped surfaces 4306-4310 may have a width of various distances. Further, as the diameter of the second diamond-shaped surface 4306 is less than the diameter of the first diamond-shaped surface 4310 and the diameter of the third diamond-shaped surface 4308, the three surfaces form a diamond-shape groove in the second rope attachment portion 4304. The groove 4306 of the rope attachment portion 4304 may receive a connector portion of a tether or rope and hold the tether or rope within the groove for lifting of the crate 100. For example, FIG. 44 illustrates an example tether strap 4400 for use with the second tether attachment 4300. The tether strap 4400 may include a connector 4402 on either end of the tether strap and connected by a length of material 4404. Each connector 4402 of the tether strap 4400 may connect to and lock with the rope attachment portion 4304 of the tether rope attachment 4300 connector.

Figure 45A:
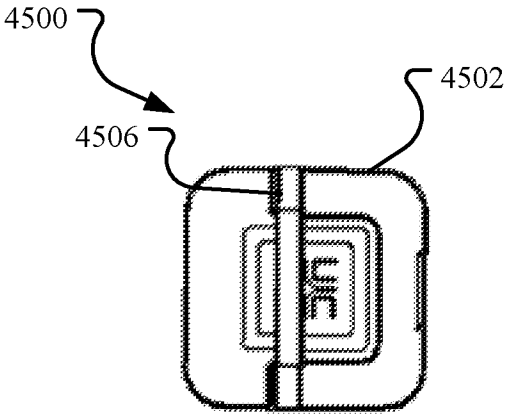
FIG. 45A-45C show various views of a first crate connector clip for connecting two crates together.
Figure 45B:
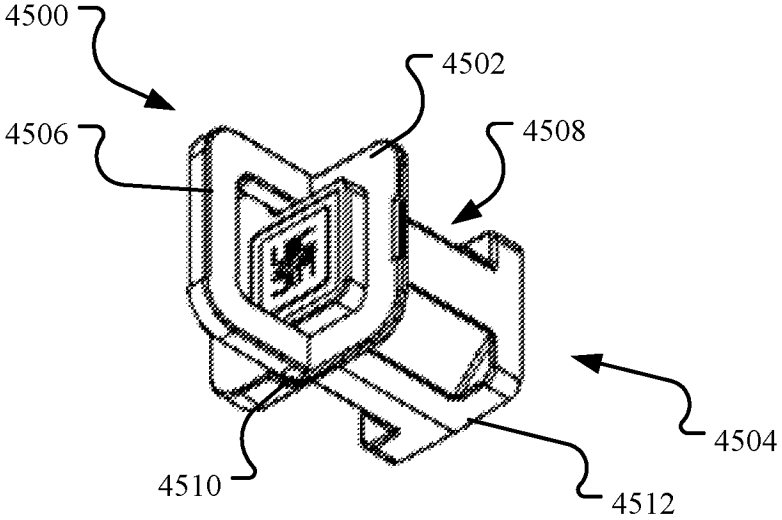
Figure 45C:
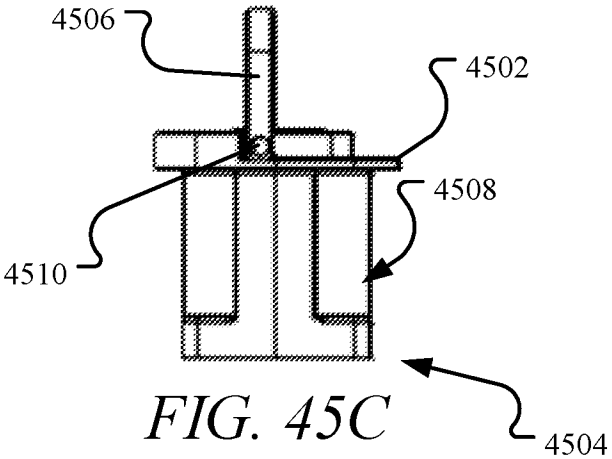

In another implementation, an attachment may be used to lock two crates 100 together. In particular, FIGS. 45A-45C illustrate a first connector clip for connecting two crates together. FIG. 45A shows a front view, FIG. 45B shows an isometric view, and FIG. 45C shows a side view of the first connector clip 4500. As above, the first connector 4500 may include a connector portion 4504 similar to the connectors 3200 discussed above. However, in this implementation, the locking grooves 4508 may extend from a front plate 4502 to a distance near the rearward edge 4512 of the connector 4500. The locking grooves 4508 provide adequate space for multiple spines 3302 of the side 118 of the crate 100 to engage with and be held by the locking grooves. In particular, the spines 3302 from two crates may be held within the locking grooves 4508, as described in more detail below. The first connector clip 4500 may also include a handle 4506 extending forward from the front plate 4502. The handle 4506 may be used to twist the connector 4500 to lock the connector onto the two crates. In one implementation, the handle 4506 may be connected to the front plate 4502 via one or more hinges 4510. In particular, the handle 4506 may be rotated about the hinge 4510 from a position abutting the front plate 4502 to a position substantially perpendicular to the front plate. Other implementations of the first connector clip 4500 may not include a handle 4506 or a hinge connection 4510 such that the handle remains in the extended position.

As noted above, the first connector clip 4500 may connect or lock two crates together. To connect the crates 100, the first connector clip 4500 may be inserted through an opening 3304 of a side 118 of a first crate 100 and a corresponding opening of a side of a second crate. For example, the connector portion 4504 of the first connector clip 4500 may be inserted through an opening 3304 of a side of a first crate 100 from an interior space of the crate such that the face plate 4502 and handle 4506 face into the interior of the crate. A second crate may be located next to the first crate such that an opening 3304 of the side of the second crate 100 aligns with the opening of the side of the first crate. In this position, the connector portion 4504 of the connector clip 4500 may pass through the opening in the second crate. The connector portion 4504 may be long enough to extend into the interior of the second crate through the two aligned openings. As described above, the first connector clip 4500 may be rotated, such as by a quarter turn in either direction, to engage the spines 3302 of the openings 3304 of the crates 100 within the locking grooves 4508 of the connector. The handle 4506 may aid in rotating the connector clip 4500 while within the side openings 3304. Similar to the connector 3200 described above, the rotation of the first connector clip 4500 locks the clip into place within the diamond-shaped openings 3304. Further, the clip may hold the first crate 100 and the second crate together as the side 118 of each crate is locked within the first connector clip. More than one such clip 4500 may be used to lock crates together through multiple openings within the sides of the crates. Further, multiple crates 100 may be locked together in any direction, such as up, down, left, right, front, back, and so on. In this manner, the first connector clip 4500 provides a mechanism for connecting two or more crates together.

Figure 46A:
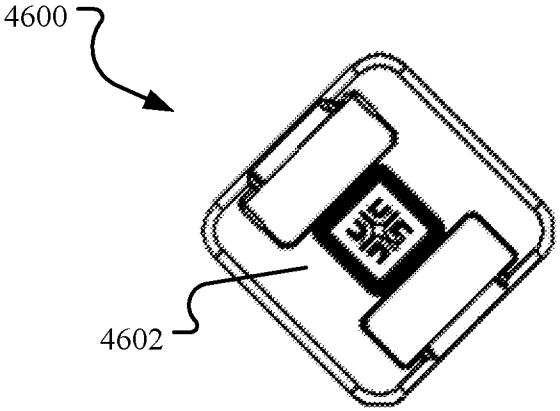
FIG. 46A shows a front view and FIG. 46B shows a side view of a second crate connector clip for connecting two crates together.
Figure 46B:
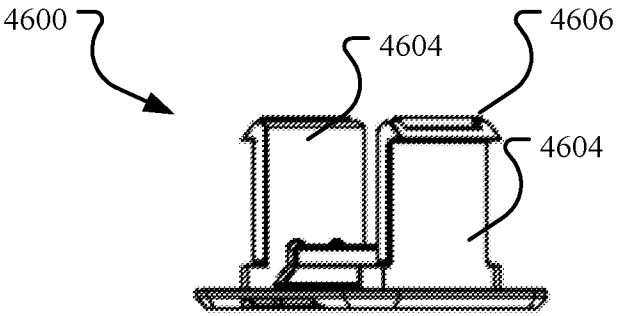

FIGS. 46A and 46B illustrate a second connector clip 4600 for connecting two crates together. The second connector clip 4600 includes a substantially flat front faceplate 4602. Extending rearward from the faceplate 4602 are two clip extensions 4604, each extending from opposing edges of the rearward surface of the faceplate. A rearward edge of each of the clip extensions 4604 (opposite the faceplate 4602) may include a flared end 4606 that creates a hook at the rearward end of the extensions. The hook 4606 is oriented to extend away from a center of the second connector clip 4600. Similar to above, the second connector clip 4600 may lock or otherwise hold two crates together by inserting the clip through aligned openings 3304 in the sides of the aligned crates 100. More particularly, the clip extensions 4604 of the second connector clip 4600 may be inserted through an opening 3304 of a side of a first crate 100 from an interior space of the crate such that the face plate 4602 faces into the interior of the crate. A second crate may be located next to the first crate such that an opening 3304 of the side of the second crate 100 aligns with the opening of the side of the first crate. In this position, the two clip extensions 4604 of the connector clip 4600 may pass through the opening in the second crate. The two clip extensions 4604 may be long enough to extend at least partially into the interior of the second crate through the two aligned openings. Further, the flared ends 4606 on the rearward ends of the clip extensions 4604 may engage with a corresponding spine 3302 on the opening 3304 of the second crate to hold the second crate to the first crate. More particularly, the clip extensions 4604 may flex inward as the rearward edge of the extensions contact the spines 3302 of the opening 3304 of the second crate. As the rearward edges extend past the spines 3302, the extensions 4604 may snap back into an orientation in which an underside surface of the hook portions contact the spines. The hook portions 4606 may hold the second connector clip 4600 in place within the corresponding openings of the first and second crate, effectively locking the crates together. In general, however, any mechanism may be included on a clip connector to lock two or more crates together.

Based upon design preferences, it is understood that the specific order or hierarchy of steps in the methods described herein, as well as the directional references, can be rearranged while remaining within the disclosed subject matter. Any accompanying method claims present elements of the various steps in a sample order and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

The above specification and examples provide a complete description of the structure and use of example implementations of the invention. Various modifications and additions can be made to the exemplary implementations discussed without departing from the spirit and scope of the presently disclosed technology. For example, while the implementations described above refer to particular features, the scope of this disclosure also includes implementations having different combinations of features and implementations that do not include all of the described features. Accordingly, the scope of the presently disclosed technology is intended to embrace all such alternatives, modifications, and variations together with all equivalents thereof.

What is claimed is:

1. A modular attachment system for a storage device, the modular attachment system comprising:

a connector portion configured to be inserted into an opening of a side panel of the storage device in a first position and locked into the opening of the side panel in a second position, wherein the side panel of the storage device comprises a plurality of intersecting spines defining the opening of the side panel, the connector portion comprising:

a tubular connector body comprising a first end and a second end opposite the first end, the connector body further comprising an outer surface extending between the first end and the second end;

a plurality of stopping tabs extending outwardly from the outer surface, each of the plurality of stopping tabs comprising a substantially vertical surface abutting a corresponding one of the plurality of intersecting spines of the side panel of the storage device as the tubular connector body is inserted into the opening of the side panel, the insertion of the tubular connector body into the opening of the side panel corresponding to the first position; and a plurality of locking grooves extending into the outer surface, each of the plurality of locking grooves receiving one of the plurality of intersecting spines defining the opening of the side panel of the storage device when the connector body is rotated from the first position to the second position, wherein the position of the plurality of intersecting spines within the plurality of locking grooves locks the connector portion within the opening of the side panel; and an attachment portion mated with and extending from the first end of the connector body.

2. The modular attachment system of claim 1 further comprising:

a gripping feature disposed on the outer surface of the connector body.

3. The modular attachment system of claim 2 wherein the gripping feature comprises a plurality of indentations in the outer surface.

4. The modular attachment system of claim 2 wherein the gripping feature comprises a plurality of ridges extending from the outer surface.

5. The modular attachment system of claim 2 wherein the gripping feature is disposed on the outer surface of the connector body closer to the first end than at least one of the plurality of stopping tabs.

6. The modular attachment system of claim 1 wherein the plurality of stopping tabs are arranged on the outer surface at a first distance from the second end of the connector body and the plurality of locking grooves are arranged in the outer surface at a second distance from the second end of the connector body, the second distance less than the first distance.

7. The modular attachment system of claim 6 wherein the surface of the plurality of stopping tabs is aligned with a forward surface of the plurality of locking grooves around a circumference of the connector body.

8. The modular attachment system of claim 1 wherein the connector body is octagonal, and wherein the plurality of stopping tabs are disposed on four opposing sides of the connector body.

9. The modular attachment system of claim 8 wherein the plurality of locking grooves are disposed on four opposing sides of the connector body adjacent to the four opposing sides of the plurality of stopping tabs.

10. The modular attachment system of claim 9 wherein the plurality of stopping tabs and the plurality of locking grooves are alternately disposed around a circumference of the outer surface.

11. The modular attachment system of claim 1 wherein the attachment portion comprises a handle for carrying the storage device.

12. The modular attachment system of claim 1 wherein the attachment portion comprises a hoop extending from the connector portion, the hoop configured to retain a receptacle upright within the hoop.

13. The modular attachment system of claim 1 wherein the attachment portion comprises a saddle configured for retaining a tool within the saddle.

14. The modular attachment system of claim 1 wherein the connector body further comprises an opening in the first end, the opening in the first end receiving the attachment portion.

15. The modular attachment system of claim 1 wherein the attachment portion comprises a tether opening for retaining a tether within the opening.

* * * * *